US006151005A

United States Patent [19]

Takita et al.

[11] Patent Number: 6,151,005

[45] Date of Patent: Nov. 21, 2000

[54] LIQUID-CRYSTAL DISPLAY SYSTEM HAVING A DRIVER CIRCUIT CAPABLE OF MULTI-COLOR DISPLAY

[75] Inventors: Isao Takita, Fujisawa; Tsutomu Furuhashi, Yokohama; Hiroyuki Nitta, Fujisawa; Toshio Futami, Mobara; Satoru Tsunekawa, Higashimurayama, all of Japan

[73] Assignee: Hitachi, Ltd., Tokyo, Japan

[21] Appl. No.: 08/132,998

[22] Filed: Oct. 7, 1993

[30] Foreign Application Priority Data

| | | | |
|---|---|---|---|
| Oct. 7, 1992 | [JP] | Japan | 4-268908 |
| Apr. 16, 1993 | [JP] | Japan | 5-89686 |
| Jul. 9, 1993 | [JP] | Japan | 5-170647 |

[51] Int. Cl.[7] ..... G09G 3/36

[52] U.S. Cl. ..... 345/89; 345/95

[58] Field of Search ..... 345/54, 87, 92, 345/94, 95, 97, 98, 99, 211, 212; 359/54, 59

[56] References Cited

U.S. PATENT DOCUMENTS

| | | | |
|---|---|---|---|
| 5,066,945 | 11/1991 | Kanno et al. | 359/56 |
| 5,214,417 | 5/1993 | Yamazaki | 345/95 |
| 5,309,151 | 5/1994 | Aoki | 345/211 |

FOREIGN PATENT DOCUMENTS

| | | | |
|---|---|---|---|
| 0478371 | 1/1992 | European Pat. Off. | 345/98 |
| 2-130586 | 5/1990 | Japan . | |
| 4-369624 | 12/1992 | Japan . | |

*Primary Examiner*—Chanh Nguyen

*Attorney, Agent, or Firm*—Antonelli, Terry, Stout & Kraus, LLP

[57] ABSTRACT

A liquid-crystal display system comprising a voltage divider circuit, and a gate circuit. The voltage divider circuit divides n voltages of n different voltage levels supplied from a power source for liquid-crystal displays, into m voltages of m different voltage levels (n<m), n and m are integers large than 1 corresponding to display data. A control signal commands the gate circuit to deliver a first voltage during the first period of one horizontal scanning cycle, and to deliver a second voltage during the second period thereof subsequent to the first period. In response to the control signal, the gate circuit corrects a signal corresponding to the display data and delivers the corrected signal during the first period so as to select a circuit which has a time constant not exceeding that of a circuit for delivering a voltage corresponding to the display data, from among circuits for supplying the m divisional voltages, and it delivers the signal left intact, during the second period. The voltage divider circuit is supplied with the output signal of the gate circuit, and it selects and delivers the voltage. Thus, the selected voltage is delivered directly without a buffer, and the liquid-crystal panel of the display system can be quickly driven.

52 Claims, 62 Drawing Sheets

| LATCHED DATA 2511 | | | VOL SEL CNT SIGNAL | | | | | | | |
|---|---|---|---|---|---|---|---|---|---|---|
| D5 | D4 | D3 | SU7 | SU6 | SU5 | SU4 | SU3 | SU2 | SU1 | SU0 |
| 0 | 0 | 0 | 0 | 0 | 0 | 0 | 0 | 0 | 0 | 1 |
| 0 | 0 | 1 | 0 | 0 | 0 | 0 | 0 | 0 | 1 | 0 |
| 0 | 1 | 0 | 0 | 0 | 0 | 0 | 0 | 1 | 0 | 0 |
| 0 | 1 | 1 | 0 | 0 | 0 | 0 | 1 | 0 | 0 | 0 |
| 1 | 0 | 0 | 0 | 0 | 0 | 1 | 0 | 0 | 0 | 0 |
| 1 | 0 | 1 | 0 | 0 | 1 | 0 | 0 | 0 | 0 | 0 |
| 1 | 1 | 0 | 0 | 1 | 0 | 0 | 0 | 0 | 0 | 0 |
| 1 | 1 | 1 | 1 | 0 | 0 | 0 | 0 | 0 | 0 | 0 |

FIG. 27

| CL4 113 | LATCHED DATA 2511 | | | DIV VOL SEL CNT SIGNAL | | | | | | | |
|---|---|---|---|---|---|---|---|---|---|---|---|
| | D2 | D1 | D0 | SL7 | SL6 | SL5 | SL4 | SL3 | SL2 | SL1 | SL0 |
| 0 | 0 | 0 | 0 | 0 | 0 | 0 | 0 | 0 | 0 | 0 | 1 |
| | 0 | 0 | 1 | 0 | 0 | 0 | 0 | 0 | 0 | 1 | 0 |
| | 0 | 1 | 0 | 0 | 0 | 0 | 0 | 0 | 1 | 0 | 0 |
| | 0 | 1 | 1 | 0 | 0 | 0 | 0 | 1 | 0 | 0 | 0 |
| | 1 | 0 | 0 | 0 | 0 | 0 | 1 | 0 | 0 | 0 | 0 |
| | 1 | 0 | 1 | 0 | 0 | 1 | 0 | 0 | 0 | 0 | 0 |
| | 1 | 1 | 0 | 0 | 1 | 0 | 0 | 0 | 0 | 0 | 0 |
| | 1 | 1 | 1 | 1 | 0 | 0 | 0 | 0 | 0 | 0 | 0 |
| 1 | X | X | X | 1 | 0 | 0 | 0 | 0 | 0 | 0 | 0 |

FIG. 28

LIQUID-CRYSTAL DISPLAY SYSTEM HAVING A DRIVER CIRCUIT CAPABLE OF MULTI-COLOR DISPLAY

BACKGROUND OF THE INVENTION

1. Field of the Invention

The present invention relates to a liquid-crystal display system capable of multiple-tone or multicolor displays, and more particularly to a liquid-crystal driving circuit for use in the liquid-crystal display system.

2. Description of the Related Art

A scheme for the liquid-crystal driving circuit of a liquid-crystal display system which displays multiple tones is disclosed in the official gazette of Japanese Patent Application Laid-open No. 130586/1990 entitled "Liquid-crystal display driving apparatus". This scheme will be explained with reference to FIGS. 37 and 38. FIG. 37 is a block diagram of the liquid-crystal driving circuit in the prior-art scheme, while FIG. 38 is a block diagram of a voltage divider circuit in the prior-art scheme.

Referring to FIG. 37, numeral 3701 indicates a shift register, numeral 3702 a clock, numeral 3703 the output bus of the shift register 3701, numeral 3704 a display data bus of 8 bits corresponding to display data of 256 tones, numeral 3705 a latch circuit configured of (X+1) latches, and numeral 3706 the output bus of the latch circuit 3705. In synchronism with the clock 3702, the shift register 3701 asserts its respective outputs S0 to SX one by one for time periods each being equal to one cycle of the clock signal 3702 and delivers the outputs to the output bus 3703 in succession. The display data are propagated to the display data bus 3704 in synchronism with the clock 3702. When the outputs S0 to SX of the shift register 3701 have been asserted or validated, the respective latches in the latch circuit 3705 corresponding to the asserted outputs S0 to SX operate to latch the display data therein from the display data bus 3704. The latched display data are delivered to the output bus 3706 as the latched data of the latch circuit 3705.

Besides, numeral 3707 indicates a clock synchronized with a horizontal synchronizing signal, numeral 3708 a latch circuit, numeral 3709 the output bus of the latch circuit 3708 for the upper 4 bits of the latched display data of this latch circuit, and numeral 3710 the output bus of the latch circuit 3708 for the lower 4 bits of the latched display data of this latch circuit. When the clock 3707 has been asserted, each of latches constituting the latch circuit 3708 operates to latch the latched data transferred by the output bus 3706 of the latch circuit 3705. Among the display data thus latched by each latch of the latch circuit 3708, the upper 4 bits are delivered from the output bus 3709, and the lower 4 bits are delivered from the output bus 3710.

The liquid-crystal driving circuit further includes a voltage bus 3711 which supplies voltages of 17 levels, voltage selectors 3712 each of which has an output bus 3713 and selects two of the 17-level voltages of the voltage bus 3711, voltage divider circuits 3714 each of which has an output bus 3715, and buffer circuits 3716 each of which has an output line 3717.

The voltage selector 3712 selects the voltages of 2 levels among voltages corresponding to the latched data of the output bus 3709 and then delivers the selected voltages to the output bus 3713. The voltage divider circuit 3714 divides the voltages of the 2 levels supplied from the output bus 3713, into voltages of 16 levels, and it selects a voltage corresponding to the latched data of the output bus 3710 from among the divisional voltages of the 16 levels and then delivers the selected voltage to the output bus 3715. Since the output bus 3715 of the voltage divider circuit 3714 has a high output impedance, it cannot directly drive a liquid-crystal element at high speed. Therefore, the buffer circuit 3716 is disposed to amplify the voltage of the output bus 3715 and to deliver the amplified voltage to the output line 3717. The output line 3717 is connected to the liquid-crystal element which constitutes a liquid-crystal panel. In this way, the voltage corresponding to the display data can be applied to the liquid-crystal element.

Referring to FIG. 38, numerals 3801 and 3802 indicate the upper-potential selection voltage and the lower-potential selection voltage which have been selected by the voltage selector 3712, respectively. In addition, numeral 3804 designates a group of selector elements (switching elements SWL0 to SWL3 and SWR0 to SWR3), numeral 3805 a group of weighted voltage divider resistors, and numeral 3806 a group of inverter circuits for inverting the display data 3710. Shown at numeral 3807 are inverted data generated by the inverter circuits 3806.

The operation of the liquid-crystal driving circuit in the prior art will be explained with reference to FIGS. 37 and 38.

When any of the outputs S0 to SX of the shift register 3701 has been asserted, the latch circuit 3705 latches the 8-bit display data of the display data bus 3704 therein and delivers the latched data to the output bus 3706. When the clock 3707 has been asserted, the latch circuit 3708 latches the latched data of the output bus 3706 therein. The latch circuit 3708 supplies the output bus 3709 with the upper 4 bits of the latched data and the output bus 3710 with the lower 4 bits. The output bus 3709 is led to the voltage selector 3712, which selects the two voltage levels corresponding to the latched data from the voltage levels of the voltage bus 3711 and delivers the selected voltage levels to the output bus 3713.

The voltage divider circuit 3714 illustrated in detail in FIG. 38 operates as stated below. The output bus 3713 is configured of the lines of the upper potential side selection voltage 3801 and the lower potential side selection voltage 3802, and these lines are respectively connected to both the ends of the group of voltage divider resistors 3805 connected in series. Any of the selector elements 3804 is selected depending upon the value of the display data 3710 of the lower 4 bits. Thus, the potential difference between the high potential side selection voltage 3801 and the low potential side selection voltage 3802 is divided in 16, and the resulting voltage is delivered to the output bus 3715. By way of example, in a case where the display data 3710 of the lower 4 bits is "0011", the inverted data 3807 generated by the inverter circuits 3806 becomes "1100", and the corresponding one of the selector elements 3804 falls into a conductive state. In consequence, the output bus 3715 is supplied with the voltage expressed by $VL+(VU-VL)\times 3/16$.

Subsequently, the voltage delivered to the output bus 3715 is amplified by the buffer circuit 3716 so as to be capable of driving the liquid-crystal element. The amplified voltage is delivered to the output line 3717, and the voltage corresponding to the display data is applied to the liquid-crystal element.

In the prior-art circuit arrangement stated above, the switching elements and the voltage dividing resistor elements are connected in parallel. In order to mitigate the influences of the ON-resistances of the switching elements, therefore, the resistances of the voltage dividing resistor elements must be enlarged, so that the output impedance of the output bus 3715 heightens inevitably. This situation will be explained with reference to FIG. 8, which is an equivalent circuit diagram of the output portion of the voltage divider circuit (3714 in FIG. 37) shown in FIG. 38 and in which the ON-resistances of the switching elements are depicted by resistor elements. Referring to FIG. 8, it is supposed that the switching elements SWL0, SWL1, SWR2 and SWR3 turn ON, whereas the other switching elements turn OFF. Assuming here that the switching elements are ideal (that is, the ON-resistances $R_{ON}=0$ holds), the output voltage $V_{out}$ of the voltage divider circuit on this occasion becomes:

$$V_{out} = \frac{8R+4R}{R+2R+R+8R+4R}(VU-VL)+VL = \frac{12R}{16R}(VU-VL)+VL = \frac{3}{4}(VU-VL)+VL \quad \text{(Eq. 1)}$$

In actuality, however, the output voltage becomes:

$$V_{out} = \left(8R+4R+\frac{2R\cdot R_{ON}}{2R+R_{ON}}+\frac{R\cdot R_{ON}}{R+R_{ON}}\right)\Big/\left(R+\frac{8R\cdot R_{ON}}{8R+R_{ON}}+\frac{4R\cdot R_{ON}}{4R+R_{ON}}+2R+R+8R+4R+\frac{2R\cdot R_{ON}}{2R+R_{ON}}+\frac{R\cdot R_{ON}}{R+R_{ON}}\right)\times(VU-VL)+VL \quad \text{(Eq. 2)}$$

Thus, the actual output voltage differs from the ideal divisional voltage. In order to reduce the difference, the resistances of the voltage divider resistors must be enlarged.

Moreover, since the voltage divider resistors are connected in series, increase in the number of voltage divisions heightens the output impedance.

In driving the liquid-crystal panel at high speed under the condition of the high output impedance, the buffer circuit (3716 in FIG. 37) needs to be disposed at the output stage of the voltage divider circuit (3714) for the purpose of lowering the output impedance. In the prior art, therefore, the output portion of the voltage divider circuit is furnished with the buffer circuit by which the liquid-crystal element can be driven. However, as the number of tones/colors has increased more, the voltage differences between the respectively adjacent tones have become smaller, and a higher precision has been required of the buffer circuits. In order to raise the precision of the buffer circuits, a correction circuit and external correction voltages are necessitated. This poses the problems that an increased number of input pins, a correction voltage generator circuit, etc. are needed, and that the scale of the liquid-crystal driving circuit enlarges.

Meanwhile, unless the buffer circuit is used, problems as stated below are involved in addition to the above problems. When the output of the voltage divider circuit is to be directly delivered to the liquid-crystal element, the output current thereof must be enlarged in order to attain a high responsibility (in order to quickly apply a predetermined voltage to the liquid-crystal element which can be regarded as a capacitor). In order to enlarge the output current, the output impedance of the voltage divider circuit must be lowered. Herein, in the case of employing the resistors as the voltage division means, the resistances of the voltage divider resistors must be reduced for lowering the output resistance of the voltage divider circuit. However, the reduction in the resistances of the voltage divider resistors is contradictory to the aforementioned requisite that the voltage division resistances must be enlarged for reducing the difference between the ideal and actual divisional voltages. In other words, the reduction in the resistances worsens the accuracy of the voltage divisions. Further, it incurs the problem of increase in the power consumption of the voltage divider circuit.

SUMMARY OF THE INVENTION

The first object of the present invention is to provide an X driver circuit whose responsibility can be enhanced without employing buffer circuits.

In the prior-art circuit arrangement, the buffer circuits are disposed at the output stage of the liquid-crystal driving circuit in order to quickly drive the liquid-crystal panel. Therefore, when the number of tones of the liquid-crystal panel has increased, a voltage width per tone narrows, and the dispersion of the offset voltages of the buffer circuits needs to be made smaller. In order to heighten the precision of the buffer circuits, however, the additional provision of the correction circuit and the enlargements of element sizes are involved, so that the chip area of the liquid-crystal driving circuit increases as stated before.

Here, the "offset voltage" signifies the difference between the actual output voltage and the output voltage corresponding to the standard values of the resistances of wiring and the characteristics of the elements, the difference being ascribable to the dispersions of the resistances and characteristics from the standard values. When such offset voltages enlarge to increase the dispersion of the output voltages, a nonuniform display develops to spoil the display quality of the liquid-crystal panel. The nonuniform display which can be recognized by man differs depending upon liquid crystals. In general, however, an intensity difference (the nonuniform display) is recognizable at a voltage difference of 30 [mV] to 50 [mV].

The second object of the present invention is to provide an X driver circuit which can lessen the dispersion of offset voltages without employing buffer circuits.

In the prior-art circuit arrangement, it is not considered that, since the operating voltage width of the buffer circuit becomes about −1.5 [V] narrower than the supply voltage width of the liquid-crystal driving circuit, the output voltage width becomes about −1.5 [V] narrower than the supply voltage width.

The third object of the present invention is to provide an X driver circuit which utilizes a supply voltage width effectively.

In order to accomplish the first object, in one aspect of performance of the present invention, a liquid-crystal display system for tonal displays, including a liquid-crystal panel having a plurality of scanning lines and a plurality of data lines disposed orthogonal to the scanning lines; a Y driver circuit by which one of the plurality of scanning lines to have a voltage applied thereto is selected, and which delivers the voltage to the selected one of the plurality of scanning lines; an X driver circuit which is supplied with display data, and which delivers a voltage corresponding to the display data to each of the plurality of data lines; and a power source for the liquid-crystal display system, which supplies voltages to the Y driver circuit and the X driver circuit, the supply voltages of the X driver circuit being in a number n; comprises a control signal generator circuit which delivers a time signal to the X driver circuit, the time signal commanding the X driver circuit to deliver a first voltage during a first period of one horizontal scanning cycle and to deliver a second voltage during a second period subsequent to the first period, the first voltage being supplied from a circuit that has a time constant smaller than that of a circuit for supplying the second voltage; the X driver circuit for each of the plurality of data lines including a voltage divider circuit by which the n voltages supplied from the power source for the liquid-crystal display system are divided into m voltages (n<m) corresponding to the display data, the voltage divider circuit having a plurality of selectable output terminals at which time constants thereof are different from one another; a signal correction circuit provided for each data line, which is supplied with the time signal and a signal corresponding to the display data, which corrects the signal corresponding to the display data and then delivers the corrected signal during the first period so as to select one of the output terminals that has a time constant not exceeding that of the output terminal for delivering the voltage corresponding to the display data, and which delivers the signal corresponding to the display data during the second period; and a selector circuit provided for each data line, which is supplied with the signal corresponding to the display data as delivered from the signal correction circuit, and which selects one of the m voltages in accordance with the signal corresponding to the display data and then delivers the selected voltage to a corresponding one of the plurality of data lines.

An X driver circuit into which display data to be displayed on a liquid-crystal panel is supplied, and which delivers a voltage corresponding to the display data to each data line of the liquid-crystal panel; may well comprise a voltage divider circuit provided for each data line, by which n voltages externally supplied are divided into m voltages (n<m) corresponding to the display data; the voltage divider circuit including a first selector circuit which is supplied with the n unequal voltages, and which selects and delivers two of the supplied n voltages;

a first control circuit which controls the first selector circuit in accordance with the display data so as to select the two voltages; an output circuit which can deliver either of a plurality of divisional voltages produced from the selected voltages, and the supplied voltages; a second selector circuit which selects and delivers any of the plurality of divisional voltages and the supplied voltages; and a second control circuit which controls the second selector circuit under either of a voltage selection command externally supplied and a voltage selection command internally generated, so as to select the voltage to-be-delivered from either of the supplied voltages and the plurality of divisional voltages corresponding to the display data; the voltage selection command being a command for selecting a higher one of the two voltages selected by the first selector circuit, during a first period, while it is a command for selecting the divisional voltage corresponding to the display data, during a second period subsequent to the first period.

Besides, in order to accomplish the second object, the X driver circuit is so constructed that a magnitude of an offset voltage which is determined by a difference between the two voltages selected by the first selector circuit is smaller than a predetermined value.

Further, in order to accomplish the third object, the X driver circuit is so constructed that a maximum one of the a voltages externally supplied is identical to a power source voltage of the X driver circuit.

As described above, the voltage of low output impedance externally supplied is directly delivered for the certain period, and the voltage corresponding to the display data is thereafter delivered through the voltage divider circuit, whereby the liquid-crystal element can be quickly driven without lowering the voltage dividing resistances of the voltage divider circuit. Moreover, since the voltage dividing resistances of the voltage divider circuit need not be lowered, the precision can be held high, and the increase of the power consumption, as well as the enlargement of the circuit scale can be minimized.

In addition, the high level side voltage of the voltages of low output impedance externally supplied is directly delivered for the certain period, and the voltage corresponding to the display data is thereafter delivered through the voltage divider circuit, whereby the first object can be similarly accomplished.

Besides, the voltage divider circuit includes the second selector circuit which is connected across both the ends of a series connection that consists of resistors of resistances being sufficiently high as compared with the ON-resistance of the first selector circuit, and which selects and delivers any of the divisional voltages produced by the resistors. That is, even when the resistors of the resistances being sufficiently high as compared with the ON-resistance of the first selector circuit are employed for the voltage divider circuit in order to reduce the offset voltage, the output impedance of the voltage divider circuit can be lowered sufficiently during the period which is set for delivering the voltage through only the first selector circuit, so that the liquid-crystal panel can be quickly driven.

By the way, in setting the tonal voltages of the liquid crystal, the offset voltage needs to be reduced more in a region where the width between the adjacent tonal voltages is smaller. With the construction of the present invention, the offset voltage is proportional to the voltage width between the voltages selected by the first selector circuit. By reducing the voltage width, therefore, the offset voltage can be reduced with ease in a voltage setting region where it needs must be reduced.

Further, since each switching element has an operating voltage width equal to the width of the power source voltage, the width of the output voltage can be equalized to that of the power source voltage.

In this regard, let's consider an output voltage range by letting $V_{cc}$ denote the power source voltage. In the case of employing the output buffer circuit, the output voltage range becomes smaller than the power source voltage $V_{cc}$ because the operating voltage range of the output buffer circuit is smaller than the power source voltage $V_{cc}$. On the other hand, in the case of delivering the output voltage directly from the switching element, the output voltage range becomes the power source voltage $V_{cc}$ because the operating voltage range of the switching element is equal to the power source voltage $V_{cc}$.

BRIEF DESCRIPTION OF THE DRAWINGS

FIG. 27 is a truth table of the generation of control signals for the voltage divider circuit in the thirteenth embodiment of the present invention;

FIG. 28 is a truth table of the generation of control signals for the voltage divider circuit in the thirteenth embodiment of the present invention;

PREFERRED EMBODIMENTS OF THE INVENTION

Figure 1:
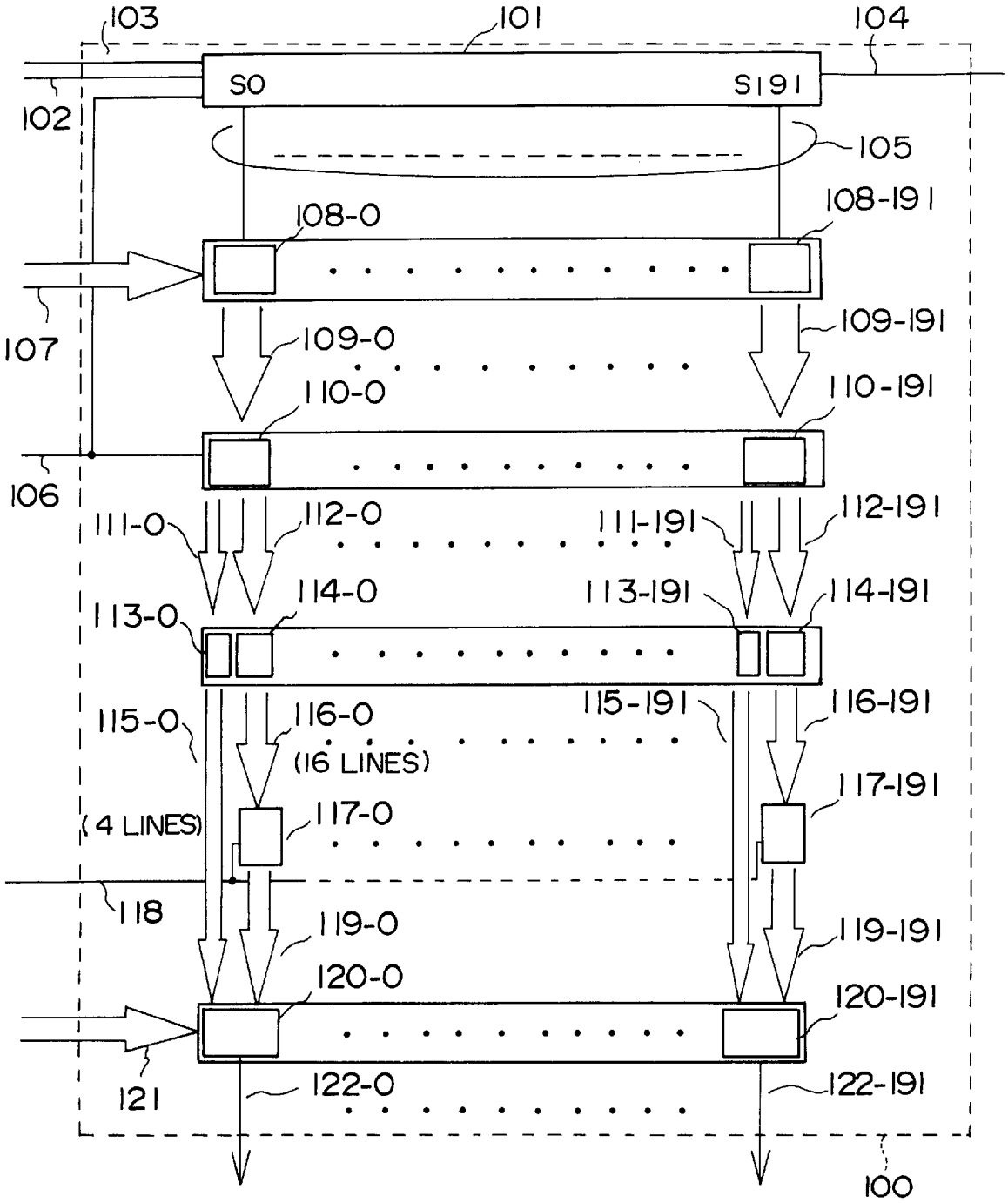
FIG. 1 is a simplified block diagram of an X driver circuit of 192 outputs in the first embodiment of the present invention.
Figure 2:
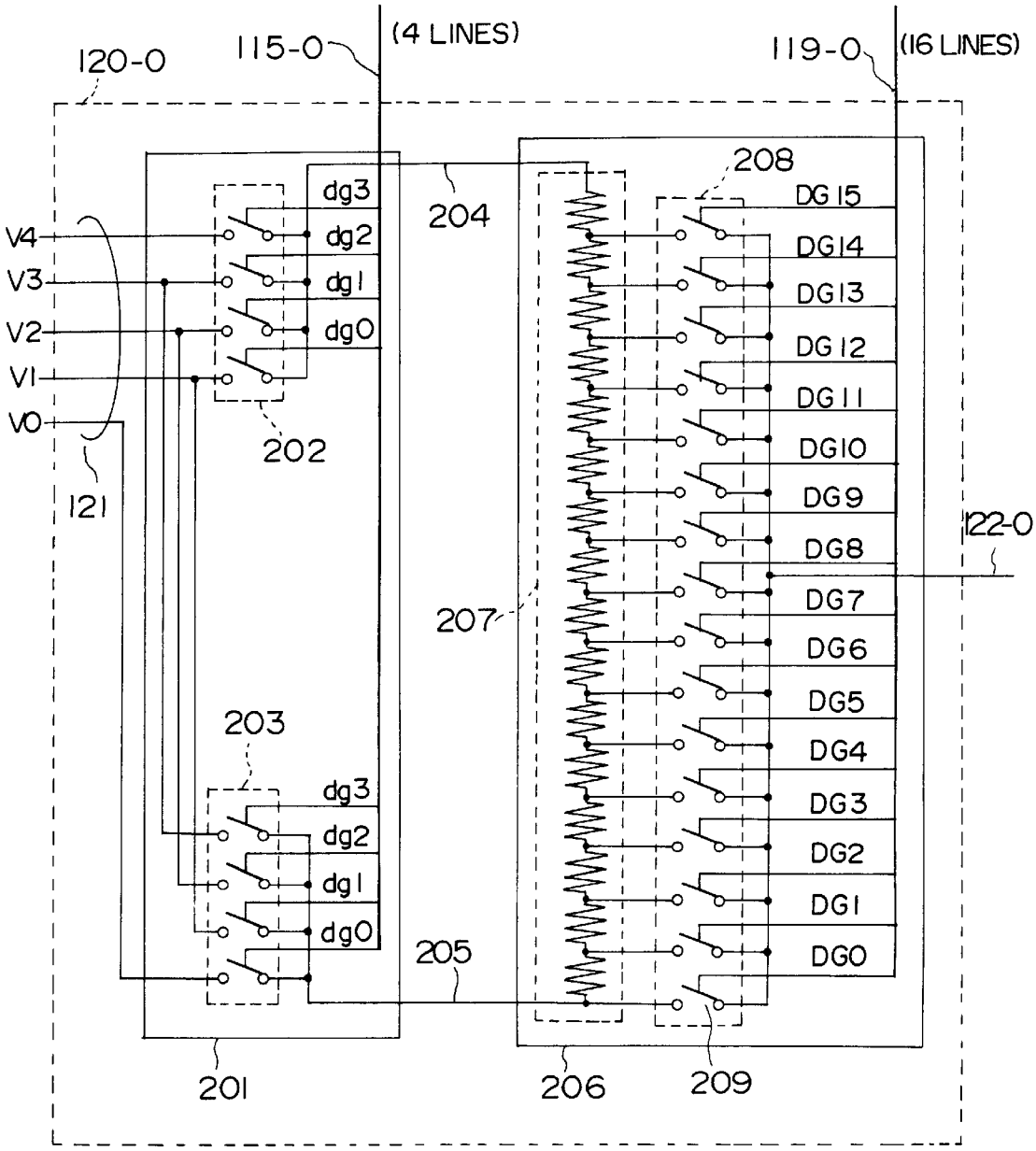
FIG. 2 is a simplified block diagram of a voltage divider circuit in the first embodiment of the present invention.
Figure 3:
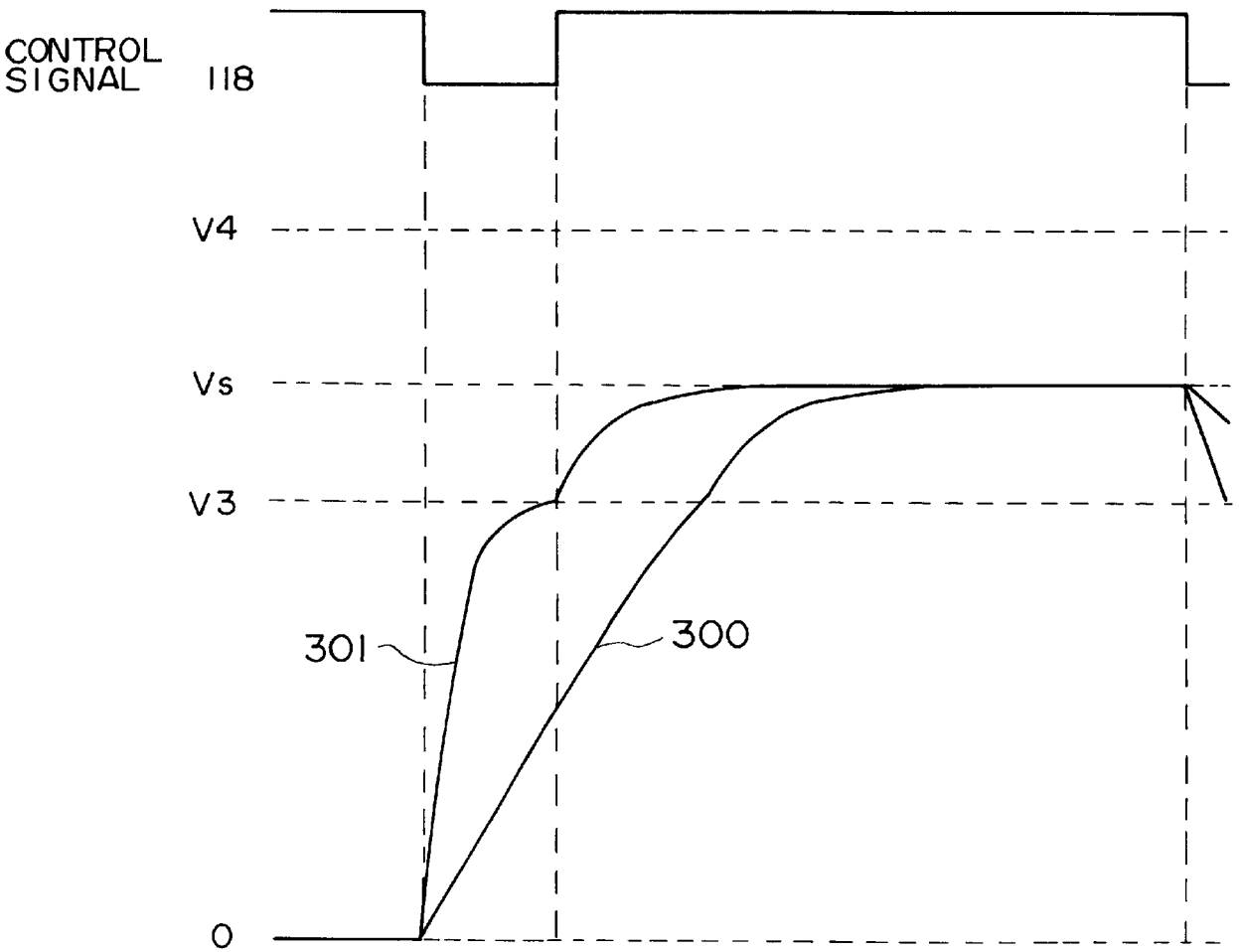
FIG. 3 is a diagram for explaining an output waveform in the first embodiment of the present invention.
Figure 9:
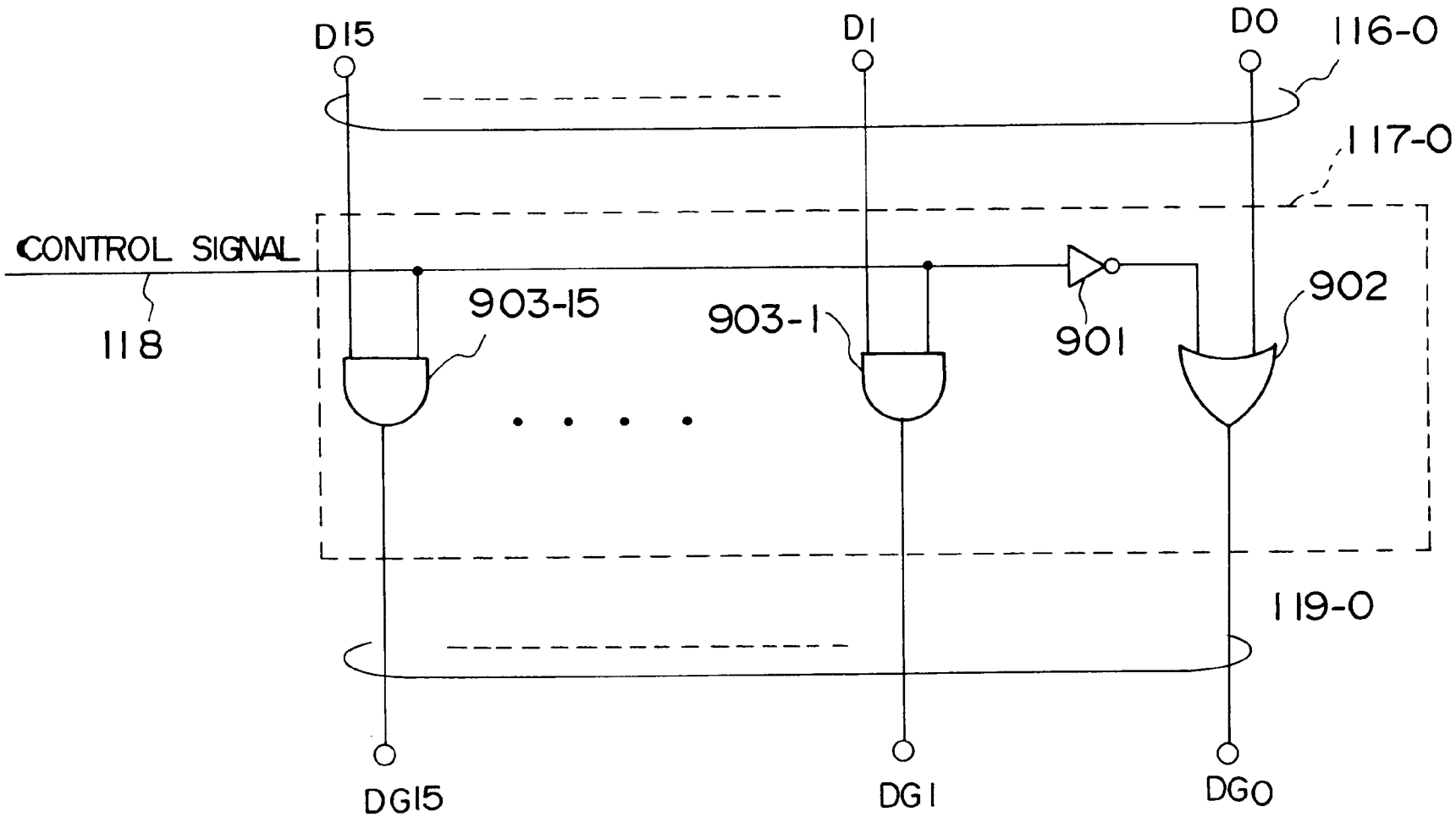
FIG. 9 is a simplified connection diagram of a gate circuit in the first embodiment of the present invention.

Now, the first embodiment of the present invention will be described with reference to FIGS. 1, 2, 3 and 9. FIG. 1 is a simplified block diagram of an X driver circuit of 192 outputs, FIG. 2 is a simplified block diagram of a voltage divider circuit, FIG. 3 is a diagram of output waveforms, and FIG. 9 is a simplified circuit diagram of a gate circuit.

FIG. 1 shows the X driver circuit 100 which has the outputs in the number of 192, and which can deliver voltages for 64 tones per output. Referring to FIG. 1, numeral 101 indicates a shift register, numeral 102 a clock, numeral 103 a control signal which is transferred from an X driver circuit at a preceding stage, numeral 104 a control signal which is transferred to an X driver circuit at a succeeding stage, numeral 105 the output bus of the shift register 101, and numeral 106 a latch clock.

When the control signal 103 transferred from the X driver circuit of the preceding stage has been asserted or validated, the shift register 101 asserts the respective outputs S0 to S191 of the output bus 105 for successive time periods each being equal to one cycle of the clock signal 102 in synchronism with this clock signal. When the shift register 101 has asserted the output S191, it asserts the control signal 104 transferred to the X driver circuit of the succeeding stage. Thereafter, the shift register 101 negates the output S191 after one cycle of the clock signal 102, and it does not operate until the control signal 103 transferred from the X driver circuit of the preceding stage is asserted after the subsequent assertion of the latch clock signal 106.

Numeral 107 designates a data bus for 6-bit display data which has binary digital data of "high" and "low" levels per bit. Symbols 108-0 to 108-191 denote latch circuits of 6 bits, respectively, while symbols 109-0 to 109-191 denote output buses of 6 bits, respectively.

The data bus 107 is supplied with the display data in synchronism with the clock signal 102. The corresponding output lines of the output bus 105 of the shift register 101 are respectively connected to the latch circuits 108-0 to 108-191. When the signals of the output lines have been asserted, the respective latch circuits 108-0 to 108-191 operate to latch the display data of the data bus 107 and to deliver the display data to the corresponding output buses 109-0 to 109-191 as latched data. In this way, the latch circuits 108-0 to 108-191 latch the display data in the number of 192 and deliver them to the output buses 109-0 to 109-191 successively in synchronism with the outputs of the shift register 101, respectively.

Symbols 110-0 to 110-191 denote latch circuits of 6 bits, respectively. Symbols 111-0 to 111-191 denote output buses for the upper 2 bits of the latched data of the respective latch circuits 110-0 to 110-191, while symbols 112-0 to 112-191 denote output buses for the lower 4 bits of the latched data of the respective latch circuits 110-0 to 110-191.

When the latch clock signal 106 has been asserted, the latch circuits 110-0 to 110-191 operate to simultaneously latch the latched data of the output buses 109-0 to 109-191 and to supply the output buses 111-0 to 111-191 with the latched data of the upper 2 bits and the output buses 112-0 to 112-191 with those of the lower 4 bits.

Symbols 113-0 to 113-191 denote decoders for decoding the data of the output buses 111-0 to 111-191, respectively, while symbols 114-0 to 114-191 denote decoders for decoding the data of the output buses 112-0 to 112-191, respectively. Output buses 115-0 to 115-191 transfer the decoded signals of the respective decoders 113-0 to 113-191, and each of them includes 4 signal lines. On the other hand, output buses 116-0 to 116-191 transfer the decoded signals of the respective decoders 114-0 to 114-191, and each of them includes 16 signal lines. Shown at symbols 117-0 to 117-191 are gate circuits whose control signal 118 is supplied from outside the X driver circuit 100 and is synchronous with the latch clock signal 106, and which have output buses 119-0 to 119-119, respectively.

The decoders-113-0 to 113-191 decode the data of the upper 2 bits delivered to the output buses 111-0 to 111-191 and then deliver the decoded signals to the output buses 115-0 to 115-191, respectively. Likewise, the decoders 114-0 to 114-191 decode the data of the lower 4 bits delivered to the output buses 112-0 to 112-191 and then deliver the decoded signals to the output buses 116-0 to 116-191, respectively. While the control signal 118 is negated or invalidated, the gate circuits 117-0 to 117-191 hold the output buses 119-0 to 119-191 of the lower 4 bits in nonconductive states and assert the output lines of the output buses 119-0 to 119-191 corresponding to a decoded value "0", respectively. When the control signal 118 has been asserted, the gate circuits 117-0 to 117-191 bring the output buses 116-0 to 116-191 and the output buses 119-0 to 119-191 into conductive states.

Symbols 120-0 to 120-191 denote voltage divider circuits which generate voltages corresponding to the display data, respectively. Shown at numeral 121 is a voltage bus to which voltages of 5 levels supplied from outside the X driver circuit 100 are propagated. The voltage divider circuits 120-0 to 120-191 have output lines 122-0 to 122-191, respectively.

The voltage divider circuits 120-0 to 120-191 generate the voltages corresponding to the data of the output buses 115-0 to 115-191 and the output buses 119-0 to 119-191, on the basis of the voltages of the voltage bus 121, and they deliver the generated voltages to the output lines 122-0 to 122-191, respectively. Since the output lines 122-0 to 122-191 are connected to a liquid-crystal panel, the voltages can be applied to liquid-crystal elements constituting the liquid-crystal panel.

As stated before, FIG. 9 is the simplified circuit diagram of the gate circuit which is included in the X driver circuit 100 shown in FIG. 1. Here, the gate circuit 117-0 shall be referred to.

In the output bus 116-0, symbol D0 denotes a signal which is asserted when the decoded value of the lower 4 bits of the display data is "0". Likewise, a signal D1 is asserted when the decoded value is "1", . . . , and a signal D15 is asserted when the decoded value is "15".

In FIG. 9, numeral 901 indicates an inverter circuit, and numeral 902 an OR circuits of 2 inputs. The inverter circuit 901 inverts the polarity of the control signal 118, and supplies the inverted signal to the OR circuit 902. Besides, the signal D0 of the output bus 116-0 is supplied to the OR circuit 902. When the control signal 118 is negated, that is, when it is "0", the OR circuit 902 is supplied with "1" by the inverter circuit 901. Thus, irrespective of the data of the input D0 of the output bus 116-0, the OR circuit 902 delivers "1" to its output DG0 and brings this output into an asserted state. On the other hand, when the control signal 118 is asserted, that is, when it is "1", the OR circuit 902 is supplied with "0" by the inverter circuit 901. Therefore, the data of the input D0 of the output bus 116-0 is delivered to the output DG0.

Symbols 903-1 to 903-15 denote AND circuits of 2 inputs, respectively. One of the 2 inputs of each of the AND circuits 903-1 to 903-15 is supplied with the control signal 118, while the other input is supplied with the corresponding one of the inputs D1 to D15 of the output bus 116-0. When the control signal 118 is negated, that is, when it is "0", all the outputs DG1 to DG15 of the respective AND circuits 903-1 to 903-15 become "0" and negated. On the other hand, when the control signal 118 is asserted, that is, when it is "1", the AND circuits 903-1 to 903-15 supply the outputs DG1 to DG15 of the output bus 119-0 with data having the same values as those of the data of the inputs D1 to D15 of the output bus 116-0, respectively.

The other gate circuits 117-1 to 117-191 in FIG. 1 perform similar operations.

As stated before, FIG. 2 is the block diagram of the voltage divider circuit which is included in the X driver circuit 100 shown in FIG. 1. Here, the voltage divider circuit 120-0 shall be referred to. It is assumed in FIG. 2 that the voltages of the voltage bus 121 are related as V4>V3>V2>V1>V0. Numeral 201 indicates a voltage selector, numeral 202 a group of selection switching elements on a high potential side, numeral 203 a group of selection switching elements on a low potential side, numeral 204 the high voltage side one of the outputs of the voltage selector 201, numeral 205 the low voltage side one of the outputs of the voltage selector 201, numeral 206 a voltage divider by which a voltage across the outputs 204 and 205 is divided into voltages of 16 levels including the voltage of the output 205, numeral 207 a group of voltage dividing resistors, numeral 208 a group of selection switching elements, and numeral 209 that one of the switching elements 208 which delivers the potential of the low potential side.

The voltage selector 201 brings one of the switching elements 202 on the high potential side and one of the switching elements 203 on the low potential side into conductive states in correspondence with the decoded signal of the output bus 115-0. Thus, it delivers the selected voltage of the high potential side to the output 204 and that of the low potential side to the output 205. Among the data of the output bus 115-0, an output dg0 is asserted when the decoded value of the upper 2 bits of the display data is "0". Likewise, an output dg1 is asserted when the decoded value is "1", an output dg2 is asserted when the decoded value is "2", and an output dg3 is asserted when the decoded value is "3". Here, the voltages V1 and V0 are selected subject to the assertion of the output dg0, and the voltages V2 and V1 are selected subject to the assertion of the output dg1. In this manner, the voltage selector 201 selects the voltage which corresponds to the decoded value and the voltage which is one level higher than the corresponding voltage.

The outputs 204 and 205 are supplied to the voltage divider 206. In accordance with the outputs DG0 to DG15 of the output bus 119-0, the voltage divider 206 selects one of the divisional voltages of the 16 levels including the potential of the output 205 and generated by the group of voltage dividing resistors 207, by means of any of the selection switching elements 208. Then, the selected voltage is delivered to the output line 122-0. More specifically, in a case where the output DG0 is asserted, the switching element 208 falls into the conductive state so as to select the potential of the output 205. Besides, in a case where the output DG1 is asserted, the first potential above the low potential side is selected from among the voltages which are obtained in such a way that the potential across the outputs 206 and 207 is divided by 15. In this manner, the (decoded value)th potential above the low potential side is selected in correspondence with the decoded value from among the 16 levels which consist of the potential of the output 205 and the voltages obtained by dividing the potential across the outputs 204 and 205 by 15.

Owing to such a circuit arrangement, the voltage divider circuit 120-0 can generate voltages for the 64 tones (=4 sets of voltages×16 divisional voltages) and can deliver the voltages corresponding to the display data of 6 bits.

The other voltage divider circuits 120-1 to 120-191 shown in FIG. 1 perform similar operations.

Now, the operation of the first embodiment will be described in detail with reference to FIGS. 1, 2, 3 and 9. The latch circuits 108-0 to 108-191 latch the display data of the data bus 107 successively in synchronism with the respective outputs S0 to S191 of the output bus 105 of the shift register 101, and deliver the latched outputs to the output buses 109-0 to 109-191. Assuming that the display data which is latched in the latch circuit 108-0 on this occasion is "110100" in an order from the most significant bit to the least significant bit, the data of the output bus 109-0 becomes "110100". Thereafter, the latch circuit 110-0 of the succeeding stage latches the data of the output bus 109-0 in synchronism with the latch clock signal 106, and it delivers the upper 2 bits of the latched data to the output bus 111-0 and the lower 4 bits to the output bus 112-0. The data "11" of the output bus 111-0 is supplied to the decoder 113-0, and is decoded therein. On the other hand, the data "0100" of the output bus 112-0 is supplied to the decoder 114-0, and is decoded therein. As a result, the decoded value of the data of the output bus 111-0 becomes "3", while the decoded value of the data of the output bus 112-0 becomes "4". Subsequently, those output lines of the output bus 115-0 of the decoder 113-0 and the output bus 116-0 of the decoder 114-0 which correspond to the respective decoded values "3" and "4" are asserted. The output bus 116-0 is connected to the gate circuit 117-0. The gate circuit 117-0 operates as stated below in conjunction with FIG. 9. Since the control signal 118 is negated, namely, "0" on this occasion, the output DG0 of the OR circuit 902 becomes asserted, namely, "1", and the outputs DG1 to DG15 of the respective AND circuits 903-1 to 903-15 become negated, namely, "0". The decoded value of these outputs is supplied to the voltage divider circuit 120-0 shown in FIG. 2, by the output bus 119-0. The voltage divider circuit 120-0 operates as stated below in conjunction with FIG. 2. The decoded value "3" of the upper 2 bits is supplied to the voltage selector 201 through the output bus 115-0. As a result, the voltage selector 201 delivers the voltage V4 to the output 204 and the voltage V3 to the output 205, thereby suppling the voltage divider 206 with these voltages. Since the voltage divider 206 is supplied with the decoded value "0" by the output bus 119-0, the switching element 209 corresponding to the output DG0 falls into the conductive state so as to deliver the voltage V3 to the output 122-0. Thus, the output impedance of the voltage divider circuit 120-0 lowers for the reason that no resistor is interposed between the output 122-0 and the V3 voltage line of the voltage bus 121. Thereafter, when the control signal 118 in FIG. 1 becomes asserted, namely, "1", the OR circuit 902 shown in FIG. 9 delivers the input data D0 of the output bus 116-0 to the output DG0 of the output bus 119-0, and the AND circuits 903-1 to 903-15 deliver the input data D1 to D15 of the output bus 116-0 to the outputs DG1 to DG15 of the output bus 119-0, respectively. On this occasion, the signal D4 of the output bus 116-0 corresponding to the decoded value "4" is asserted, and all the other signals thereof are negated. The outputs of the gate circuit 117-0 based on such input signals are supplied to the voltage divider 206 by the output bus 119-0 shown in FIG. 2. In a case where the voltage divider 206 divides the voltage levels at equal intervals, the switching element 208 to which the output DG4 is connected falls into the conductive state because of the assertion of the output DG4, and it supplies the output 122-0 with the following voltage:

$$V_s = V3 + (V4 - V3) \times 4/16$$

The other voltage divider circuits 120-1 to 120-191 in FIG. 1 perform similar operations.

FIG. 3 is a waveform diagram showing the output waveforms of each of the outputs 122 (122-0 to 122-191) in the case where the liquid-crystal panel is connected to the outputs 122. In FIG. 3, numeral 300 indicates the output waveform which is demonstrated when the liquid-crystal panel is charged through the resistor(s) of the voltage divider 206, while numeral 301 indicates the output waveform which is demonstrated when the liquid-crystal panel is charged in accordance with the first embodiment. Since the liquid-crystal panel is a capacitive load, the charging/discharging time period thereof differs depending upon a resistance which intervenes between a capacitance portion and an external voltage. As the intervening resistance is higher, the charging/discharging time period becomes longer. According to the system described in conjunction with FIGS. 1, 2 and 9, as illustrated by the output waveform 301, the voltage V3 is delivered directly from the output 122 while the clock signal 118 shown in FIG. 1 is negated. Therefore, the intervening resistance consists only of the resistance of the liquid-crystal panel, and the output waveform rises rapidly. When the clock signal 118 has been asserted, the prescribed voltage value $V_s$ passed through the voltage divider 206 is delivered. Until the prescribed value $V_s$ is reached, the liquid-crystal panel is charged/discharged in the state in which the resistance of the liquid-crystal panel and that of the voltage divider 206 form a series resistance. As illustrated by the output waveform 300, however, when the voltage $V_s$ is delivered through the voltage divider 206 from the beginning, the charging/discharging time period of the liquid-crystal panel becomes long because the resistance of the liquid-crystal panel and that of the voltage divider 206 are involved.

Figure 4:
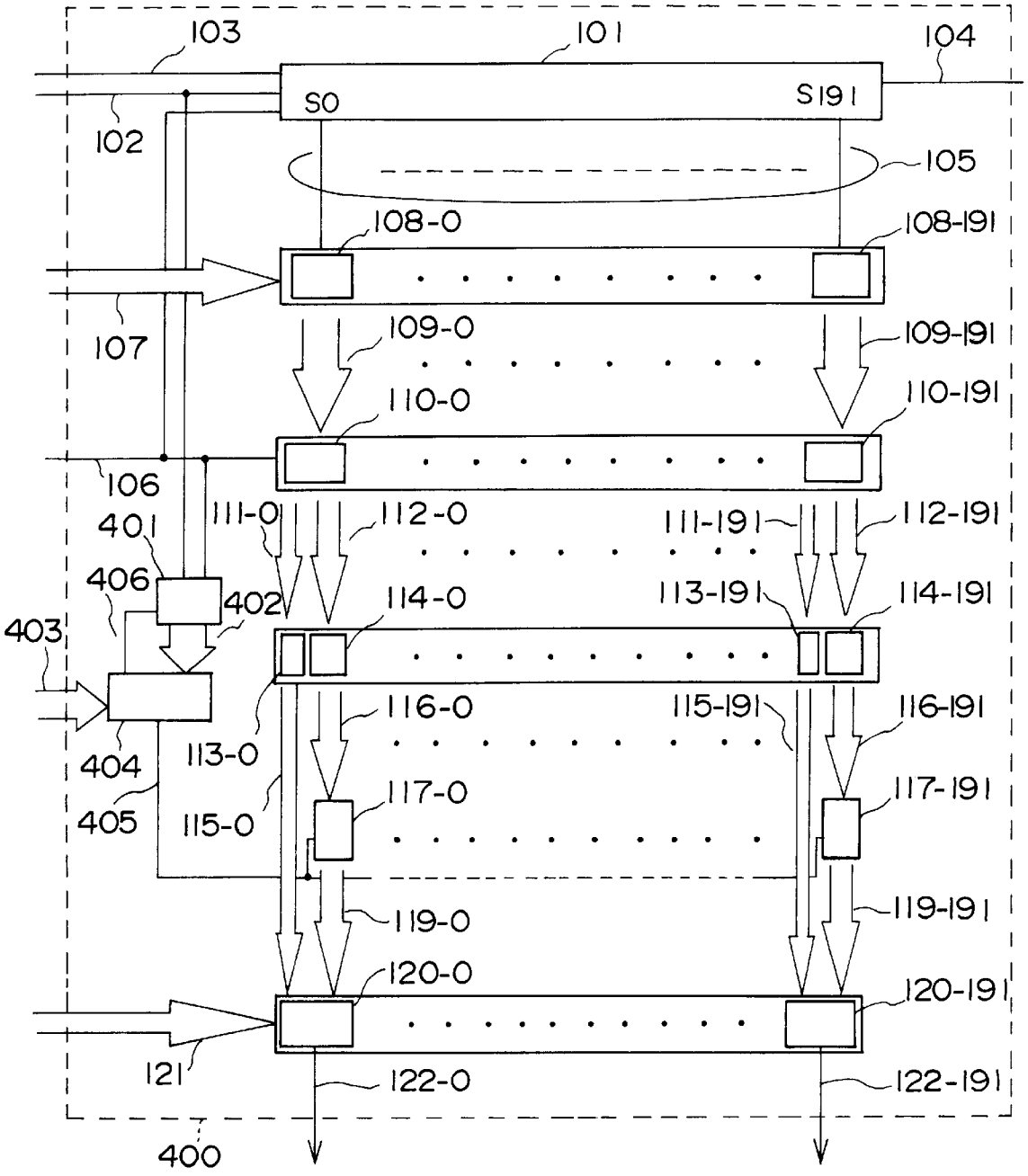
FIG. 4 is a simplified block diagram of an X driver circuit of 192 outputs in the second embodiment of the present invention.

The second embodiment of the present invention is shown in FIG. 4. This figure is a simplified block diagram of an X driver circuit of 192 outputs.

Referring to FIG. 4, numeral 400 indicates the X driver circuit of 192 outputs, numeral 401 a counter, numeral 402 the output bus of the counter 401, numeral 403 the input bus of data for setting a value to be compared with the content of the counter 401, numeral 404 a comparator, numeral 405 a control signal, and numeral 406 a stop signal. When a latch clock 106 has been asserted, the counter 401 starts counting from "0" in synchronism with a clock 102, and it delivers the count value to the output bus 402 and supplies it to the comparator 404. The comparator 404 is also supplied with the external comparison value through the input bus 403. Thus, the comparator 404 compares the values of the input bus 403 and the output bus 402. Herein, in a case where the data of the output bus 402 is equal to or smaller than that of the input bus 403, the control signal 405 is negated. On the other hand, in a case where the data of the output bus 402 is greater than that of the input bus 403, the control signal 405 is asserted. On this occasion, the comparator 404 asserts the stop signal 406. When the stop signal 406 has entered the counter 401, this counter stops counting. The counter 401 is at a stop until the latch clock 106 is asserted from the negated state thereof again, and it starts counting from "0" again when the latch clock 106 is asserted again.

The embodiment in FIG. 4 operates as described below.

When the latch clock signal 106 has been asserted, latch circuits 110-0 to 110-191 operate to simultaneously latch the latched data of respective output buses 109-0 to 109-191. The latched data of upper 2 bits are delivered to output buses 111-0 to 111-191 and supplied to decoders 113-0 to 113-191 so as to be decoded, and the decoded results are delivered to output buses 115-0 to 115-191, respectively. On the other hand, the latched data of lower 4 bits are delivered to output buses 112-0 to 112-191 and supplied to decoders 114-0 to 114-191 so as to be decoded, and the decoded results are delivered to output buses 116-0 to 116-191, respectively. Further, when the latch clock signal 106 has been asserted, the counter 401 starts counting, and the comparator 404 negates the control signal 405. While the control signal 405 is negated, gate circuits 117-0 to 117-191 assert only those output lines of respective output buses 119-0 to 119-191 which correspond to a decoded value "0". Thereafter, when the data of the output bus 402 of the counter 401 has become greater than that of the input bus 403, the comparator 404 asserts the control signal 405, and it also asserts the stop signal 406 to stop the operation of the counter 401. When the control signal 405 has been asserted, the gate circuits 117-0 to 117-191 deliver the data of the output buses 116-0 to 116-191 to the output buses 119-0 to 119-191, respectively.

The operations of the other circuits are the same as in the first embodiment.

Even with the circuit arrangement of the second embodiment, the operation similar to that of the first embodiment can be performed.

Figure 5:
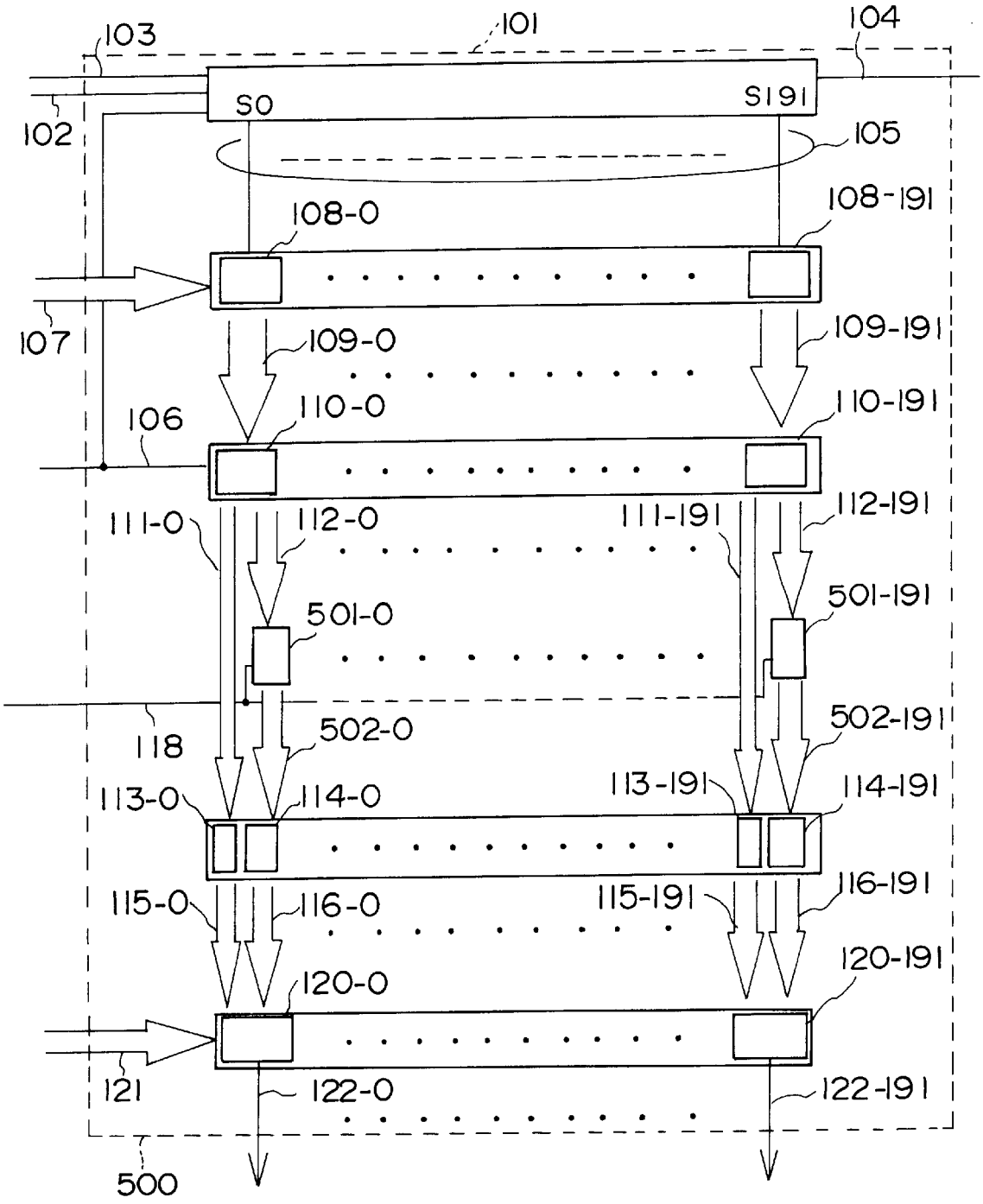
FIG. 5 is a simplified block diagram of an X driver circuit of 192 outputs in the third embodiment of the present invention.
Figure 13:
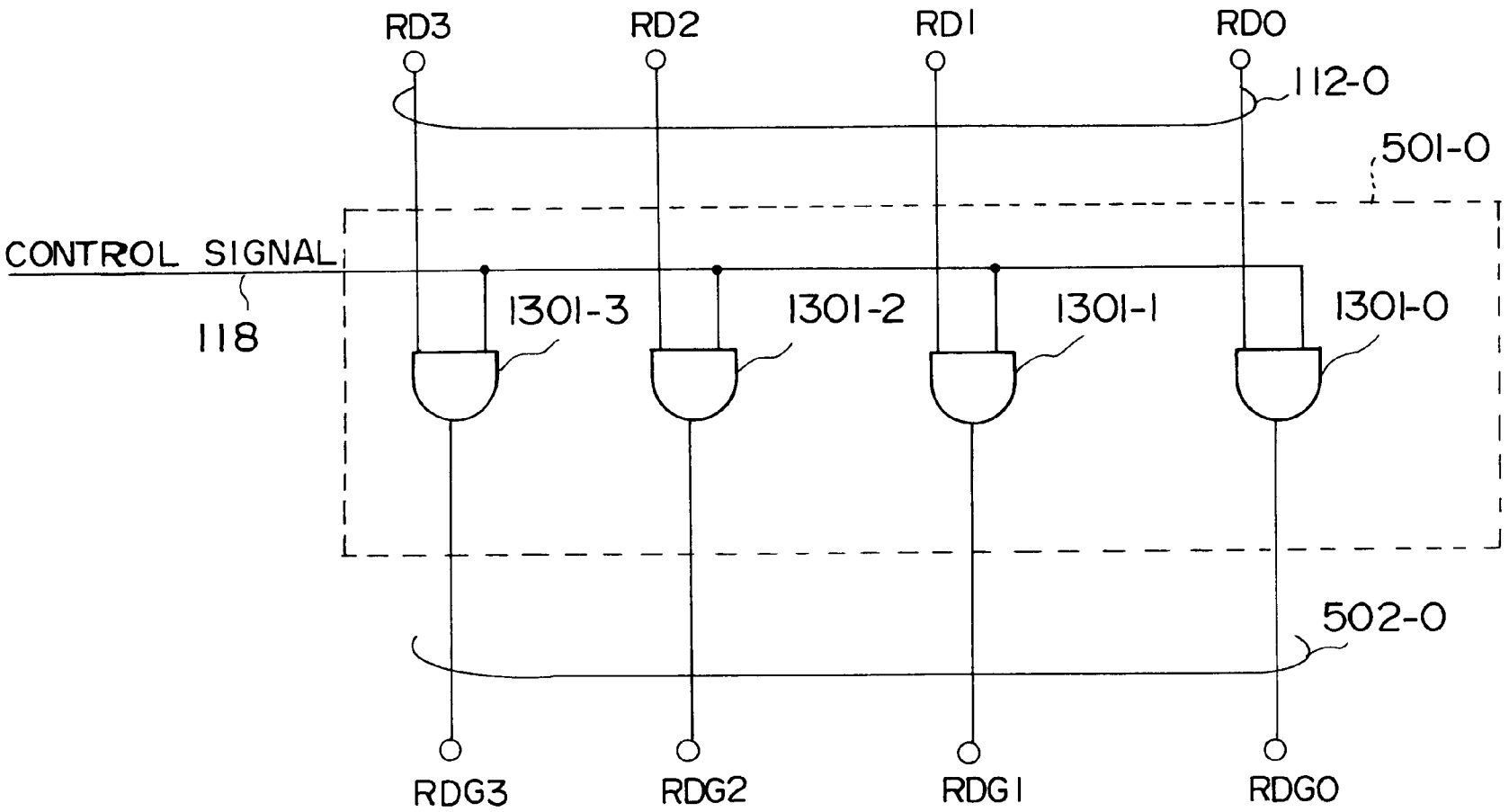
FIG. 13 is a simplified connection diagram of a gate circuit in the third embodiment of the present invention.

The third embodiment of the present invention is shown in FIGS. 5 and 13. FIG. 5 is a simplified block diagram of an X driver circuit of 192 outputs, while FIG. 13 is a simplified block diagram of a gate circuit.

Referring to FIG. 5, numeral 500 designates the X driver circuit of 192 outputs. Symbols 501-0 to 501-191 denote the gate circuits for lower 4 bits, respectively, while symbols 502-0 to 502-191 denote the output buses of the gate circuits 501-0 to 501-191, respectively. When a control signal 118 is negated, the gate circuits 501-0 to 501-191 deliver "0" to the output buses 502-0 to 502-191 without delivering the latched data of output buses 112-0 to 112-191, respectively. When the control signal 118 has been asserted, the gate circuits 501-0 to 501-191 deliver the data of the output buses 112-0 to 112-191 to the output buses 502-0 to 502-191, respectively.

Referring to FIG. 13 illustrative of the gate circuit 501-0, symbols 1301-0 to 1301-3 denote AND circuits of 2 inputs, respectively. When the control signal 118 is negated, the respective AND circuits 1301-0 to 1301-3 negate all the signals of the bits RDG0 to RDG3 of the output bus 502-0 and deliver the data "0" to the output bus 502-0. On the other hand, when the control signal 118 is asserted, the respective AND circuits 1301-0 to 1301-3 deliver the data of the bits RD0 to RD3 of the output bus 112-0 to the bits RDG0 to RDG3 of the output bus 502-0.

This operation proceeds similarly in each of the other gate circuits 501-1 to 501-191.

The operation of the third embodiment will be described with reference to FIGS. 5 and 13. In synchronism with a latch clock 106, latch circuits 110-0 to 110-191 latch all the latched data of respective output buses 109-0 to 109-191 therein. The data of upper 2 bits are delivered to output buses 111-0 to 111-191 and are supplied to decoders 113-0 to 113-191 so as to be decoded, and the decoded values are delivered to output buses 115-0 to 115-191, respectively. The data of the lower 4 bits are delivered to the output buses 112-0 to 112-191 and are supplied to the gate circuits 501-0 to 501-191, respectively. The gate circuit 501-0 operates as stated below in conjunction with FIG. 13. Since the control signal 118 becomes negated, namely, "0" in synchronism with the latch clock signal 106 on this occasion, the respective AND circuits 1301-0 to 1301-3 negate all the outputs RGD0 to RGD3, namely, render them "0", thereby delivering the data "0" to the output bus 502-0. Such operations are also performed in the gate circuits 501-1 to 501-191 shown in FIG. 5. Consequently, the data "0" is delivered to the output buses 502-0 to 502-191. Thereafter, when the control signal 118 becomes asserted, namely, "1", the respective AND circuits 1301-0 to 1301-3 deliver the data of the inputs RD0 to RD3 of the output bus 112-0 to the corresponding outputs RDG0 to RDG3 of the output bus 502-0 shown in FIG. 13. Likewise, the gate circuits 501-1 to 501-191 shown in FIG. 5 deliver the data of the output buses 112-1 to 112-191 to the output buses 502-1 to 502-191, respectively.

The operations of the other circuits are the same as in the first embodiment.

Owing to the circuit arrangement of the third embodiment, the operation similar to that of the first embodiment can be performed.

Figure 6:
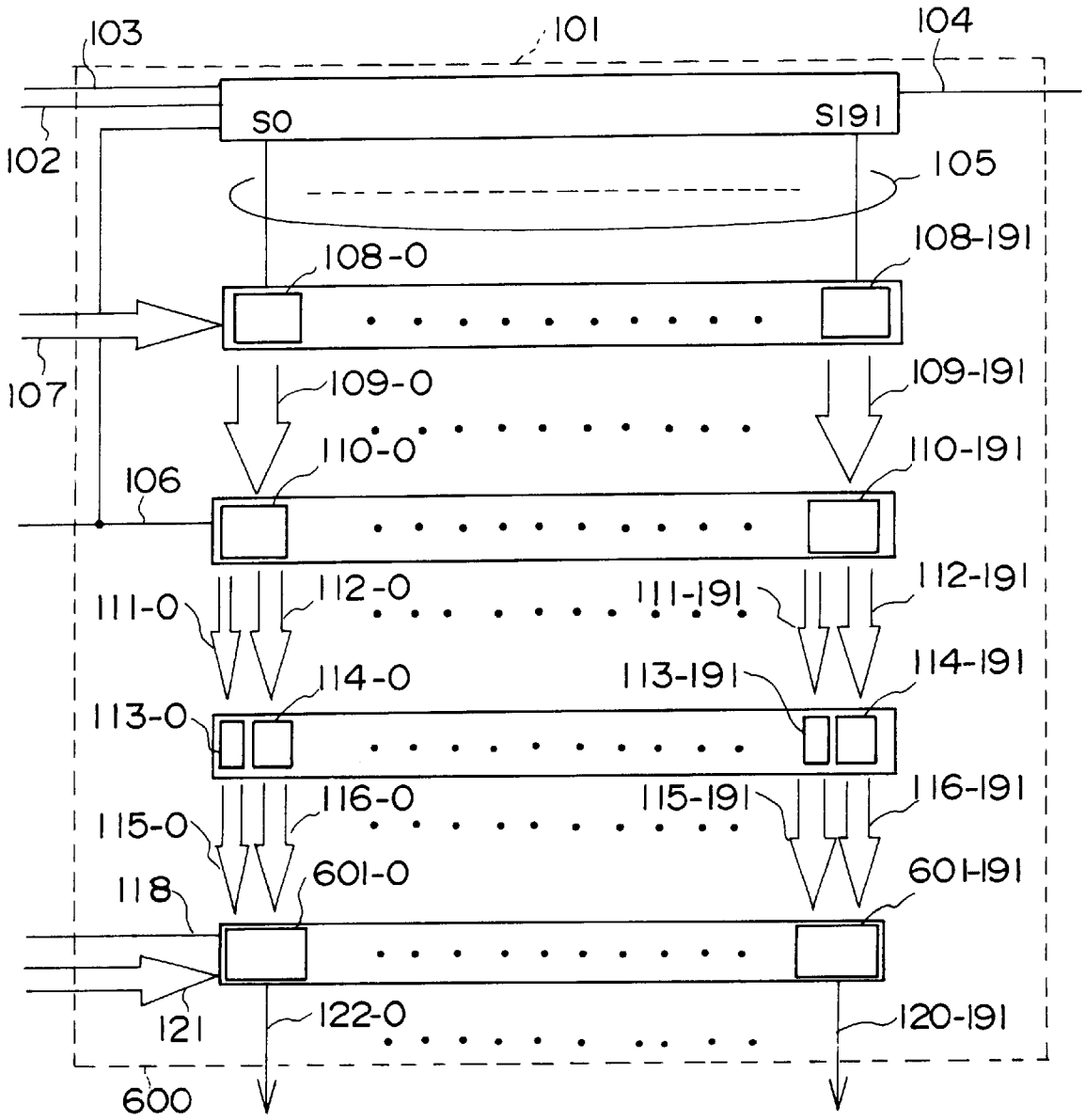
FIG. 6 is a simplified block diagram of an X driver circuit of 192 outputs in the fourth embodiment of the present invention.
Figure 7:
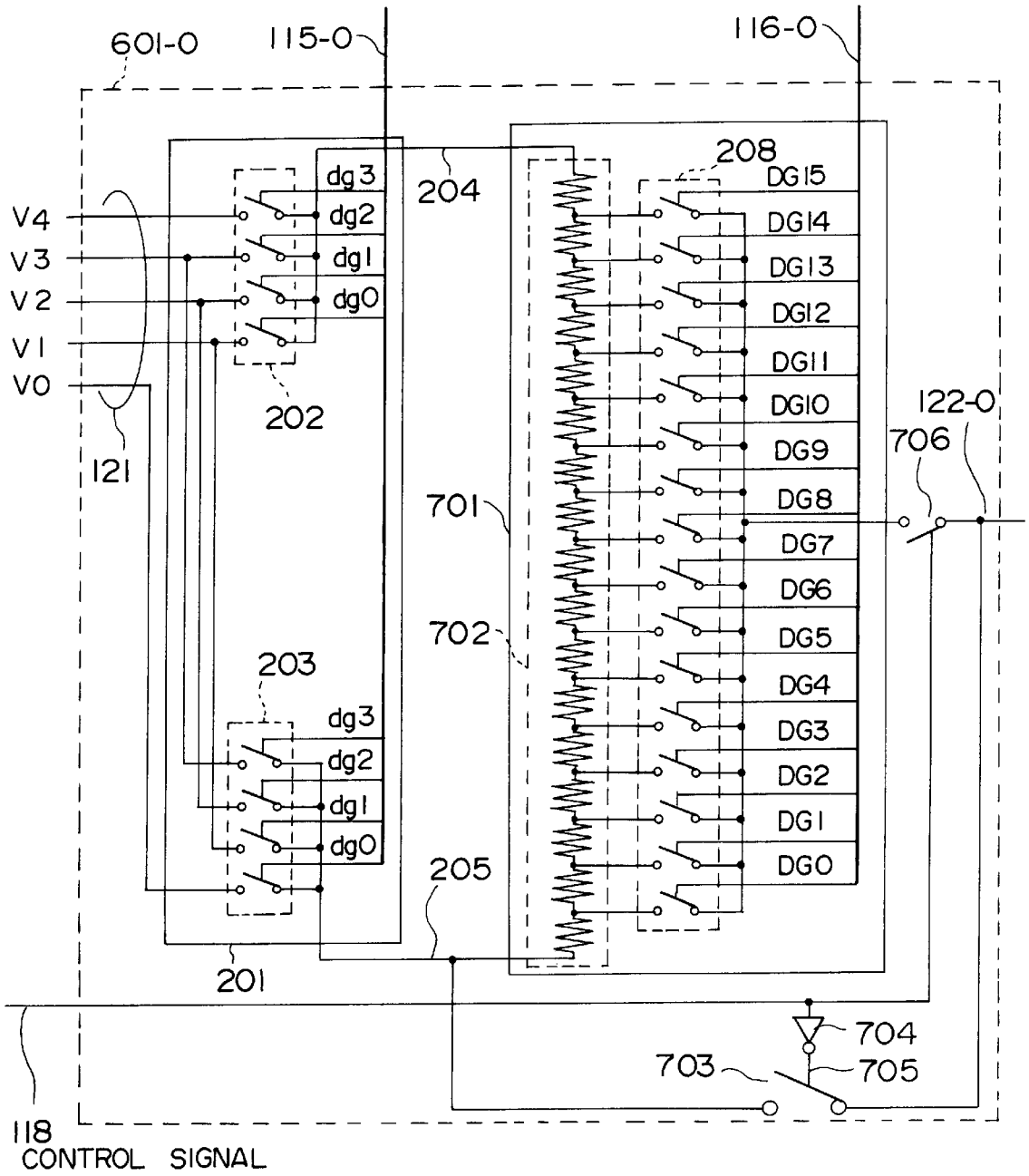
FIG. 7 is a simplified block diagram of a voltage divider circuit in the fourth embodiment of the present invention.
Figure 8:
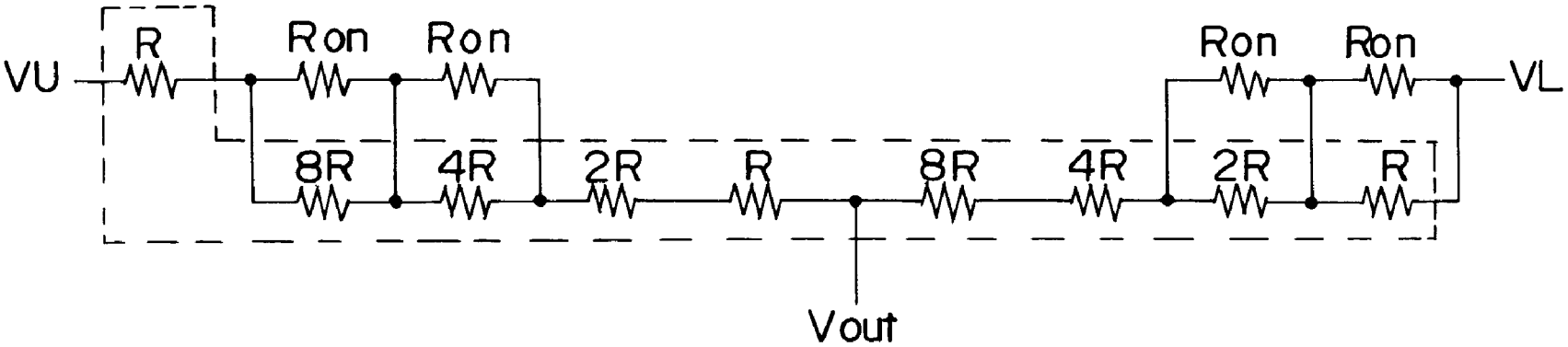
FIG. 8 is a diagram for explaining the problem of a prior-art example.

The fourth embodiment of the present invention is shown in FIGS. 6 and 7. FIG. 6 is a simplified block diagram of an X driver circuit of 192 outputs, while FIG. 7 is a simplified block diagram of a voltage divider circuit.

Referring to FIG. 6, numeral 600 designates the X driver circuit of 192 outputs, and symbols 601-0 to 601-191 denote the voltage divider circuits. When the control signal 118 is negated, the voltage divider circuits 601-0 to 601-191 connect the voltage lines and output lines of lower voltage levels of 2-level voltages selected in accordance with the decoded values of upper 2 bits and deliver the voltages of the lower voltage levels to output buses 122-0 to 122-191, respectively. On the other hand, when the control signal 118 is asserted, the voltage divider circuits 601-0 to 601-191 deliver voltages corresponding to display data to the output buses 122-0 to 122-191, respectively.

One of the voltage divider circuits 601-0 to 601-191 shown in FIG. 6 is illustrated in the block diagram of FIG. 7. Referring to FIG. 7, numeral 701 indicates a voltage divider which divides a voltage into 16 levels, numeral 702 a voltage divider resistor assembly in which 17 resistors are connected in series, numeral 703 a switching element which is in a conductive state during the negation of the control signal 118, numeral 704 an inverter, numeral 705 the output of the inverter 704, and numeral 706 a switching element which is in a conductive state during the assertion of the control signal 118. The voltage divider 701 which divides the voltage by means of the series resistors 702 is structurally incapable of directly delivering the potential of an output 205 on a lower potential side, unlike the voltage divider circuit 206 shown in FIG. 2. When the control signal 118 is negated, namely, "0", the switching element 703 is supplied with an asserted signal "1" owing to the inverter 704, and it renders the outputs 205 and 122-0 electrically conductive. Since, on this occasion, the switching element 706 is supplied with the negated signal, namely, "0" of the control signal 118, a voltage selected by a group of switching elements 208 is not delivered to the output 122-0.

Thereafter, when the control signal 118 is asserted, the switching element 703 is supplied with "0" by the output 705, and it renders the outputs 205 and 122-0 electrically nonconductive. On this occasion, the switching element 706 is supplied with "1" of the asserted control signal 118. Therefore, a voltage selected in accordance with the decoded value of the data of an output bus 116-0 is delivered to the output 122-0.

The operation of this embodiment in the case where the display data latched in a latch circuit 108-0 is "110100" will be described with reference to FIGS. 6 and 7. A decoder 113-0 decodes the latched data "11" of an output bus 111-0, while a decoder 114-0 decodes the latched data "0100" of an output bus 112-0. Thus, those output lines of the output buses 115-0 and 116-0 which correspond to the respective decoded values "3" and "4" are asserted. The output buses 115-0 and 116-0 are led to the voltage divider circuit 601-0. This voltage divider circuit 601-0 operates as stated below in conjunction with FIG. 7. The decoder output of the output bus 115-0 is supplied to a voltage selector 201, and voltages V4 and V3 are respectively delivered as outputs 204 and 205 in correspondence with the decoded value "3". On this occasion, the control signal 118 is negated, so that the output 205 is delivered to the output bus 122-0 through the switching element 703. In addition, the switching element 706 is in a nonconductive state during the negation of the control signal 118, so that the voltage divider 701 does not deliver any divided voltage value. When the control signal 118 is asserted, the outputs 205 and 122-0 are rendered electrically nonconductive, and the voltage corresponding to the decoded value "4" of the output bus 116-0 is delivered to the output bus 122-0 through the switching element 706.

The other voltage divider circuits 601-1 to 601-191 operate similarly.

Figure 14:
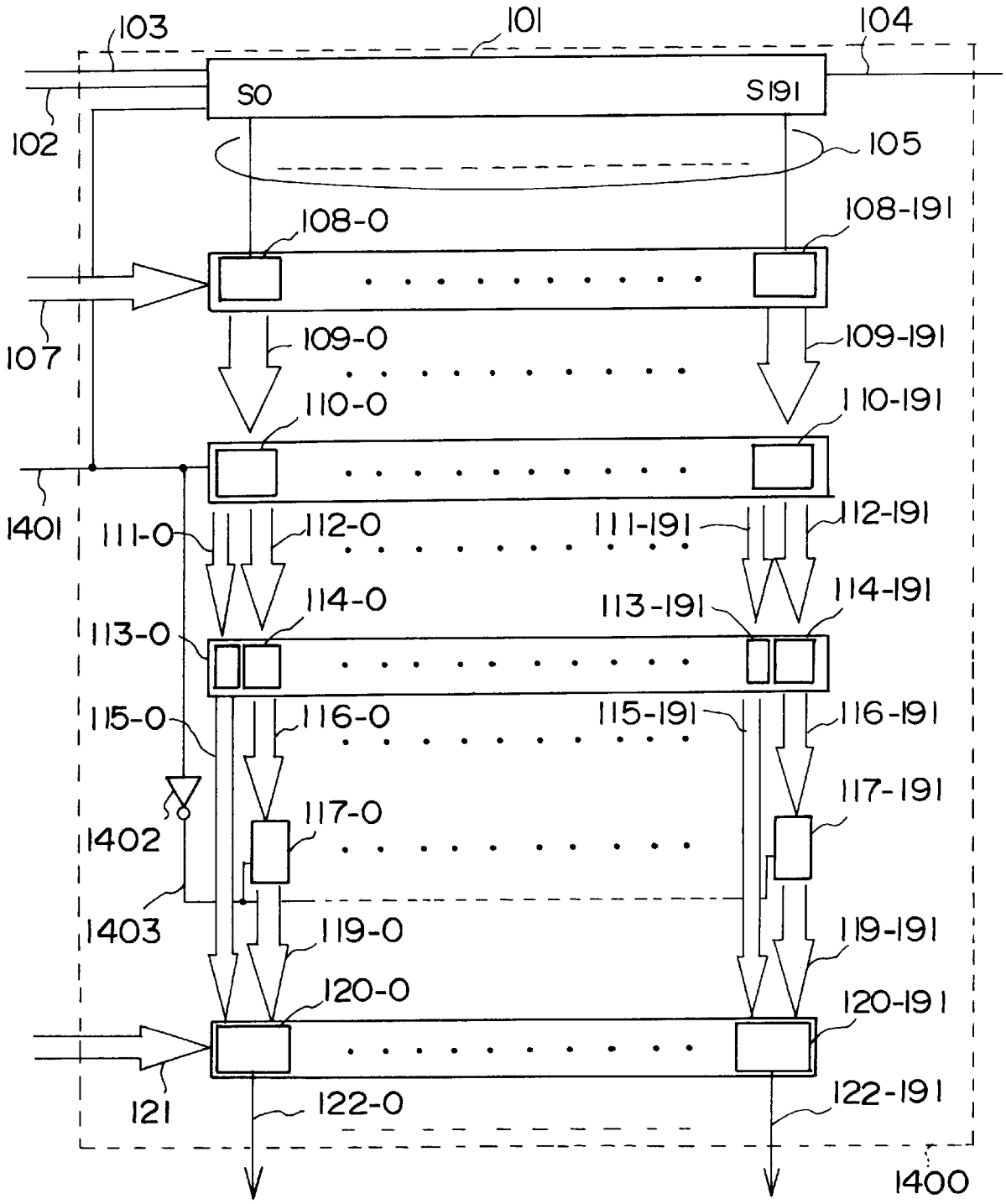
FIG. 14 is a simplified block diagram of an X driver circuit of 192 outputs in the fifth embodiment of the present invention.

The fifth embodiment of the present invention is shown in FIG. 14. This figure is a simplified block diagram of an X driver circuit of 192 outputs.

Referring to FIG. 14, numeral 1400 indicates the X driver circuit of 192 outputs, numeral 1401 a latch clock whose assertion period can be set at will, numeral 1402 an inverter, and numeral 1403 the output of the inverter 1402.

The latch clock signal 1401 enters a shift register 101 and latch circuits 110-0 to 110-191. Further, the latch clock signal 1401 is inverted by the inverter 1402, and the resulting output 1403 enters gate circuits 117-0 to 117-191.

The operation of this embodiment will be described with reference to FIG. 14. When the latch clock signal 1401 having been negated is asserted, the shift register 101 asserts outputs S0 to S191 successively during one cycle of a clock 102 for each of these outputs in synchronism with the clock signal 102. Besides, when the latch clock signal 1401 having been negated is asserted, the latch circuits 110-0 to 110-191 simultaneously latch the data of the output buses 109-0 to 109-191 of respective latch circuits 108-0 to 108-191 disposed at a preceding stage.

Further, when the latch clock signal 1401 having been negated is asserted, the signal inverted by the inverter 1402, that is, the signal changed from the asserted state into the negated state is delivered as the output 1403. Thereafter, when the latch clock signal 1401 having been asserted is negated, the signal inverted by the inverter 1402, that is, the signal changed from the negated state into the asserted state is delivered as the output 1403. Such an output 1403 enters the gate circuits 117-0 to 117-191 so as to control these gate circuits.

The other detailed operation of this embodiment is the same as in the first embodiment.

Figure 15:
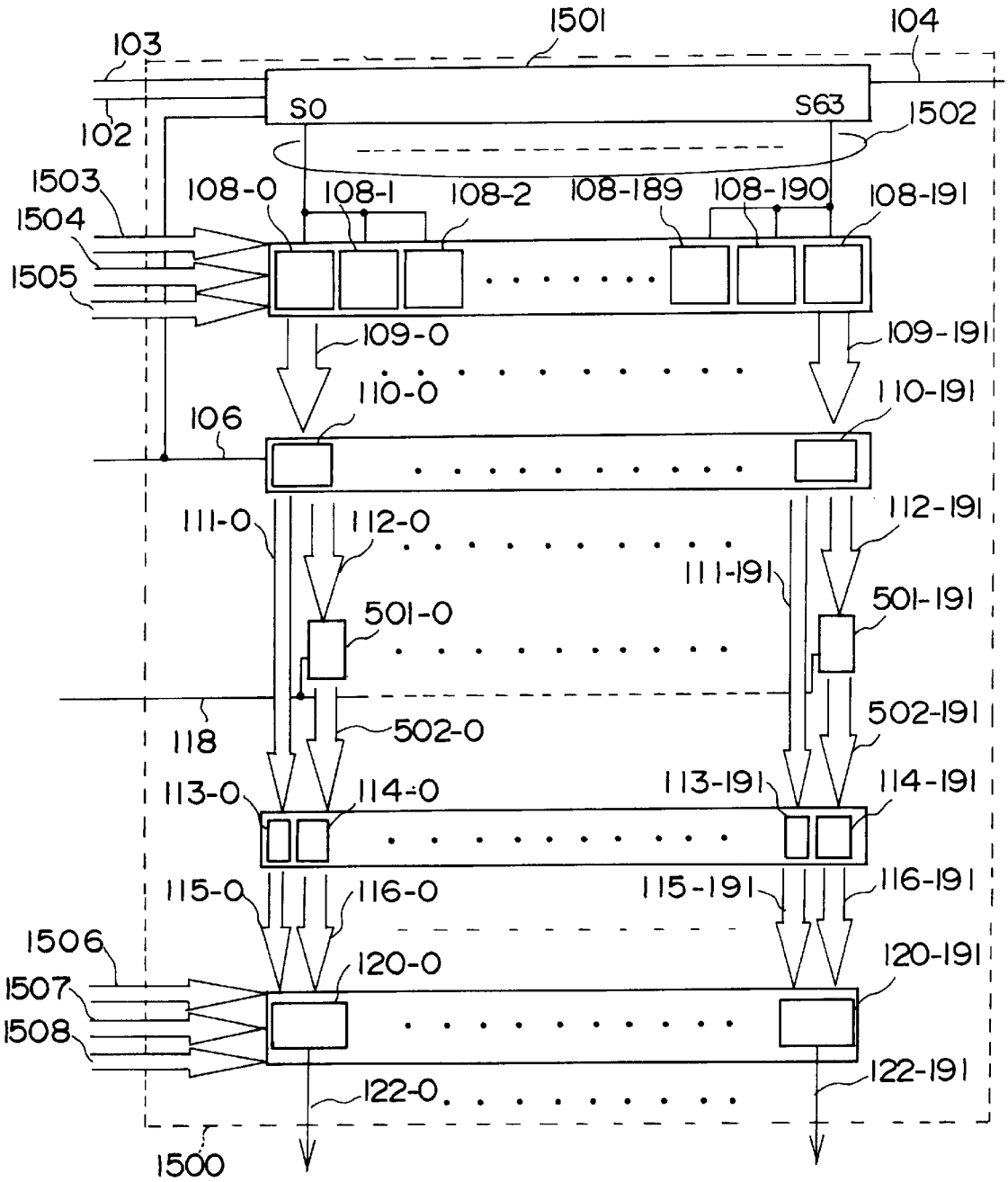
FIG. 15 is a simplified block diagram of an X driver circuit of 192 outputs in the sixth embodiment of the present invention.

The sixth embodiment of the present invention is shown in FIG. 15. This figure is a simplified block diagram of an X driver circuit of 192 outputs.

Referring to FIG. 15, numeral 1500 indicates the X driver circuit of 192 outputs, numeral 1501 a shift register, numeral 1502 the output bus of the shift register 1501, numeral 1503 a data bus for 6-bit display data for red (hereinbelow, abbreviated to "R"), numeral 1504 a data bus for 6-bit display data for green (hereinbelow, abbreviated to "G"), numeral 1505 a data bus for 6-bit display data for blue (hereinbelow, abbreviated to "B"), numeral 1506 a voltage bus for R, numeral 1507 a voltage bus for G, and numeral 1508 a voltage bus for B.

When a control signal 103 and a clock signal 106 supplied from a stage preceding the illustrated X driver circuit 1500 are asserted, the shift register 1501 asserts the outputs S0 to S63 of the output bus 1502 successively during one cycle of a clock 102 for each of these outputs in synchronism with the clock signal 102. When the output S63 has been asserted, a control signal 104 to be supplied to a stage succeeding the illustrated X driver circuit 1500 is asserted. Subsequently, the output S63 is negated after one cycle of the clock signal 102. The shift register 1501 starts operating again when the control signal 103 and the clock signal 106 from the preceding stage are asserted. The output S0 of the output bus 1502 enters latch circuits 108-0, 108-1 and 108-2. The next output S1 of the output bus 1502 enters latch circuits 108-3, 108-4 and 108-5. In this manner, each output of the output bus 1502 is connected to three of latch circuits 108-0 to 108-191.

The data bus 1503 for R is connected to every third latch circuit from the latch circuit 108-0. Likewise, the data bus 1504 for G is connected to every third latch circuit from the latch circuit 108-1. Also, the data bus 1505 for B is connected to every third latch circuit from the latch circuit 108-2.

The voltage bus 1506 for R is connected to every third voltage divider circuit from a voltage divider circuit 120-0. Likewise, the voltage bus 1507 for G is connected to every third voltage divider circuit from a voltage divider circuit 120-1. Also, the voltage bus 1508 for B is connected to every third voltage divider circuit from a voltage divider circuit 120-2.

The operation of this-embodiment will be described with reference to FIG. 15.

When the latch clock signal 106 and the control signal 103 are asserted, the shift register 1501 asserts the outputs of the output bus 1502 successively from the output S0 in synchronism with the clock signal 102. When the output S0 is asserted, the latch circuit 108-0 latches the data of the R data bus 1503 and delivers the latched data to an output bus 109-0. Further, the latch circuits 108-1 and 108-2 latch the data of the G data bus 1504 and the data of the B data bus 1505 and deliver the latched data to output buses 109-1 and 109-2, respectively. Three of the latch circuits 108-3 to 108-191 perform similar operations in synchronism with each output of the output bus 1502. The subsequent operations of voltage divider circuits 120-0 to 120-191 are basically the same as in the third embodiment. The point of difference is that the R voltage bus 1506 is connected to the voltage divider circuits 120 which deliver voltages corresponding to the R display data, so the voltages appropriate for the characteristics of a filter for R in a liquid-crystal panel can be delivered. Also, the voltage buses 1507 and 1508 for G and B are respectively connected to the voltage divider circuits 120 corresponding to the G and B display data, so that voltages appropriate for the characteristics of filters for G and B can be delivered.

Owing to such a circuit arrangement, the circuit scale of the shift register 1501 can be made small. Moreover, since the voltages suited to the characteristics of the respective filters are supplied, displays of high display quality can be presented.

In each of the first, second, third, fourth and sixth embodiments, even when the capacitance and resistance of the liquid-crystal panel have changed, the changes can be coped with because the period of the negation of the control signal 118 can be set at will.

In the fifth embodiment, even when the capacitance and resistance of the liquid-crystal panel have changed, the changes can be coped with because the period of the negation of the latch clock signal 1401 can be set at will.

The voltage divider circuit is constructed of the series resistors in each of the first, second, third, fifth and sixth embodiments. However, the construction is not restrictive, but any voltage divider circuit capable of directly delivering the output of the lower potential side can produce similar effects by the use of a similar driving mode.

In each of the first thru sixth embodiments, in a case where the number of divisions of the voltage divider circuit has been changed to, for example, 8 divisions, the change can be coped with in such a way that the number of external voltages is set at 9 levels, that-the latched data is separated into upper 3 bits and lower 3 bits, and that decoders corresponding to such separation are employed. In this manner, even the change of the number of divisions can be satisfactorily coped with by similar alterations.

In each of the first thru sixth embodiments, in a case where the number of tones has been changed, for example, from 64 tones to 256 tones, the change can be coped with in such a way that the data bus 107 is set at 8 bits, that the number of bits of the latch circuit 108 is increased from 6 bits to 8 bits, that the number of external voltages is set at 17 levels, that the latched data is separated into upper 4 bits and lower 4 bits, and that decoders corresponding to such separation are employed. In this manner, even the change of the number of tones can be satisfactorily coped with.

Each of the first, third, fourth and sixth embodiments operates even when the latch clock signal 1401 is employed for the control as in the fifth embodiment.

In each of the first thru sixth embodiments, the change of the number of outputs can be coped with in such a way that the number of outputs of the shift register, the number of the latch circuits, the number of the gate circuits, the number of the decoders and the number of the voltage divider circuits are conformed to the new number of outputs.

In each of the first thru fifth embodiments, the circuit scale of the shift register can be reduced in such a way that the data items for several outputs are simultaneously latched as in the sixth embodiment. Besides, output voltages suited to the filter characteristics can be obtained by supplying the voltages which correspond to the respective filters.

Figure 10:
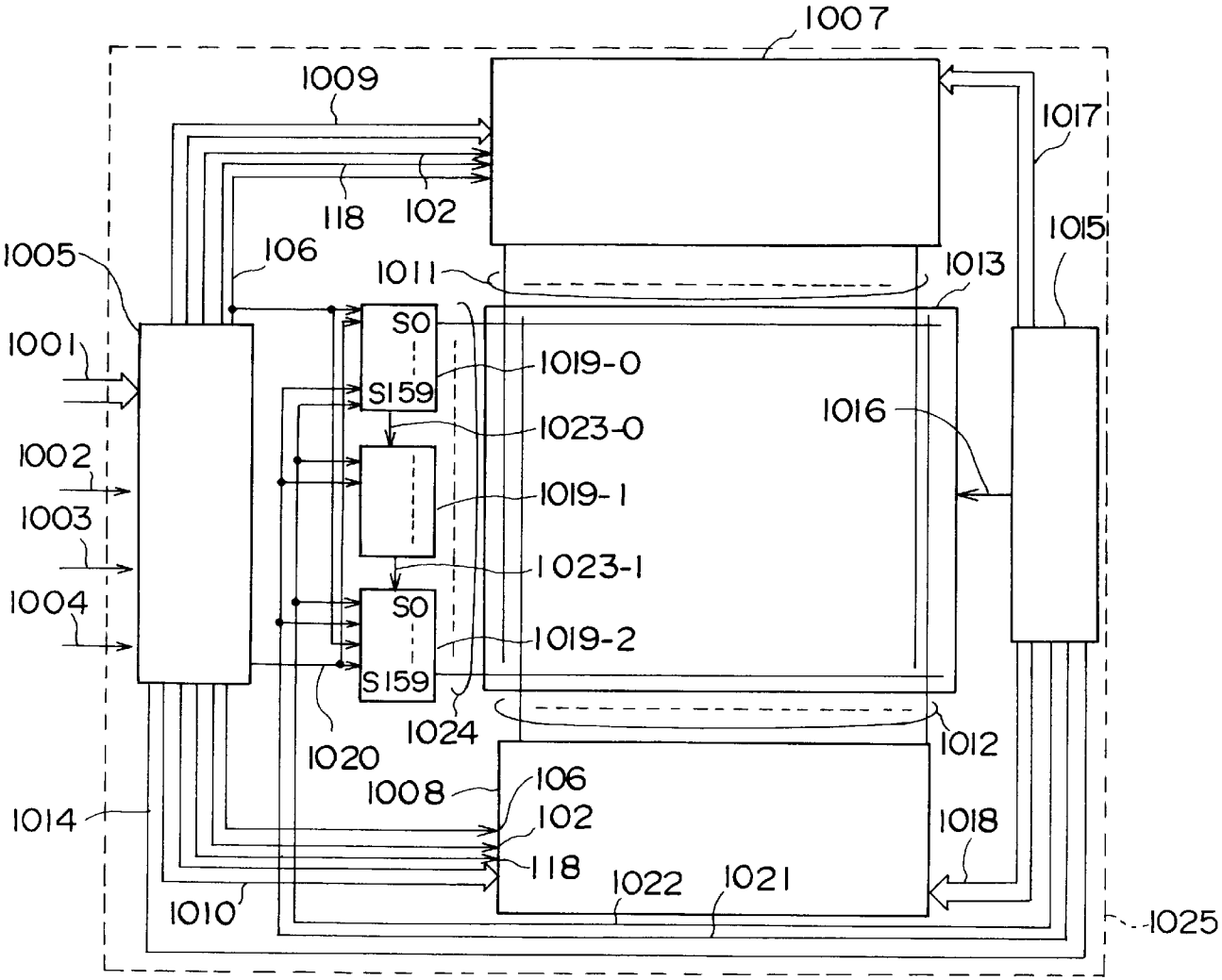
FIG. 10 is an arrangement diagram of a liquid-crystal display system in the seventh embodiment of the present invention.
Figure 11:
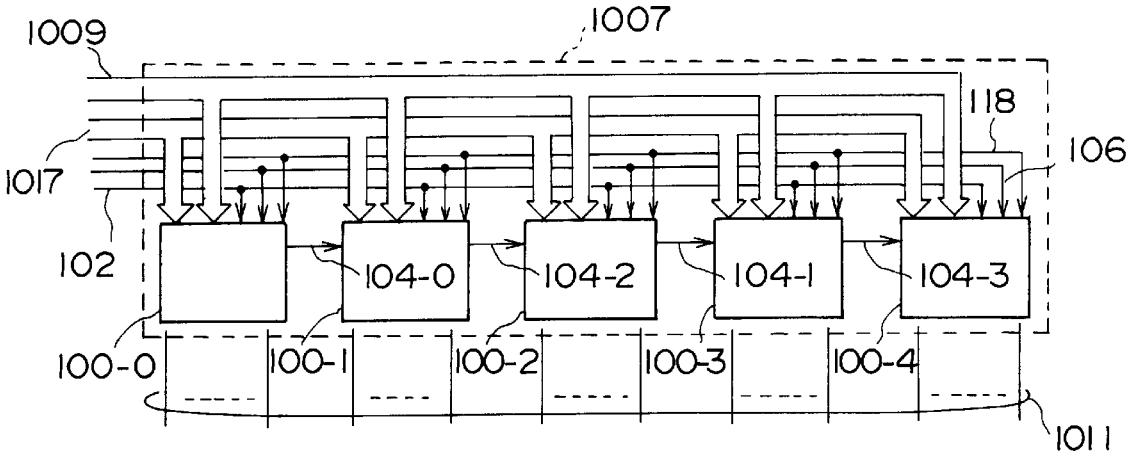
FIG. 11 is an arrangement diagram of upper X driver circuits in the seventh embodiment of the present invention.
Figure 12:
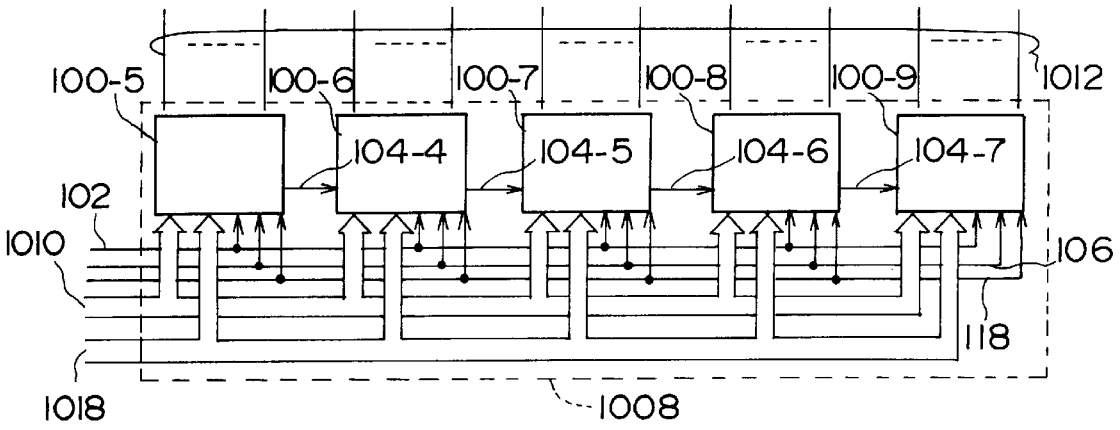
FIG. 12 is an arrangement diagram of lower X driver circuits in the seventh embodiment of the present invention.

The seventh embodiment of the present invention is shown in FIGS. 10, 11 and 12. FIG. 10 is a simplified block diagram of a liquid-crystal display system which employs the X driver circuit described before, FIG. 11 is an arrangement diagram of an upper group of X driver circuits, and FIG. 12 is an arrangement diagram of a lower group of X driver circuits.

Numeral 1001 indicates a data bus for 6-bit display data in respective colors R, G and B, numeral 1002 a dot clock, numeral 1003 a horizontal synchronizing signal, numeral 1004 a vertical synchronizing signal, and numeral 1005 a liquid-crystal display controller. The display data of the data bus 1001 is supplied to the liquid-crystal display controller 1005 in synchronism with the dot clock signal 1002. Further, the liquid-crystal display controller 1005 is supplied with the horizontal synchronizing signal 1003 and the vertical synchronizing signal 1004. The liquid-crystal display controller 1005 produces a clock signal 102 from the dot clock signal 1002 and does a clock signal 106 from the horizontal synchronizing signal 1003, thereby rearraying the display data and control the clock signals so that the liquid-crystal display system can be driven.

The upper group of X driver circuits is configured of five X driver circuits of 192 outputs stated before, while the lower group of X driver circuits 1008 is configured of five X driver circuits of 192 outputs stated before. Numeral 1009 represents the data bus of the display data for the upper group of X driver circuits 1007, numeral 1010 the data bus of the display data for the lower group of X driver circuits 1008, numeral 1011 the output bus of the upper group of X driver circuits 1007, numeral 1012 the output bus of the lower group of X driver circuits 1008, numeral 1013 a liquid-crystal panel of active matrix type formed of 1920 pixels×480 lines, numeral 1014 an alternating signal, numeral 1015 a power source circuit for liquid-crystal displays, numeral 1016 an output for propagating a voltage for a counter electrode, numeral 1017 a voltage bus for the upper group, and numeral 1018 a voltage bus for the lower group. The upper group of X driver circuits 1007 have the display data transferred thereto from the liquid-crystal display controller 1005 by the display data bus 1009. They select voltages corresponding to the display data from the voltages of the voltage bus 1017 and deliver the selected voltages to the output bus 1011 so as to supply them to the liquid-crystal panel 1013. On the other hand, the lower group of X driver circuits 1008 have the display data transferred thereto from the liquid-crystal display controller 1005 by the display data bus 1010. They select voltages corresponding to the display data from the voltages of the voltage bus 1018 and deliver the selected voltages to the output bus 1012 so as to supply them to the liquid-crystal panel 1013. The output lines of the output buses 1011 and 1012 are respectively connected with the vertical lines of the liquid-crystal panel 1013, and they are connected in interdigitated fashion so as not to be connected with the identical vertical lines. The power source circuit 1015 for the liquid-crystal displays generates the voltage which is supplied to the counter electrode of the active matrix type liquid-crystal panel 1013, and it delivers the generated voltage to the output 1016. Besides, the power source circuit 1015 for the liquid-crystal displays delivers the voltages to the voltage buses 1017 and 1018 in synchronism with the alternating signal 1014. More specifically, the voltages which are delivered to the voltage bus 1017 are plus with respect to the potential of the output 1016 during the assertion of the alternating signal 1014 and are minus during the negation thereof. On the other hand, the voltages which are delivered to the voltage bus 1018 are minus with respect to the potential of the output 1016 during the assertion of the alternating signal 1014 and are plus during the negation thereof.

Symbols 1019-0 to 1019-2 denote Y driver circuits each of which has 160 outputs. Numeral 1020 indicates a clock signal. The output 1021 of the power source circuit 1015 is the ON-voltage of the Y driver circuits 1019-0 to 1019-2, while the output 1022 of the power source circuit 1015 is the OFF-voltage of the Y driver circuits 1019. Symbols 1023-0 and 1023-1 represent control signals which are supplied to the Y driver circuits 1019-0 to 1019-2 of succeeding stages. Shown at numeral 1024 are the output buses of the Y driver circuits 1019-0 to 1019-2. The clock signal 1020 is produced from the vertical synchronizing signal 1004 by the liquid-crystal display controller 1005. In synchronism with the clock signal 106 delivered from the liquid-crystal display controller 1005, the Y driver circuit 1019-0 delivers the ON-voltage of the output 1021 to the output lines S0 to S159 of the output bus 1024 successively during one cycle of the clock signal 106 for each of these output lines. Herein, the output lines which are not selected are supplied with the OFF-voltage of the output 1022. When the Y driver circuit 1019-0 has delivered the ON-voltage to the output line S159, it asserts the control signal 1023-0 directed to the succeeding stage. Subsequently, it delivers the OFF-voltage to the output line S159 after one cycle of the clock signal 106. The Y driver circuits 1019-1 and 1019-2 perform similar operations when the respective control signals 1023-0 and 1023-1 from the preceding stages are asserted. In addition, when the clock signal 1020 is asserted, the Y driver circuit 1019-0 delivers the ON-voltage to the output line S0 again, and it thereafter operates in synchronism with the clock signal 106.

Referring to FIG. 11, the upper group of X driver circuits 1007 have the circuit arrangement in which the X driver circuits as used in the first embodiment are connected in series in the number of 5. The X driver circuits operate to successively store the display data numbering 192 for each of these circuits, and they deliver the voltages corresponding to the data of one horizontal line. By the way, the data bus 1009 and the voltage bus 1017 are respectively the same as the data bus 107 and the voltage bus 121 in each of the first, third and fourth embodiments.

Referring to FIG. 12, the lower group of X driver circuits 1008 have the circuit arrangement in which the X driver circuits as used in the first embodiment are connected in series in the number of 5. The X driver circuits operate to successively store the display data numbering 192 for each of these circuits, and they deliver the voltages corresponding to the data of one horizontal line. By the way, the data bus 1010 and the voltage bus 1018 are respectively the same as the data bus 107 and the voltage bus 121 in each of the first, third and fourth embodiments.

The operation of this embodiment will be described with reference to FIGS. 10, 11 and 12.

There will be explained a case where voltages are applied to the first line of the active matrix type liquid-crystal panel 1013.

The display data transferred by the data bus 1001 in synchronism with the dot clock 1002 are separated by the liquid-crystal display controller 1005 into the data of the upper group of X driver circuits 1007 and those of the lower group of X driver circuits 1008, which are respectively delivered to the data bus 1009 and the data bus 1010 in synchronism with the clock signal 102. When the liquid-crystal controller 1005 has delivered the display data corresponding to one line, it asserts the clock signal 106. Reference will be had to FIG. 11 below. The display data of the data bus 1009 are latched in the X driver circuit 100-0 in synchronism with the clock signal 102. In the course of the latch of the 192nd display data, the X driver circuit 100-0 asserts a control signal 104-0 which is delivered to the succeeding stage 100-1. The X driver circuit 100-1 supplied with the asserted control signal 104-0 latches the data of the data bus 1009 in synchronism with the clock signal 102. In this way, the display data for one line are latched. Thereafter, the clock signal 1020 shown in FIG. 10 is asserted, the ON-voltage is delivered to the output line S0 of the Y driver circuit 1019-0, and the first line of the active matrix type liquid-crystal panel 1013 is asserted. Besides, when the clock signal 106 is asserted in synchronism with the clock signal 1020, the X driver circuits 100-0 to 100-4 latch the latched data in second-stage latch circuits simultaneously in synchronism with the clock signal 106. Subsequently, while a control signal 118 (shown in FIG. 10) having become negated in synchronism with the clock signal 106 is negated, the X driver circuits 100-0 to 100-4 select the voltages corresponding to the upper 2 bits of the latched data, from among the voltages of the voltage bus 1017, and deliver the selected voltages to the output bus 1011. Also, when the control signal 118 is asserted, the X driver circuits 100-0 to 100-4 deliver the divisional voltages corresponding to the latched data of 6 bits, to the output bus 1011. Regarding the lower group of X driver circuits 1008, the X driver circuits 100-5 to 100-9 in FIG. 12 operate similarly to the X driver circuits 100-0 to 100-4 in FIG. 11, respectively. Further, control signals 104-4 to 104-7 in FIG. 12 function similarly to the control signals 104-0 to 104-3 in FIG. 11, respectively. In this way, the voltages corresponding to the display data for one line can be applied to the respective pixels of the first line of the active matrix type liquid-crystal panel 1013. During the delivery of the voltages of the first line, the X driver circuits 100-0 to 100-4 latch the display data of the second line.

The displays of the active matrix type liquid-crystal panel can be presented by iterating such operations.

In a case where the X driver circuit of the second embodiment is to be adopted, the adoption can be coped with by a construction which does not use the control signal 118.

In a case where the X driver circuit of the fifth embodiment is to be adopted, the adoption can be coped with by a construction which uses the clock signal 1401 without using either of the control signal 118 and the clock signal 106.

The seventh embodiment can also be realized by a similar construction which adopts the X driver circuit of the third or fourth embodiment.

Increase in the number of bits of the display data can be coped with by enlarging the width of each data bus, the number of bits of each X driver circuit, and the number of output voltages. The number of voltages of each voltage bus may well be enlarged in some constructions of the X driver circuits.

A similar operation is effected even when the control signal 118 is generated by, for example, the control signal generator circuit 401 included in the second embodiment, without using the liquid-crystal display controller 1005.

In a case where the X driver circuit of the sixth embodiment is to be adopted, the adoption can be coped with in such a way that the data items of the colors R, G and B are delivered to each of the data buses 1009 and 1010 in parallel, while the voltages for the colors R, G and B are delivered to each of the voltage buses 1017 and 1018 in parallel.

Figure 16:
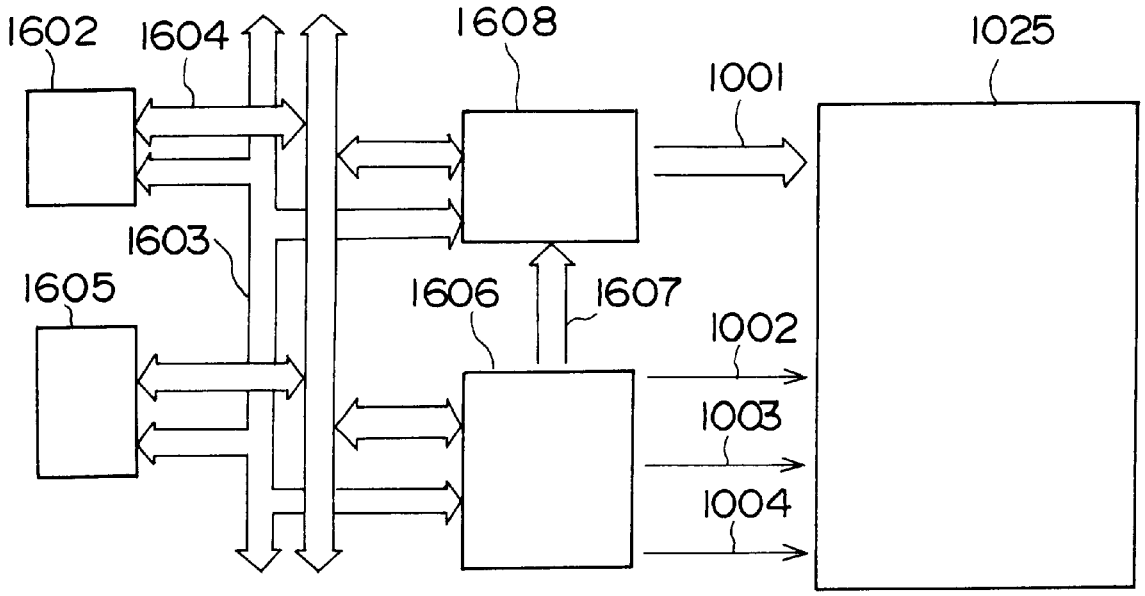
FIG. 16 is a block diagram of an information processing system in the eighth embodiment of the present invention.

The eighth embodiment of the present invention is shown in FIG. 16. This figure is a block diagram of an information processing system which employs the liquid-crystal display system (1025 in FIG. 10) described before.

Referring to FIG. 16, numeral 1602 indicates a central processor circuit, numeral 1603 an address bus, numeral 1604 a data bus, numeral 1605 a memory, numeral 1606 a display controller, numeral 1607 the output bus of the display controller 1606, and numeral 1608 a display memory.

The central processor circuit 1602 functions to deliver data to the data bus 1604 or read data therefrom and to deliver an address to the address bus 1603, in accordance with data received from the data bus 1604. In a case where the address value of the address bus 1603 indicates any address in the memory 1605, this memory 1605 renders the memory area of the address and the data bus 1604 electrically conductive. Besides, in a case where the address value of the address bus 1603 indicates the display controller 1606, this display controller 1606 renders the data bus 1604 and a memory within the display controller 1606 electrically conductive. The display controller 1606 controls the display memory 1608 through the output bus 1607 in accordance with the data of the internal memory. Further, the display controller 1606 generates and delivers the dot clock signal 1002, horizontal synchronizing signal 1003 and vertical synchronizing signal 1004 (which are shown in FIG. 10). In a case where the address value of the address bus 1603 indicates the display memory 1608, this display memory 1608 renders the memory area of the address value and the data bus 1604 electrically conductive. In addition, the display memory 1608 delivers its content to the output bus 1001 (shown in FIG. 10) in accordance with the data of the output bus 1607 of the display controller 1606.

With the information processing system of this embodiment, in a case where neither of the display controller 1606 nor the display memory 1608 is accessed from the central processor circuit 1602, the display controller 1606 delivers a read command signal and address data corresponding to the dot clock signal 1002, to the output bus 1607 so as to supply display data in synchronism with the dot clock signal 1002. Since, on this occasion, the display memory 1608 has been commanded to read data and supplied with the address data through the output bus 1607, it supplies the data bus 1001 with the data of the address indicated by the output bus 1607. The data of the data bus 1001 enters the liquid-crystal display system 1025 in synchronism with the dot clock signal 1002. Further, the horizontal synchronizing signal 1003 and the vertical synchronizing signal 1004 generated by the display controller 1606 enter the liquid-crystal display system 1025.

In this way, the liquid-crystal display system employing the X driver circuit of the present invention can be connected to and operated in a personal computer, a workstation or the like.

Figure 18:
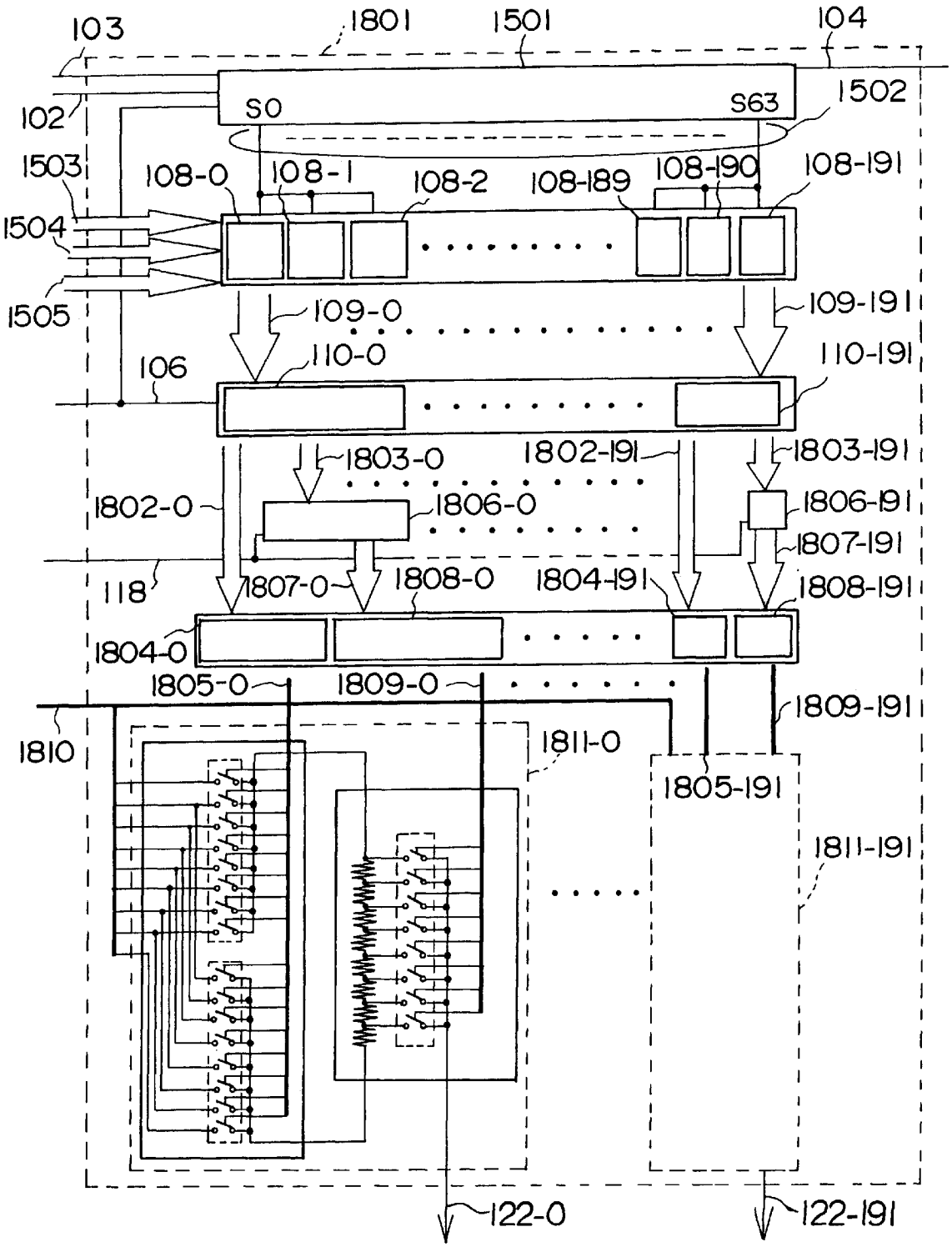
FIG. 18 is a simplified block diagram of an X driver circuit in the ninth embodiment of the present invention.
Figure 20:
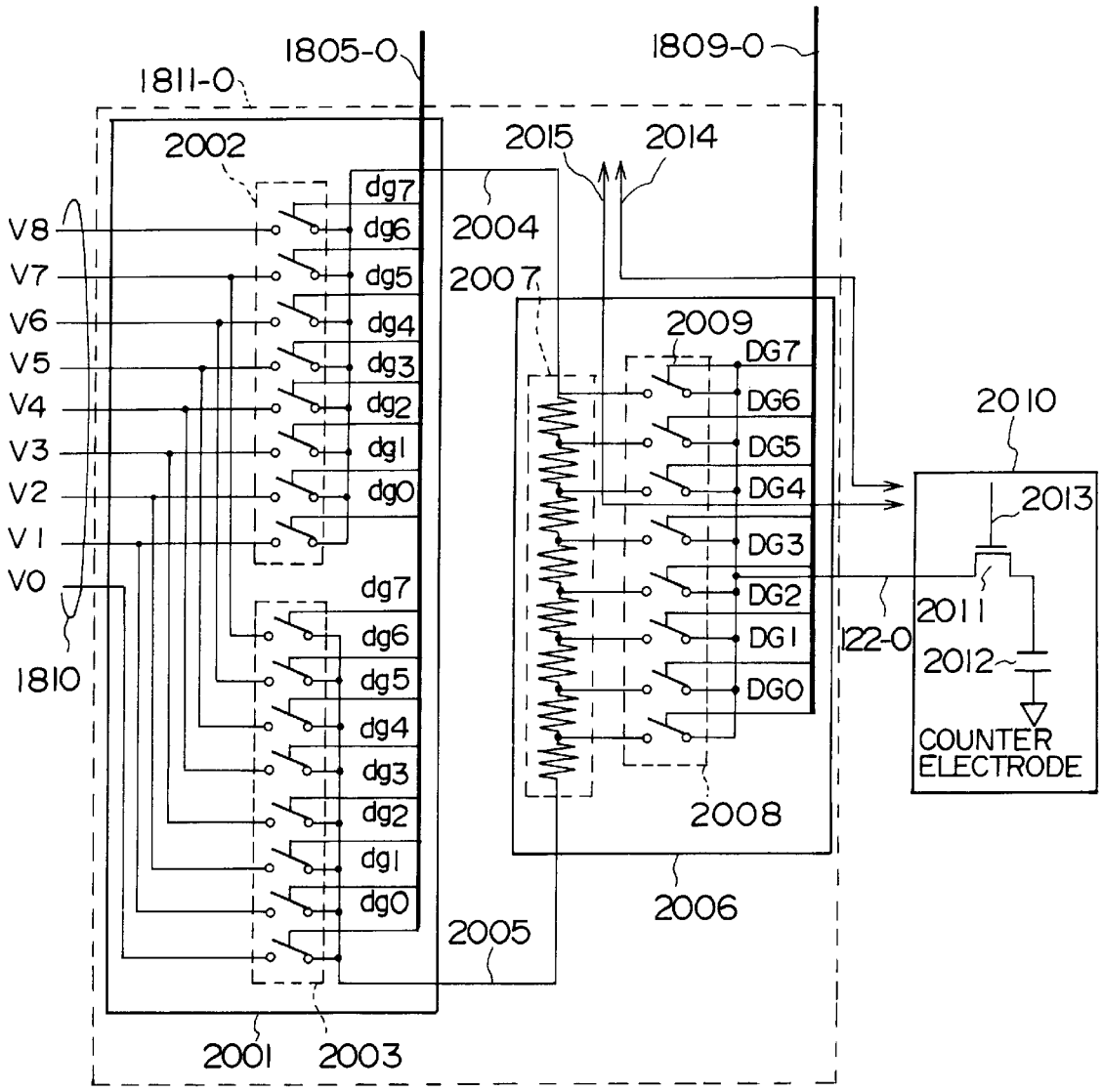
FIG. 20 is a simplified block diagram of a voltage divider circuit in the ninth embodiment of the present invention.

The ninth embodiment of the present invention will be described with reference to FIGS. 18 and 20. FIG. 18 is a simplified block diagram of an X driver circuit of 192 outputs, while FIG. 20 is a simplified block diagram of a voltage divider circuit.

Numeral 1801 designates the X driver circuit of 192 outputs. Symbols 1802-0 to 1802-191 denote latch outputs of upper 3 bits, symbols 1803-0 to 1803-191 latch outputs of lower 3 bits, symbols 1804-0 to 1804-191 decoders for the upper 3 bits, symbols 1805-0 to 1805-191 the output buses of the decoders 1804-0 to 1804-191, symbols 1806-0 to 1806-191 gate circuits, symbols 1807-0 to 1807-191 the output buses of the gate circuits 1806-0 to 1806-191, symbols 1808-0 to 1808-191 decoders for the lower 3 bits, and symbols 1809-0 to 1809-191 the output buses of the decoders 1808-0 to 1808-191, respectively.

The latch outputs 1802-0 to 1802-191 enter the respective decoders 1804-0 to 1804-191 for the upper 3 bits, the decoded results of which are delivered to the respective output buses 1805-0 to 1805-191. On the other hand, the latch outputs 1803-0 to 1803-191 enter the respective gate circuits 1806-0 to 1806-191. Herein, when a control signal 118 is asserted, the gate circuits 1806-0 to 1806-191 convert all the input data into "1", and when the control signal 118 is negated, the gate circuits 1806-0 to 1806-191 deliver the input data to the respective output buses 1807-0 to 1807-191 without converting them. The data of the output buses 1807-0 to 1807-191 enter the respective decoders 1808-0 to 1808-191, the decoded results of which are delivered to the respective output buses 1809-0 to 1809-191.

Numeral 1810 represents a voltage bus which is supplied with tonal voltages of 9 levels. Symbols 1811-0 to 1811-191 denote the voltage divider circuits each of which divides the voltages of the 9 levels into voltages of 64 levels.

The voltage divider circuits 1811-0 to 1811-191 select ones of the 64-level voltages (each voltage divider circuit selects one of the 64-level voltages) generated on the basis of the 9-level voltages supplied from the power source bus 1810, in accordance with the data of the output buses 1805-0 to 1805-191 and the output buses 1809-0 to 1809-191, and they deliver the selected voltages to outputs 122-0 to 122-191, respectively.

The voltage divider circuit shown in detail in FIG. 20 produces the voltages of the 64 levels from the voltages of the 9 levels. Here, the voltage divider circuit 1811-0 in FIG. 18 shall be referred to. In FIG. 20, numeral 2001 indicates a voltage selector, numeral 2002 a group of selection switching elements on a higher potential side, numeral 2003 a group of selection switching elements on a lower potential side, numeral 2004 the output of the voltage selector 2001 on the higher potential side, numeral 2005 the output of the voltage selector 2001 on the lower potential side, numeral 2006 a voltage divider by which a voltage across the outputs 2004 and 2005 is divided into voltages of 8 levels including the output 2004, numeral 2007 a group of voltage dividing resistors, numeral 2008 a group of selection switching elements, numeral 2009 that switching element in the group of switching elements 2008 which delivers the potential of the higher potential side, numeral 2010 a liquid-crystal panel, numeral 2011 a switching element in the liquid-crystal panel 2010, numeral 2012 a liquid-crystal element of one pixel, numeral 2013 a scanning line, numeral 2014 the path of current which flows when the control signal 118 is negated, and numeral 2015 the path of current which flows when the control signal 118 is asserted.

The voltage selector 2001 brings one of the higher potential side switching elements 2002 and one of the lower potential side switching elements 2003 into conductive states in correspondence with the data of the output bus 1805-0. It delivers the selected voltage of the higher potential side to the output 2004, and the selected voltage of the lower potential side to the output 2005. In the output bus 1805-0, an output dg0 is asserted when the decoded value of the upper 3 bits of the display data is "0". Likewise, an output dg1 is asserted when the decoded value is "1", . . . , and an output dg7 is asserted when the decoded value is "7". Here, when the output dg0 is asserted, the voltages V1 and V0 are selected, and when the output dg1 is asserted, the voltages V2 and V1 are selected. In this manner, the voltage selector 2001 selects the voltages of 2 levels corresponding to the decoded value.

The potentials of the outputs 2004 and 2005 enter the voltage divider 2006. In the voltage divider 2006, one of the divisional voltages of the 8 levels including the potential of the output 2004 as produced by the group of voltage dividing resistors 2007, is selected and delivered to the output 122-0 by the group of selection switching elements 2008 in accordance with the decoder output 1809-0. In a case where an output DG7 is asserted, the switching element 2009 falls into a conductive state so as to select the potential of the output 2004. In a case where an output DG0 is asserted, the first potential as reckoned from the lower potential side is selected from among voltages obtained in the way that the potential across the outputs 2004 and 2005 is divided by 7. In this manner, the (decoded value)th voltage as reckoned from the lower potential side is selected from among the 8 levels which consist of the voltage of the output 2004 and the 7 divisional voltages based on the potential across the outputs 2004 and 2005, in correspondence with the decoded value. Owing to such a circuit arrangement, the voltage divider circuit 1811-0 can generate the voltages of the 64 levels (=8 sets of voltages×8 divisional voltages) and deliver the voltages corresponding to the display data of the 6 bits.

The other voltage divider circuits 1811-1 to 1811-191 in FIG. 18 perform similar operations.

The operation of this embodiment will be described in detail with reference to FIGS. 18 and 20.

Assuming that the display data which is to be latched in a latch circuit 110-0 is "110100", the display data is latched in synchronism with a clock signal 106. The latch circuit 110-0 delivers the upper 3 bits "110" of the display data to the output bus 1802-0, and the lower 3 bits "100" to the output bus 1803-0. The data of the output bus 1802-0 enters the decoder 1804-0 and is decoded therein, with the result that the output dg6 of the output bus 1805-0 is asserted. The data of the output bus 1803-0 enters the gate circuit 1806-0. Subject to the negation of the control signal 118, the gate circuit 1806-0 turns any data into "1" without regard to the data of the output bus 1803-0. In contrast, subject to the assertion of the control signal 118, the gate circuit 1806-0 delivers the data "100" of the output bus 1803-0 to its output bus 1807-0. Accordingly, when the control signal 118 is negated, any data of the output bus 1807-0 becomes "1", and hence, the decoder circuit 1808-0 asserts the output DG7 of the output bus 1809-0. On the other hand, when the control signal 118 is asserted, the data of the output bus 1807-0 becomes "100", and hence, the output DG4 of the output bus 1809-0 is asserted.

The voltage divider circuit 1811-0 operates as explained below in conjunction with FIG. 20. Since the output dg6 of the output bus 1805-0 is asserted, the voltage V7 is delivered to the output 2004, and the voltage V6 to the output 2005.

When the control signal 118 is negated, the output DG7 of the output bus 1809-0 is asserted. Therefore, the switching element 2009 to which the output DG7 is connected falls into the conductive state, and the voltage V7 is delivered to the output 122-0. The output 122-0 leads to the liquid-crystal panel 2010. The switching element 2011 is rendered conductive owing to the scanning line 2013 asserted on this occasion, so that the voltage V7 is applied to the liquid-crystal element 2012. The output current of the voltage divider circuit 1811-0 at this time flows through the current path 2014.

On the other hand, when the control signal 118 is asserted, the output DG4 of the output bus 1809-0 is asserted. Therefore, the switching element to which the output DG4 is connected falls into the conductive state, and the following voltage is delivered to the output 122-0:

$$V_s=V6+(V7-V6))\times 4/8$$

The output current at this time flows through the current path 2015 which passes through the voltage dividing resistors 2007.

The other voltage divider circuits 1811-1 to 1811-191 in FIG. 18 perform similar operations, and deliver the voltages corresponding to the display data.

A tenth embodiment of the present invention will be described with reference to FIG. 22 which is a schematic block diagram of the X driver circuit having 192 outputs.

If the circuit of the digital unit comprises transistors each having a breakdown voltage of 3 volts and the maximum tonal voltage is 5 volts, the voltage divider circuits 1811-0 to 1811-191 should comprise transistors each having a breakdown voltage of 5 volts or more. Accordingly, if the voltage divider circuits 1811-0 to 1811-191 comprise transistors each having a breakdown voltage of 5 volts, the signals for controlling the voltage divider circuits are negated to operate the transistors unless they have a voltage range of 5 voltages.

Figure 22:
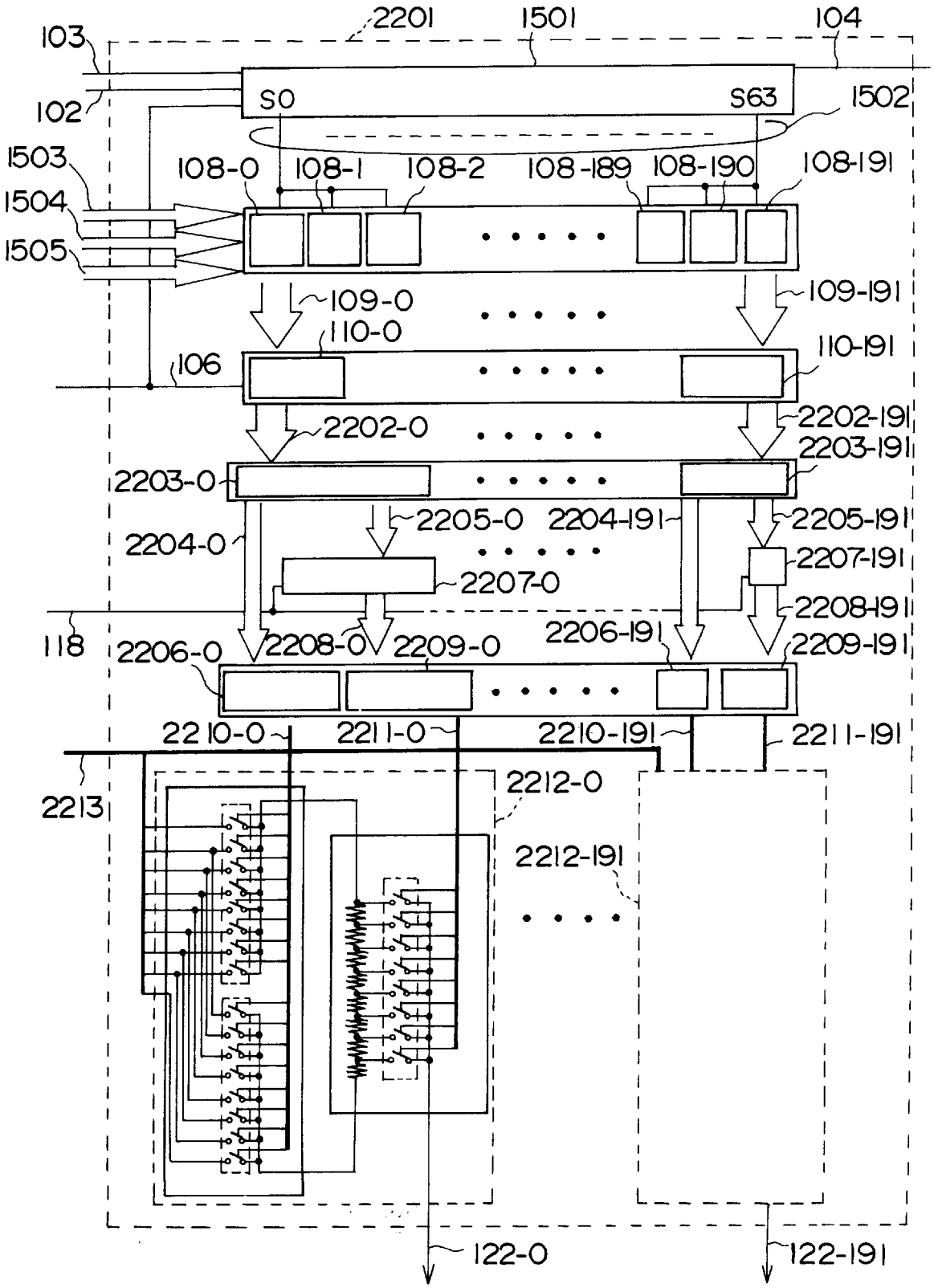
FIG. 22 is a simplified block diagram of an X driver circuit in the tenth embodiment of the present invention.

FIG. 22 shows a schematic block diagram of the X driver circuit having a capability of shifting the level of the 192 outputs.

In present embodiment, the X driver circuits deal with a case in which the tonal voltage which is externally supplied in the former embodiment is higher than the voltage of the power source of the digital unit.

A reference numeral 2201 denotes an X driver circuit; reference numerals 2202-0 to 2202-191 denote output buses; 2203-0 to 2203-191 denote level shift circuits; 2204-0 to 2204-191 denote high voltage output buses of upper 3 bits of the level shift circuit 2203-0 to 2203-191; 2205-0 to 22-5-191 denote the high voltage buses of the lower 3 bits of the level shift circuits 2203-0 to 2203-191; 2206-0 to 2206-191 denote high voltage decoder circuits; 2208-0 to 2208-191 denotes high voltage output buses of the high voltage gate circuits 2207-0 to 2207-191; 2209-0 to 2209-191 denote high voltage decoder circuits; 2210-0 to 2210-191 denote the high voltage buses of the high voltage decoder circuits 2206-0 to 2206-191; 2211-0 to 2211-191 denote high voltage output buses of the high voltage decoder circuits 2209-0 to 2209-191; 2212-0 to 2212-191 denote high voltage divider circuits; 2213 denotes a high voltage bus.

The level shift circuits 2203-0 to 2203-191 convert the data having a voltage range of 3 volts into the data having a voltage range of 5 volts among which a tonal voltage can be selected for outputting them to the output buses 2205-0 to 2205-191.

Since the other circuits are only modified to deal with higher voltage signals, the operation of them is similar to that of the ninth embodiment. Higher voltage signals can be dealt with by shifting the levels of the signals from the latch circuits 110-0 to 110-191 of the X driver circuit which has been described with reference to the first to sixth embodiments by means of similar level shift circuits.

Even if the capacitance and the resistance of the liquid crystal panel is changed in the above mentioned ninth to twelfth embodiments, the X driver circuit can cope with the change in the capacitance and resistance since any negation period of time of the control signal 118 can be set at will.

Although series resistors are used in the voltage divider circuit in the above mentioned ninth to twelfth embodiments, a similar driving system is used if the voltage divider circuit is adapted to directly output higher voltages.

In a case where the number of divisions of the voltage divider circuit has been changed to 16, for example, the level shift circuit can deal with the change in the number of divisions of the voltage by making the number of external voltage set at 5 levels, separating the latched data into upper 2 bits and lower 4 bits, and using respective decoder and gate circuits.

In each of the ninth thru twelfth embodiments, in a case where the number of tones has been changed, for example, from 64 tones to 256 tones, the X driver circuit can deal with the change in the number of tones by converting the data buses 1503, 1504 and 1505 into 8 bit buses, increasing the number of bits of the latch from 6 bits to 8 bits, by making the number of external voltage set at 17 levels, by dividing the latched data into upper 4 bits and lower 4 bits and using respective decoders and 16-voltage divider circuits.

Also in the ninth to twelfth embodiments, the X driver circuit can also be operated under control of the latch clock 1401 as is similar to the above mentioned ninth embodiment.

In the above mentioned ninth, eleventh and twelfth embodiments, the X driver circuit can be deal with the change in the number of outputs by making the number of the outputs of the shift registers, the number of latch circuits, the number of the gate circuits, the number of the decoders, and the number of the voltage divider circuits equal to the number of the changed outputs.

In the above mentioned tenth embodiment, the X driver circuit can deal with the change in the number of outputs by making the number of the level shift circuits, the number of outputs of the shift registers, the number of latch circuits, the number of gate circuits, the number of decoders and the number of the voltage divider circuits equal to the number of outputs.

Figure 17:
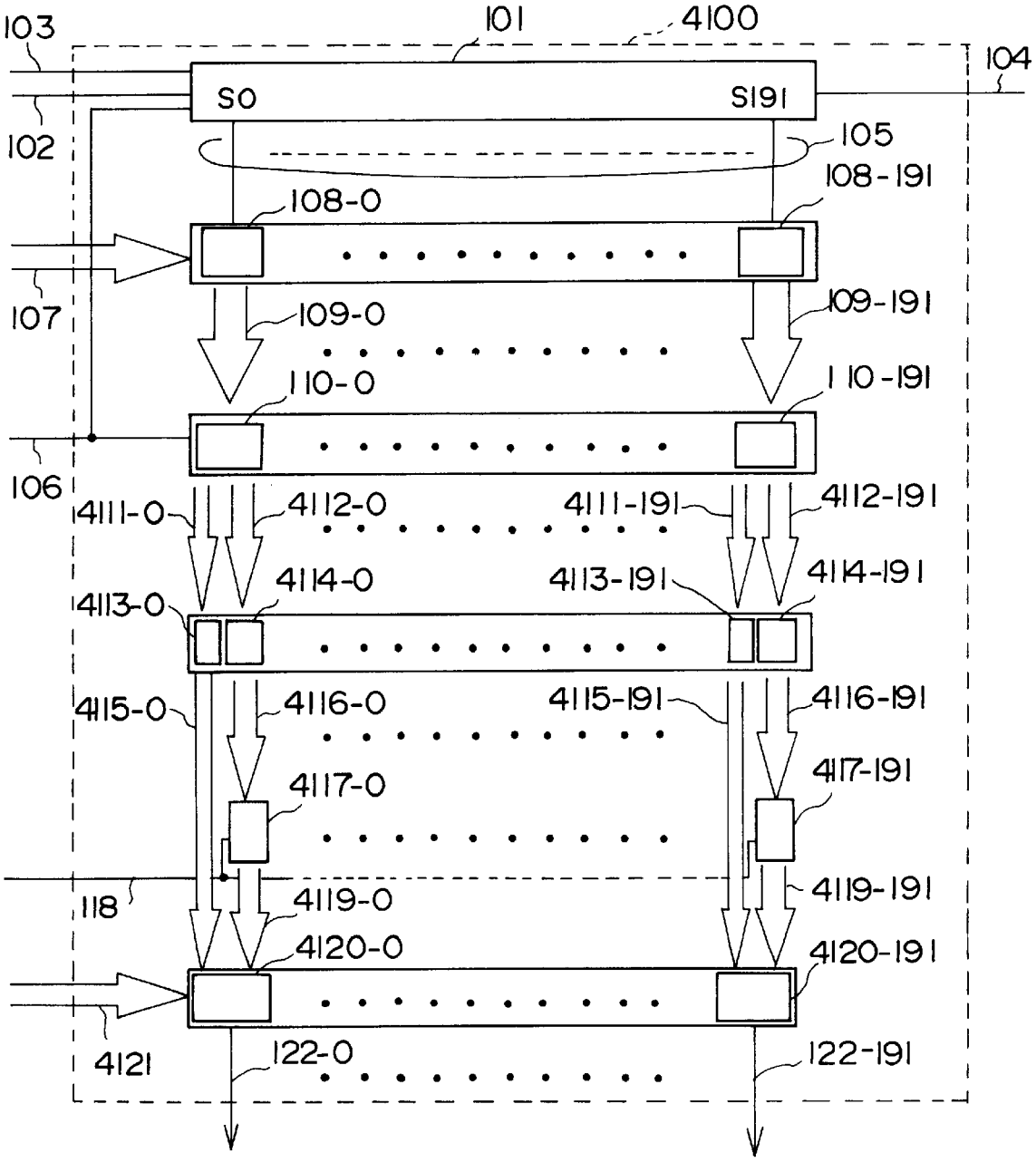
FIG. 17 is a simplified block diagram of an X driver circuit of 192 outputs in the eleventh embodiment of the present invention.
Figure 19:
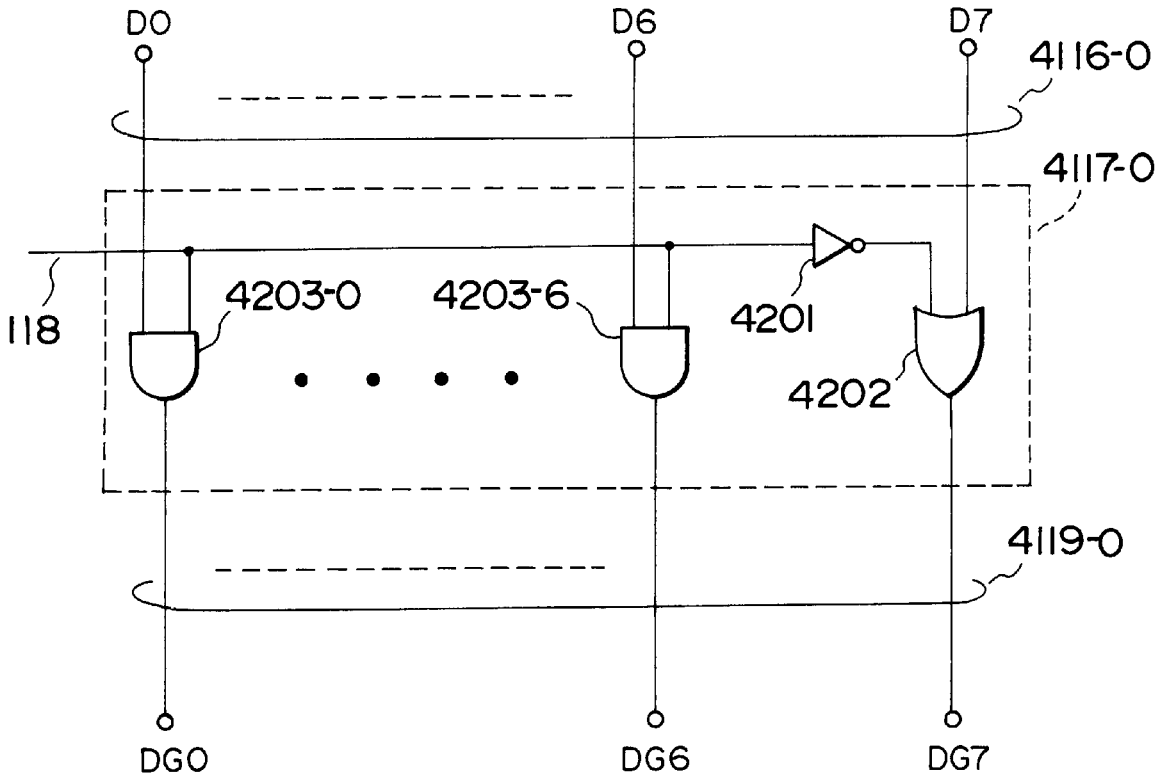
FIG. 19 is a simplified connection diagram of a gate circuit in the eleventh embodiment of the present invention.
Figure 21:
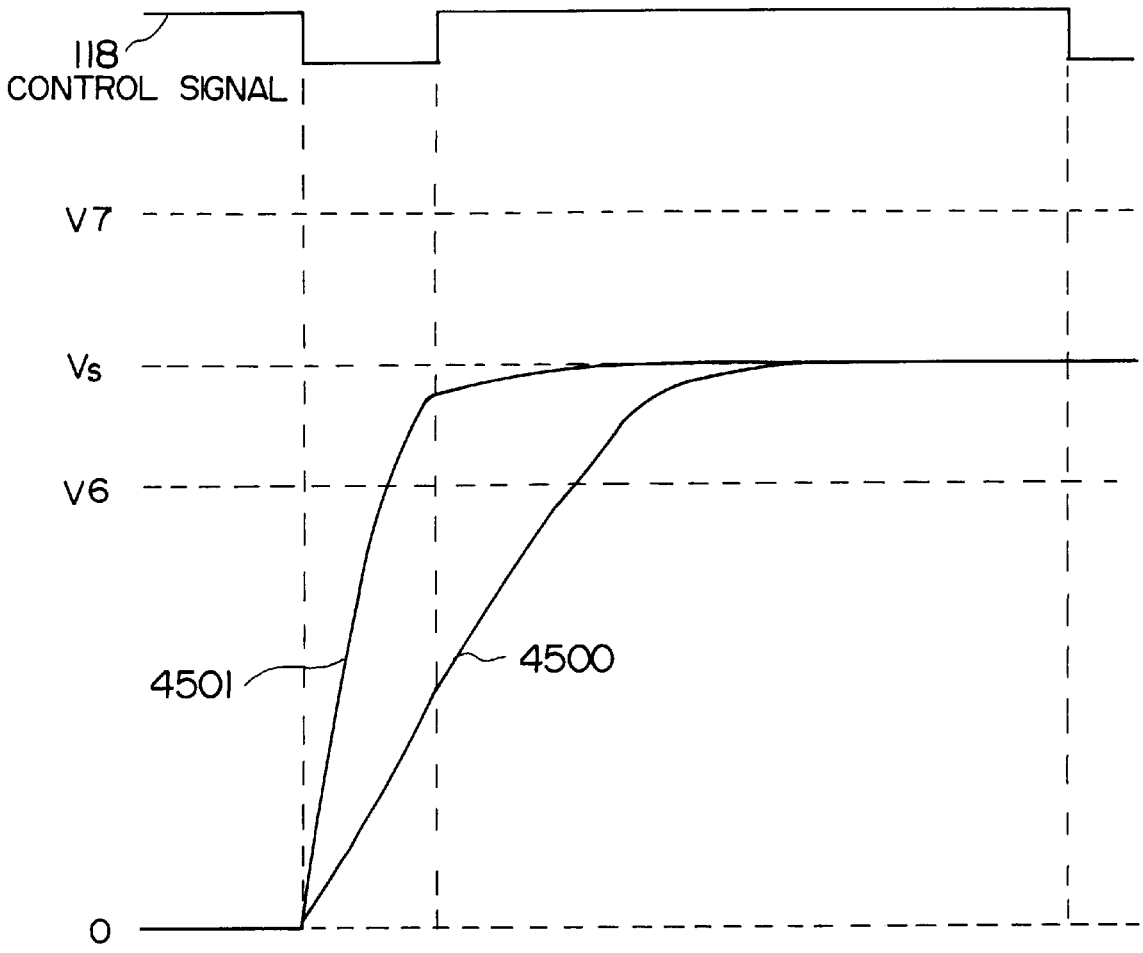
FIG. 21 is a diagram for explaining an output waveform in the eleventh embodiment of the present invention.
Figure 63:
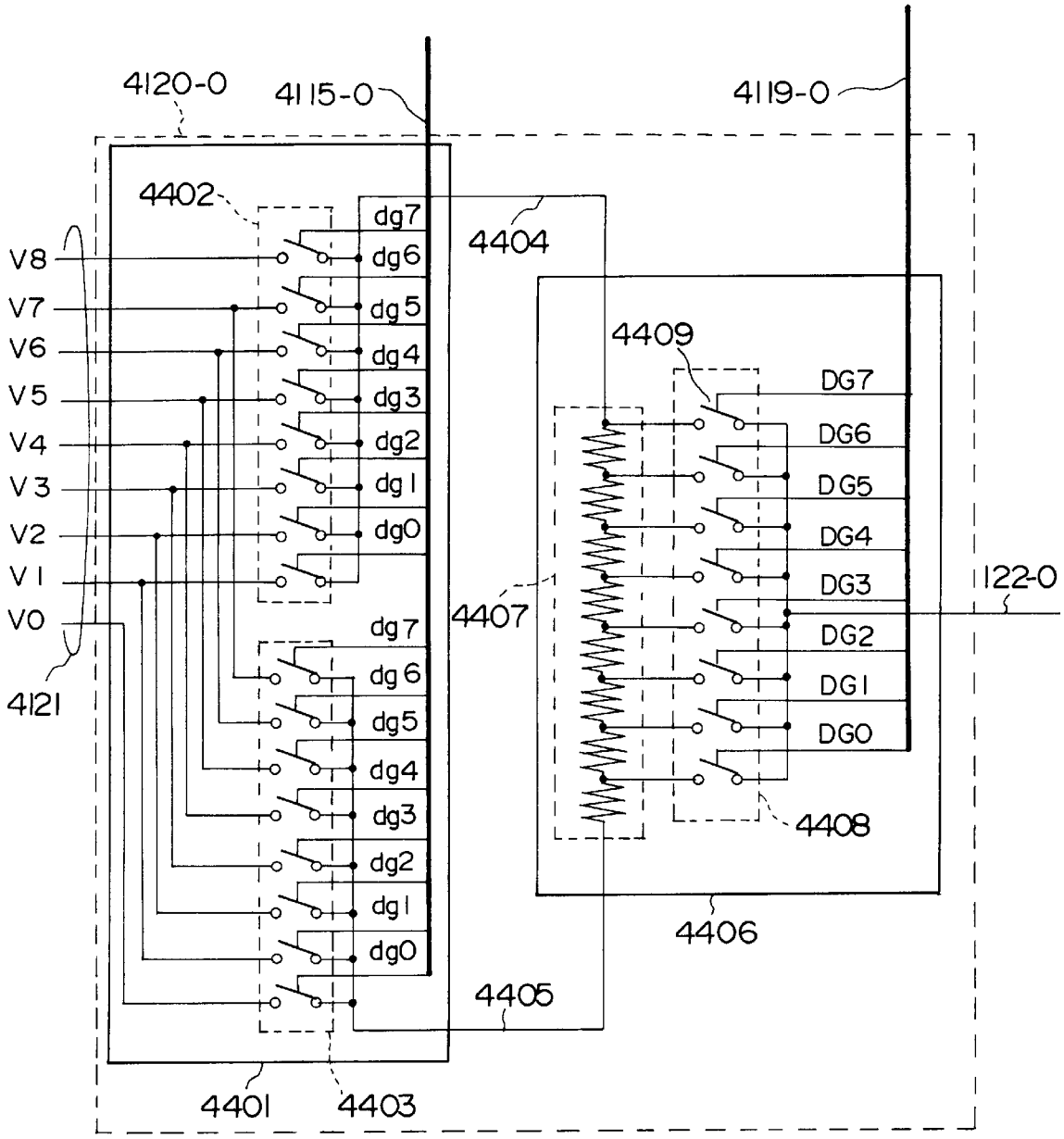
FIG. 63 is a simplified block diagram of a voltage divider circuit in the eleventh embodiment of the present invention.

Now, the eleventh embodiment of the present invention will be described with reference to FIGS. 17, 19, 21 and 63. FIG. 17 is a schematic block diagram showing the X driver circuit of 192 outputs. FIG. 19 is a schematic circuit diagram showing a gate circuit; FIG. 63 is a schematic block diagram showing a voltage divider circuit and FIG. 21 is an output waveform view.

FIG. 7 shows the X driver circuit 100 which has 192 outputs, which can output voltages for 64 tones per output. In FIG. 7, numeral 101 denotes a shift register, numeral 102 a clock, numeral 103 a control signal from the X driver circuit at a preceding stage, numeral 104 a control signal which is transferred to an X driver circuit at the next stage, numeral 105 the output bus of the shift register 101, and numeral 105 a latch clock.

When the control signal 103 fed from the X driver circuit at the preceding stage has been asserted of validated, the shift register 101 asserts the respective outputs S0 to S191 of the output bus 105 for successive time periods each being equal to one cycle of the clock signal 102 in synchronism with this clock signal. When the shift register 101 has asserted the output S191, it asserts the control signal 104 fed to the X driver circuit at the succeeding stage. Thereafter, the shift register 101 negates the output S191 after one cycle of the clock signal 102, and it does not operate until the control signal 103 from the X driver circuit at the preceding stage is asserted after the subsequent assertion of the latch clock signal 106.

A reference numeral 107 designates a data bus for 6 bit display data which has binary digital data of "high" and "low" levels per bit. Reference numerals 108-0 to 108-191 denotes latch circuits of 6 bits, respectively, while symbols 109-0 to 109-191 denote output buses of 6 bits, respectively.

The data bus 107 is supplied with the display data in synchronism with the clock signal 102. The corresponding output lines of the output bus 105-1 of the shift register 101 are respectively connected to the latch circuits 108-0 to 108-191. When the signals of the output lines have been asserted, the respective latch circuits 108-0 to 108-191 latch the display data of the data bus 107 and to send the display data to the corresponding output buses 109-0 to 109-191 as latched data. In this way, the latch circuits 108-0 to 108-191 latch the 192 display data and send them to the output buses 109-0 to 109-191 successively in synchronism with the outputs of the shift register 101, respectively.

Reference numerals 110-0 to 110-191 denote 6 bit latch circuits. 4110-0 to 4111-191 denote output buses for the upper 3 bits of the latched data of the respective latch circuits 110-0 to 110-191, while numerals 4112-0 to 4112-191 denote output buses for the lower 4 bits of the latched data of the respective latch circuits 110-0 to 110-191.

When the latch clock signal 106 has been asserted, the latch circuits 110-0 to 110-191 operate to simultaneously latch the latched data of the output buses 109-0 to 109-191 and to supply the output buses 4111-0 to 4111-191 with the latched data of the upper 2 bits and the output buses 4112-0 to 4112-191 with those of the lower 4 bits.

Numerals 4113-0 to 4113-191 denote decoders for decoding the data of the output buses 4111-0 to 4111-191, respectively, while numerals 4111-0 to 4111-191 denote decoders for decoding the data of the output buses 4112-0 to 4112-191, respectively. Output buses 4115-0 to 4115-191 transfer the decoded signals of the respective decoders 4113-0 to 4113-191, each of including 8 signal lines. On the other hand, output buses 4116-0 to 4116-191 transfer the decoded signals of the respective decoders 4114-0 to 4114-191, each including 8 signal lines. Shown at numerals 4117-191 are gate circuits whose control signal 118 is supplied from external of the X driver circuit 100 and is synchronized with the latch clock signal 106. Numerals 4119-0 to 4119-191 denote output buses of the gate circuits 4117-0 to 4117-191.

The decoders 4113-0 to 4113-191 decode the data of the upper 3 bits fed to the output buses 4111-0 to 4111-191 and then transfer the decoded signals to the output buses 4115-0 to 4115-191, respectively. Likewise, the decoders 4114-0 to 4114-191 decode the data of the lower 4 bits fed to the output buses 4112-0 to 4112-191 and then transfer the decoded signals to the output buses 4116-0 to 4116-191, respectively. While the control signal 118 is negated or invalidated, the gate circuits 4117-0 to 4117-191 hold the output buses 4119-0 to 4119-191 of the lower 3 bits in nonconductive states and assert the output lines of the output buses 4110-0 to 4119-191 corresponding to a decoded value "7", respectively. When the control signal 118 has been asserted, the gate circuits 4117-0 to 4117-191 bring the output buses 4116-0 to 4116-191 and the output buses 4119-0 to 4119-191 into conductive states.

Numerals 4120-0 to 4120-191 denote voltage divider circuits which generate voltages corresponding to the display data, respectively. Shown at numeral 4121 is a voltage bus through which voltages of 9 levels externally supplied are propagated. The voltage divider circuits 4120-0 to 4120-191 have output lines 4122-0 to 4122-191, respectively.

The voltage divider circuits 4120-0 to 4120-191 generate the voltages corresponding to the data of the output buses 4115-0 to 4115-191 and the output buses 4119-0 to 4119-191, on the basis of the voltages of the voltage bus 4121, and they output the generated voltages to the output lines 4122-0 to 4122-191, respectively. The output lines 4122-0 to 4122-191 are connected to a liquid-crystal panel so that the voltages can be applied to liquid-crystal elements constituting the liquid-crystal panel.

FIG. 19 is the simplified circuit diagram of the gate circuit which is included in the X driver circuit shown in FIG. 17. Here, the gate circuit 4117-0 shall be referred to.

In the output bus 4116-0, reference symbol D0 denotes a signal which assumes "1" when the decoded value of the lower 3 bits of the display data is "0". Likewise, a signal D1 assumes "1" when the decoded value is "1", . . . , and a signal D7 assumes "1" when the decoded value is "7".

In FIG. 19, numeral 4201 denotes an inverter circuit, and numeral 4202 an OR circuits of 2 inputs. The inverter circuit 4201 inverts the polarity of the control signal 118, and supplies the inverted signal to the OR circuit 4202. Besides, the signal D7 of the output bus 4116-0 is supplied to the OR circuit 4202. When the control signal 118 assumes "0", the OR circuit 402 is supplied with "1" by the inverter circuit 4201. Thus, irrespective of the data of the input D7 of the output bus 4116-0, the Or circuit 4202 sends "1" to its output dG7 into an asserted state. On the other hand, when the control signal 118 is "1", the OR circuit 4202 is supplied with "0" by the inverter circuit 4201. Therefore, the data of the input D7 of the output bus 4116-0 is fed to the output D7.

Reference numerals 4203-1 to 4203-6 is supplied with the control signal 118, while the other input is supplied with the corresponding one of the inputs D1 to D6 of the output bus 4116-0. When the control signal 118 is "0", all the outputs DG0 to DG6 of the respectively AND circuits 4203-1 to 4203-6 become "0". On the other hand, when the control signal 118 is "1", the AND circuits 4203-1 to 4203-6 supply the outputs DG0 to DG14 of the output bus 4119-0 with data having the same values as those of the data of the inputs D1 to D6 of the output bus 4116-0, respectively.

The other gate circuits 4117-1 to 4117-191 in FIG. 17 perform similar operations.

As stated before, FIG. 63 is a block diagram of the voltage divider circuit which is included in the X driver circuit shown in FIG. 17. Here, the voltage divider circuit 4120-0 shall be referred to. Numeral 4401 denotes a voltage selector, numeral 4402 a group of selection switching elements on a high potential side, numeral 4403 a group of selection switching elements on a low potential side, numeral 4404 the high voltage side one of the outputs of the voltage selector 4401, numeral 4405 the low voltage side one of the outputs of the voltage selector 4401, numeral 4406 a voltage divider which divides a voltage across the outputs 204 and 205 into voltages of 8 levels including the voltage of the output 4404, numeral 4407 a group of voltage dividing resistors, numeral 4408 a group of selection switching elements, and numeral 4409 that one of the switching elements 4408 which outputs the potential of the low potential side.

The voltage selector 4401 brings one of the switching elements 4402 on the high potential side and one of the switching elements 4403 on the low potential side into conductive states in response to the decoded signal of the output bus 4115-0. Thus, it sends the selected voltage of the high potential side to the output 4404 and that of the low potential side to the output 4405. Among the data of the output bus 4115-0, an output dg0 is asserted when the decoded value of the upper 2 bits of the display data is "0". Likewise, an output dg1 is asserted when the decoded value is "1", an output dg2 is asserted when the decoded value is "2", and so on. An output dg7 is asserted when the decoded value is "3". Here, the voltages V1 and V0 are selected on the assertion of the output dg0, and the voltages V2 and V1 are selected on the assertion of the output dg1. In this manner, two level voltages are selected depending upon the decoded value.

The outputs 4404 and 4405 are supplied to the voltage divider 4406. In response to the outputs 119-0 of the decoder, the voltage divider 4406 selects one of the divided voltages of the 8 levels including the potential of the output 4404 generated by the group of voltage dividing resistors 4407, by means of any of the selection switching elements 4408. Then, the selected voltage is fed to the output line 122-0. More specifically, when the output DG7 is asserted, the switching element 208 are brought into the conductive state so as to select the potential of the output 205. Besides, when the output DG0 is asserted, the first potential above the low potential side is selected from among the voltages which are obtained in such a way that the potential across the outputs 4406 and 4407 is divided by 15. In this manner, the (decoded value)th potential above the low potential side is selected depending upon the decoded value from among the 8 levels which consist of the potential of the output 4404 and the voltages obtained by dividing the potential across the outputs 4404 and 4405 by 7.

Owing to such a circuit arrangement, the voltage divider circuit 4120-0 can generate voltages for the 64 tones (=8 sets of voltages×8 divisional voltages) and can send the voltages corresponding to the display data of 6 bits.

The other voltage divider circuits 4120-1 to 4120-191 shown in FIG. 17 perform similar operations. Now, operation will be described in detail with reference to FIGS. 17, 19, 63 and 21. The latch circuits 108-0 to 108-191 successively latch the display data on the data bus 107 in synchronism with the output bus 105 of the shift register 101 to output the latched outputs to the output buses 109-0 to 109-191. If the display data which is latched by the latch circuit 108-0 at this time is represented as "110100" from the upper bit, the data on the output bus 109-0 is then represented as "110100". Then, the next latch circuit 110-0 latches the data on the output bus 109-0 in synchronism with the latch clock 106 to output upper 3 bits and lower 3 bits to the output buses 4111-0 and 4112-0, respectively. The data "110" on the output data is input to the decoder 4113-0 by which the data is decoded. The data "100" on the output bus 4112-0 is input to the decoder 4114-0 by which the data is decoded. As a result of this, the decoded values of the data on the output buses 4114-0 and 4115-0 are "6" and "4", respectively. Among the output bus 4115-0 of the decoder 4113-0 and the output bus 4116-0 of the decoder 4114-0, the output lines related to the decoded values "6" and "4" are asserted. The output bus 4116-0 is connected to the gate circuit 4117-0. Operation of the gate circuit 4117-0 will be described with reference to FIG. 19. Since the control line 118 is "0" at this time, the output DG7 of the OR circuit 4202 is "1" and the outputs DG0 to DG7 of the AND circuits 4203-1 to 4203-7 are "0". These outputs are input to the voltage divider circuit 4120-0 to 4120-191 shown in FIG. 19 through the output bus 4119-0. Now, operation of the voltage divider circuit 4120-0 will be described with reference to FIG. 63. The data line dg6 having a decoded value "6" of the upper 3 bits of the input bus 4114-0 connected with the voltage selector 4401 is asserted. As a result, the voltage selector 4401 outputs voltages V7 and V6 to the outputs 4404 and 4405, respectively. The data line DG7 of the output bus 4119-0 is asserted for the voltage divider circuit 4406. As a result, the switching element 4409 is rendered conductive to output the voltage V7 to the output 4122-0. Accordingly, since no resistive element is interposed between the output 122-0 and the voltage line V7 of the voltage bus 4121, the output impedance lowers. When the control line 118 in FIG. 17 becomes "1" thereafter, the OR circuit 4202 shown in FIG. 19 outputs data D7 on the output bus 4116-0 to the output DG7. The AND circuit 4203-0 to 4203-6 output the data D0 to D6 on the output bus 4116-0 to DG0 to DG14 of the output bus 4119-0. At this time, the output bus 4116-0 has D4 corresponding to the decoded value "4" which is asserted and other data which are negated. The data is input to the voltage divider circuit 4406 via the output bus 4119-0 shown in FIG. 63. In a case where each level is equally divided by the voltage divider circuit 4406, DG4 is asserted. Therefore, among the switching element group 4408, the switching element to which DG4 is connected becomes conductive to output a voltage to the output 122-0. The voltage is as follows:

$$Vs=V6+(V7-V6)\times 4/8$$

The other voltage divider circuits 4120-1 to 4120-191 in FIG. 17 perform similar operations and output voltages corresponding to display data.

FIG. 21 shows a waveform view of an output signal of the output 122 when a liquid-crystal panel to connected to the output 122. In FIG. 21, a numeral 4500 denotes an output waveform when charging is conducted through resistors of the voltage divider circuit; 4501 denotes an output waveform when charging is conducted in the present embodiment. Since the liquid-crystal panel is a capacitive load, the charging/discharging time period varies depending upon the resistance which intervenes between a capacitive value and the external voltage. The larger the resistance value becomes, the longer the charging/discharging period of time becomes. In the systems which have been described with reference to FIGS. 17, 19 and 63, the voltage V7 is directly output from the output 4122 while the clock 118 shown in FIG. 17 is negated. Accordingly, the output signal quickly rises up as represented by the output waveform 4501 since the resistance includes only the resistances in the liquid-crystal panel. A predetermined value Vs which is set by the voltage divider circuit 4406 is output when the clock 118 is asserted. The output signal is charged or discharged until it becomes the predetermined value while the resistors of the liquid-crystal panel are in series with the resistors of the voltage divider circuit 4406. However, the period of charging/discharging time is extended due to the resistors of the voltage divider circuit 4406 as represented as the output waveform 4500 when it is output via the voltage divider circuit 4406 from the beginning.

Figure 64:
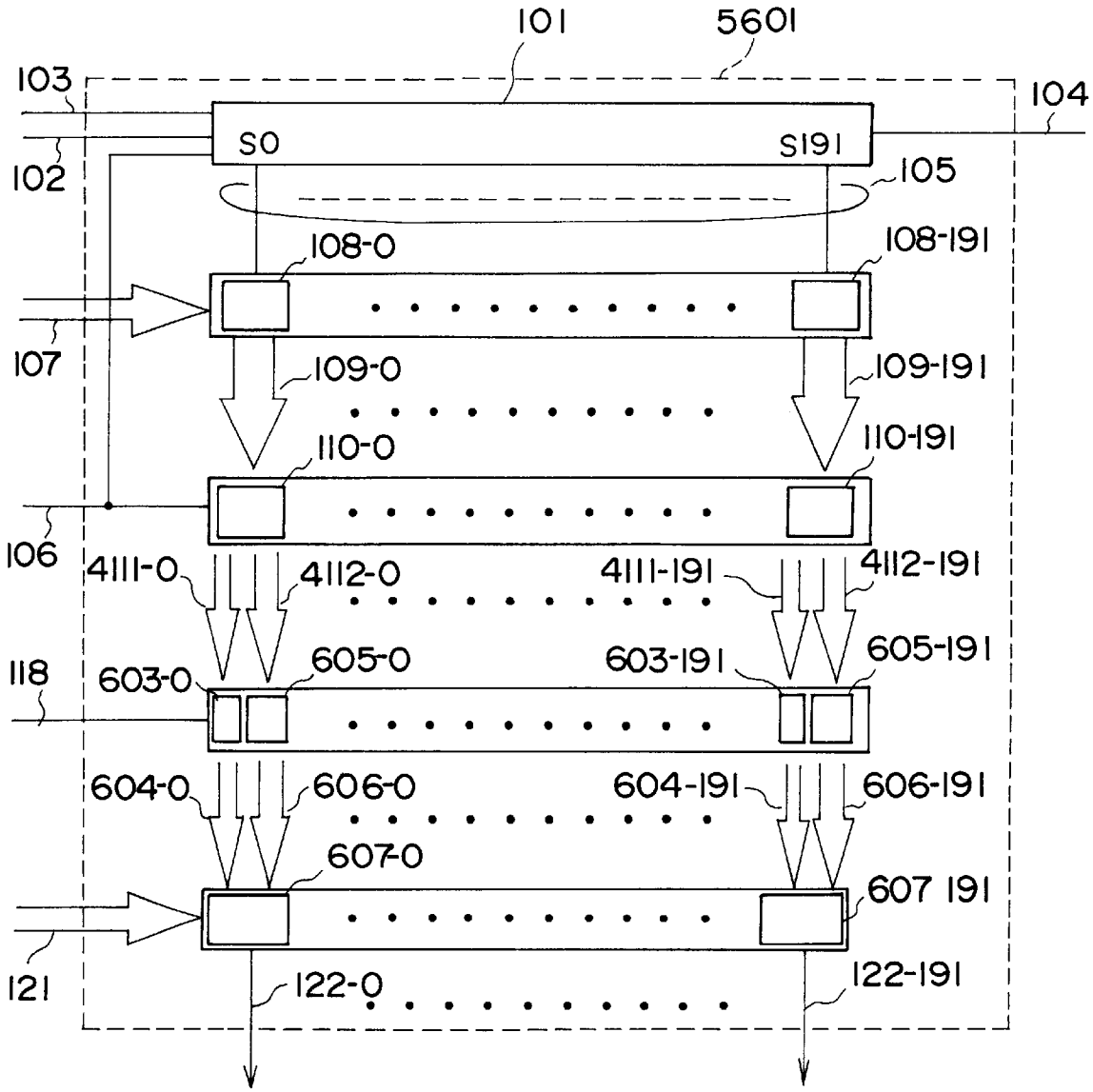
FIG. 64 is a simplified block diagram of an X driver circuit of 192 outputs in an embodiment of the present invention.
Figure 65:
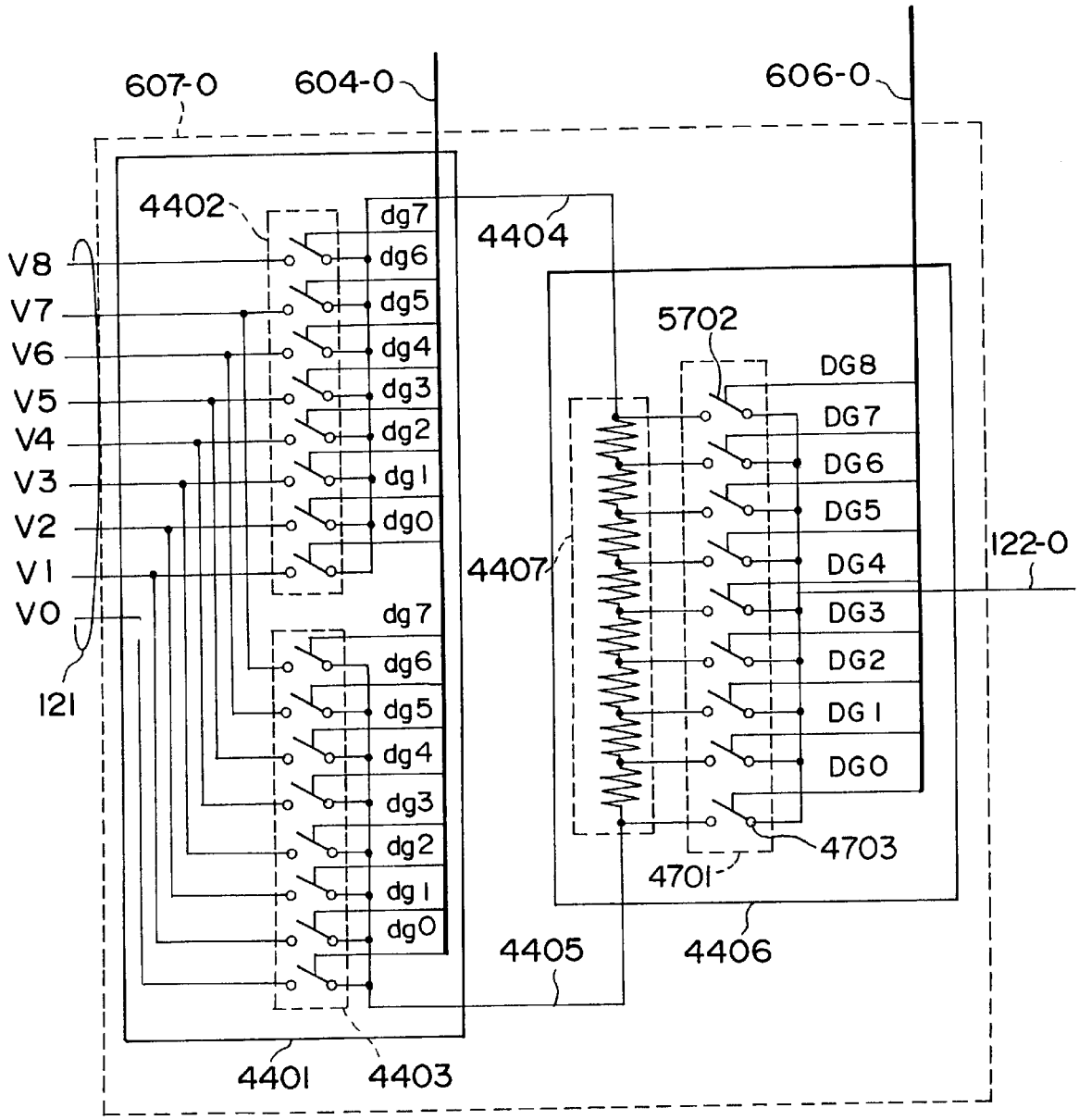
FIG. 65 is a simplified block diagram of a voltage divider circuit in an embodiment of the present invention.

Tenth embodiment of the present invention is shown in FIGS. 64 and 65. FIG. 64 is a schematic block diagram showing an X driver circuit. FIG. 65 is a schematic block diagram a voltage divider circuit.

FIG. 64 shows an X driver circuit having 192 outputs each being capable of outputting voltages for 64 tones. In FIG. 64, a reference numeral 601 denotes the X driver circuit having 192 outputs; 603 an upper bit decoder; 604 an output bus of the upper bit decoder comprising 8 signal lines dg0 to dg7; 605 a lower bit decoder; 606 an output bus of the lower bit decoder comprising 8 signal lines DG0 to DG7; and 607 a voltage divider circuit. The upper bit decoder 603 decodes the data on the output bus 4110 to output decoded data to the output bus 604. When the control signal 118 is "0", the lower bit decoder 605 brings DG8 into "1" irrespective of the data on the output bus 4112. When the control signal 118 is "1", the decoder 605 brings one of the signal lines DG1 to DG8 of the output bus 606 into "1" in response to the data on the output bus 4112. The output buses 604 and 605 are connected to the voltage divider circuit 607, which outputs from the output 122-0 a voltage depending upon the data on the output buses 604 and 606. A schematic block diagram of the voltage divider circuit 607 is shown in FIG. 65.

The voltage divider circuit shown in FIG. 65 generates voltages for 64 tones from an externally supplied voltages of 9 levels and outputs one level. A reference numeral 4701 denotes a switching element group comprising 9 switching elements; 4702 denotes a switching element of the switching element group, which connect the output 4204 with the output 122; 4703 denotes a switching element of the switching element group 4701 which connects the output 4405 with the output 122. In the voltage divider circuit 4407, a voltage having one level of V8 to V1 is selected by the switching element group 4402 in accordance with the data on the output bus 604 and is output from the output 4404 and one voltage having one level of V7 to V0 is selected by the switching element group 4403 and is output from the output 4405. The outputs 4404 and 4405 are connected to the opposite ends of the resistor group comprising in series connected 8 resistors. The switching element group 4408 selects a voltage having one level corresponding to the data on the output bus 4606 from the voltages having 9 levels including the voltages at the outputs 4404 and 4405 and outputs the selected voltage to the output 122.

Operation will be described with reference to FIGS. 64 and 65.

It is assumed that the data on the output buses 111 and 112 be represented as "110" and "011", respectively and the control signal 118 be "0", the upper bit decoder 603 brings the signal line dg6 of the output bus 604 into "1" and the other signal lines into "0". The lower bit decoder 605 brings the signal line DG8 into "1" and outputs it to the output bus 606 irrespectively of the display data when the control signal line 118 is "0". The decoded results are input to the voltage divider circuit 607. Operation of the voltage divider circuit 607 will be described with reference to FIG. 65. Since the signal line dg6 of the output bus 604 is "1" in FIG. 65, the switching element to which the dg6 is input is rendered conductive. Accordingly, a voltage V7 is output to the output 4404 and a voltage V6 is output to the output 4405, which are input to the opposite ends of the voltage divider 4406, respectively. Since the line DG8 of the output bus 606 is "1", the switching element 4702 to which the DG8 is connected is rendered conductive so that a voltage V7 is output to the output 4112.

When the control signal 118 becomes "1" thereafter, the lower bit decoder 605 in FIG. 69 brings the signal line DG4 corresponding to the data "0" on the output bus 4112 into "1", and outputs it to the output bus 606. The data on the output bus 604 of the upper bit decoder 603 does not change. Since the data on the output bus 606 has been changed in the voltage divider circuit 609 of FIG. 65, the switching element 4702 to which DG8 is connected becomes nonconductive and the switching element to which dG4 is connected becomes conductive. Therefore, the voltage divider circuit 607 outputs to the output 122 a voltage as $$Vs=(V7-V6)\times\tfrac{4}{8}+V6.$$

Figure 23:
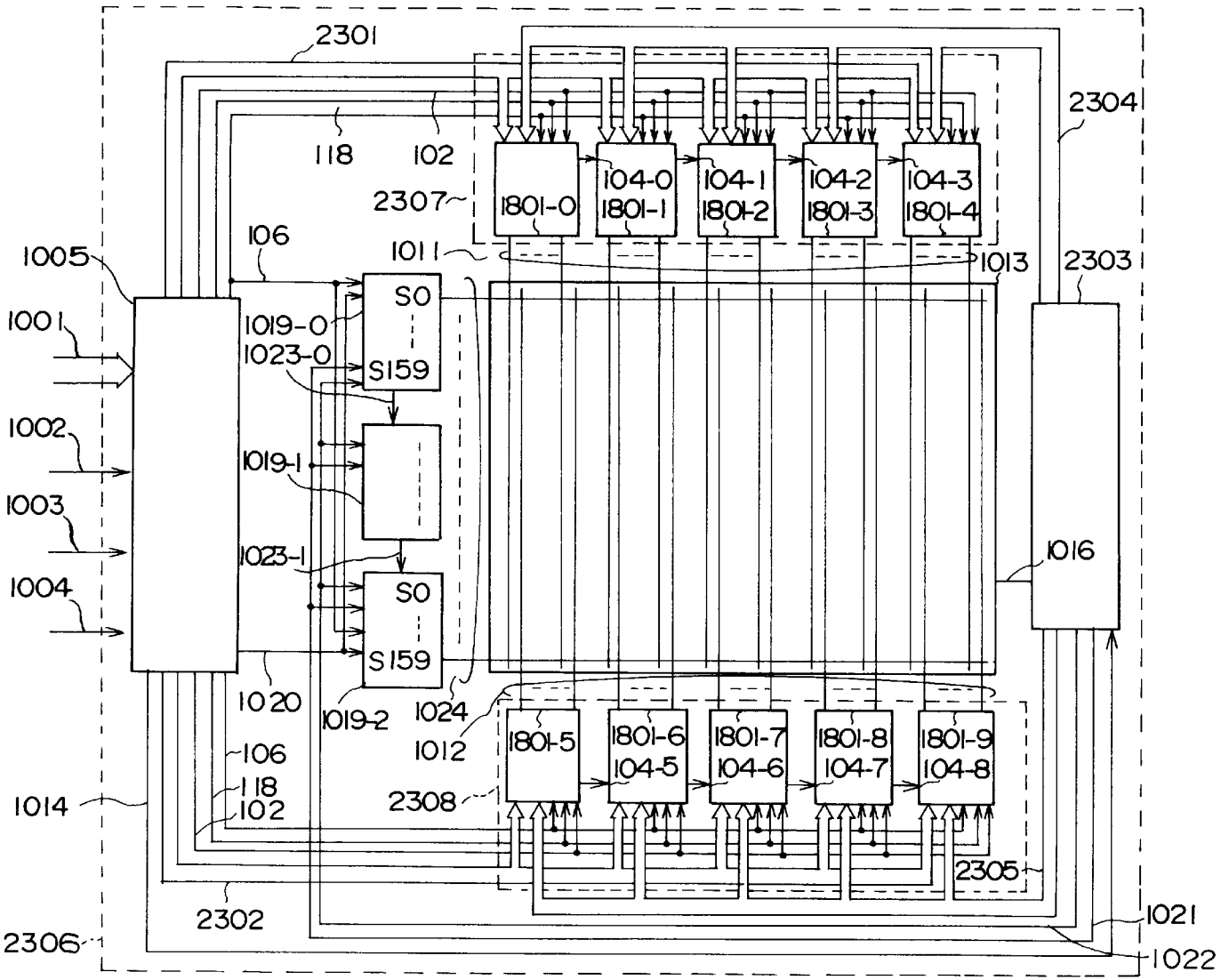
FIG. 23 is an arrangement diagram of a liquid-crystal display system in the eleventh embodiment of the present invention.

A thirteenth embodiment of the present invention will be described with reference to FIG. 23. FIG. 23 shows the configuration of a liquid-crystal display system using the above mentioned X driver circuit.

In the present embodiment, the X driver circuit 1801 used in the ninth embodiment is used in the seventh embodiment.

A reference numeral 2301 denotes an upper group of data bus having 6 bit display data each for R, G and B; 2302 denotes a lower group of data bus having 6 bit display data each for R, G and B; 2303 denotes a power source circuit for liquid-crystal displays; 2304 a voltage bus for upper group; 2305 a voltage bus for lower group; 2306 a liquid-crystal display device; 2307 a board for an upper group of X driver circuit; and 2308 a board for a lower group of X driver circuit.

The upper and lower groups of data buses 2301 and 2302 are connected to 1503, 1504 1505 of the X driver circuits 1801-0 to 1801-9.

The tonal voltages of 9 levels are output from the power source circuit 2303 for liquid-crystal displays to the upper and lower group of voltage buses 2304 and 2305 and supplied to the voltage bus 1810 of the X driver circuit 1801-01 to 1802-9.

An upper group of X driver circuit board 2307 is provided thereon signal lines for the data bus 2301 for the upper group, clocks 102, 118, 106 and a control signal 104 and upper group of voltage bus 2304, which are connected to the X driver circuit 1801 disposed on the upper group of the board.

A lower group of X driver circuit board 2308 is provided thereon with signal lines for the lower group of data bus 2302 for lower group, clocks 102, 118 and 106, control signal 104 and the lower group of voltage bus 2305, which are connected to the X driver circuit 1801.

Operation of the other circuits is similar to that of the seventh embodiment.

The X driver circuits 1801-0 to 1801-9 which are used in the present invention may be replaced with the X driver circuit which has been described in the tenth embodiment.

Figure 24:
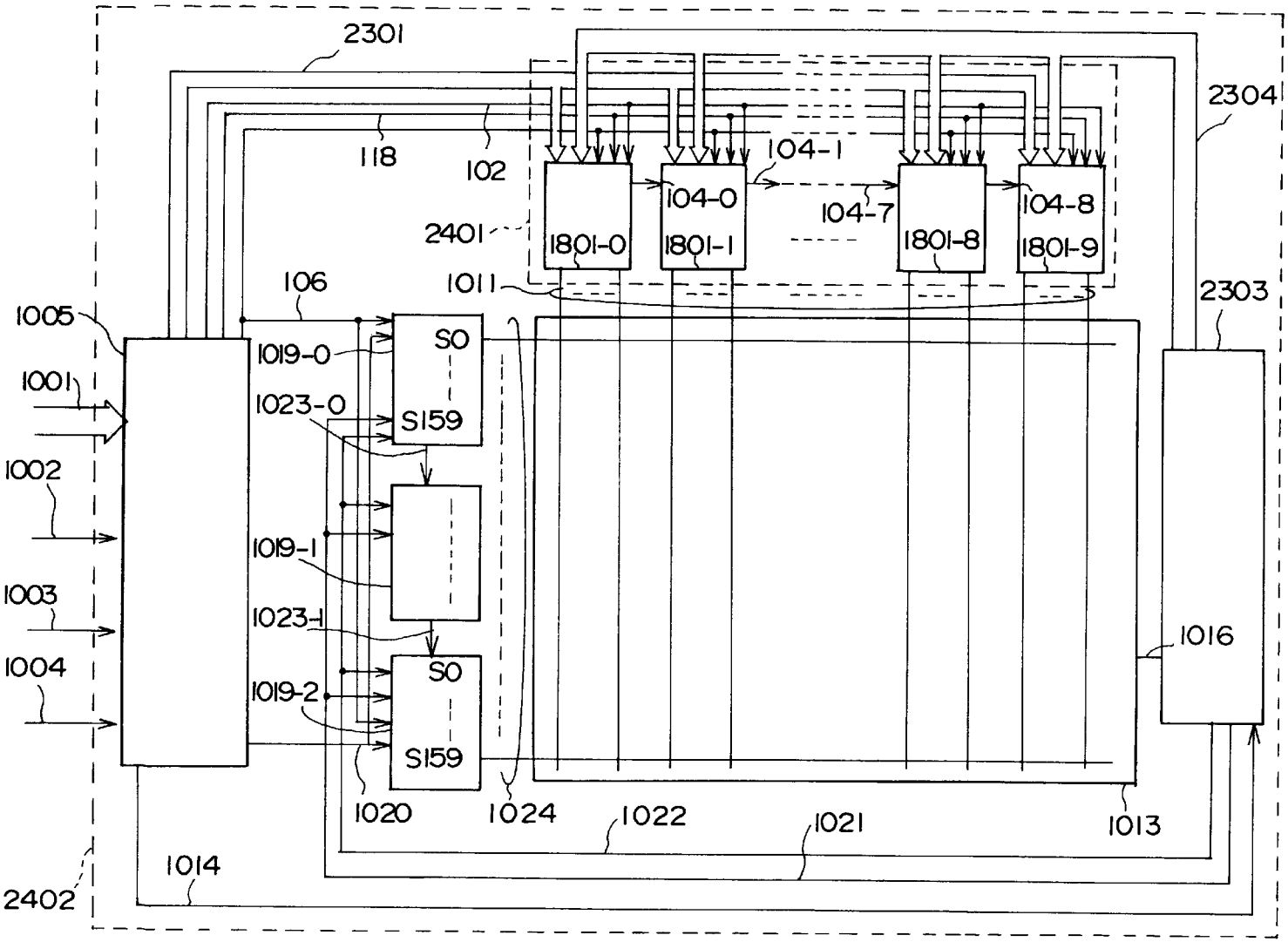
FIG. 24 is an arrangement diagram of a liquid-crystal display system in the twelfth embodiment of the present invention.

A fourteenth embodiment of the present invention will be described with reference to FIG. 24. FIG. 24 is a view showing the layout of a liquid-crystal display device using the above mentioned X driver circuit.

The present embodiment is identical with the thirteen embodiment except that the X driver circuit which has been described in the ninth embodiment is concentratedly disposed on one side of the liquid-crystal panel.

A reference numeral 2401 denotes an upper group of X driver circuit board a liquid-crystal device. Since the X driver circuit 1801 has 192 outputs in the liquid-crystal device, 10 X driver circuits are cascade-connected with each other in order to drive an active matrix type liquid-crystal panel 1012 comprising 1920 pixels by 480 lines.

An upper group of X driver circuit board 2401 is provided with signal lines of data bus 2301 for upper group, clocks 102, 118, 106, control signal 104 and a voltage bus 2304 for upper group, which are connected with 10 X driver circuit 1801 which is disposed on the upper portion of the board.

After the X driver circuit 1801-0 at the first stage has latched 192 data in synchronism with the clock 102, it asserts the control signal 104-0. The control signal 104-0 is input to the X driver circuit 1801-1 at the next stage and the X driver circuit 1801-1 latches 192 data in synchronism with the clock 102. The same operation is repeated until the X driver circuit 1801-9 has latched 192 data. Voltages corresponding to the latched data can be output to pixels of the liquid-crystal panel 1012, which have been asserted.

Operation of the other components is similar to that in the seventh embodiment.

The X driver circuits 1801-0 to 1801-9 used in the present embodiment may be replaced with the X driver circuits which have been described in the first to sixth, tenth to twelfth embodiments.

The liquid-crystal display 2306 which has been described with reference thirteenth embodiment may be used as a display for information processing system by replacing it with the liquid-crystal display 1025 in the eighth embodiment.

The liquid-crystal display 2402 which has been described with reference to the fourteenth embodiment by replacing it with the liquid-crystal display 1025 in the eighth embodiment.

Now, a fifteenth embodiment to generate output voltages for 64 tones in accordance with the present invention will be described with reference to FIGS. 25 to 36.

Figure 25:
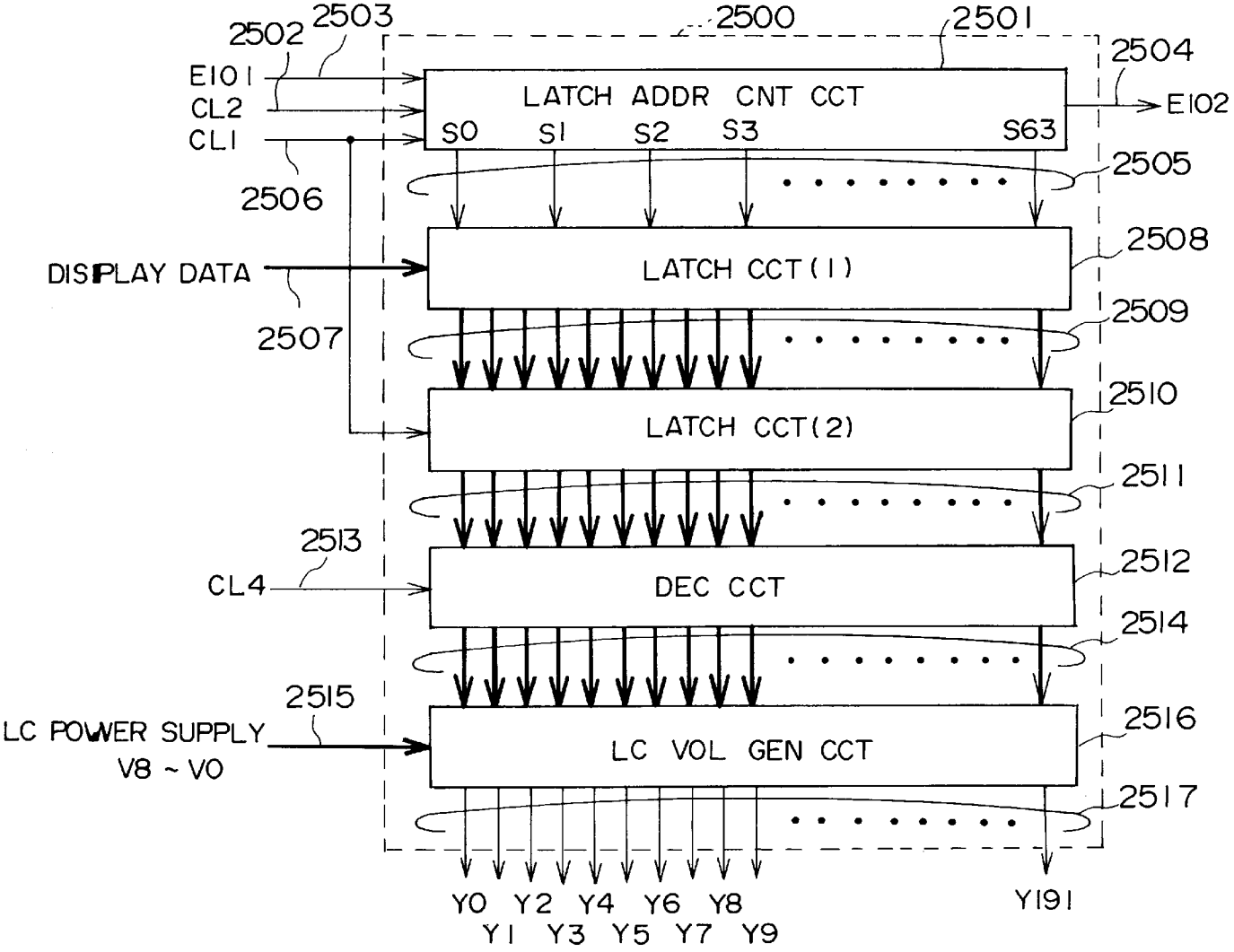
FIG. 25 is a simplified block diagram of a liquid-crystal driving circuit of 192 outputs in the thirteenth embodiment of the present invention.
Figure 26:
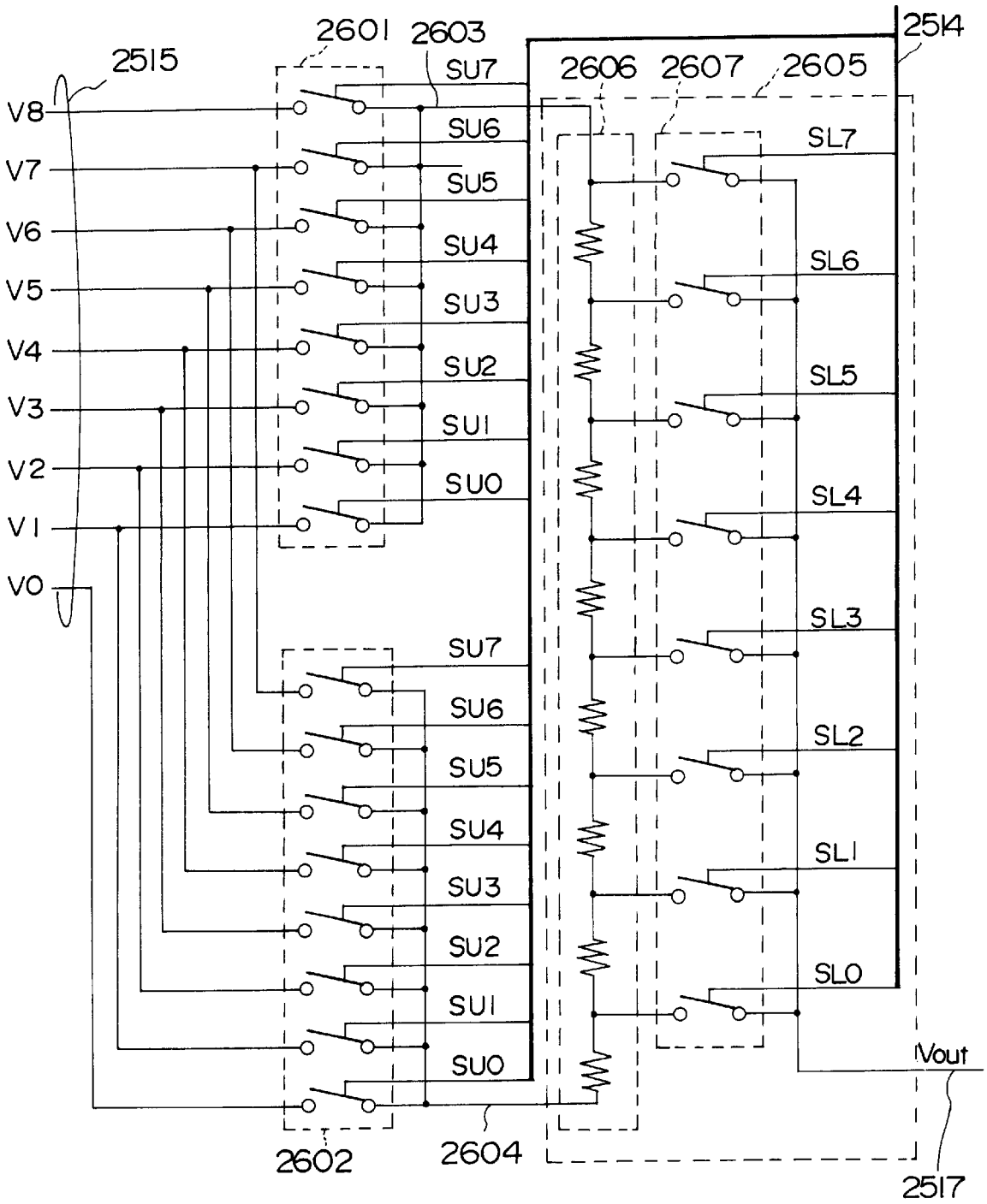
FIG. 26 is a simplified block diagram of a voltage divider circuit in the thirteenth embodiment of the present invention.
Figure 29:
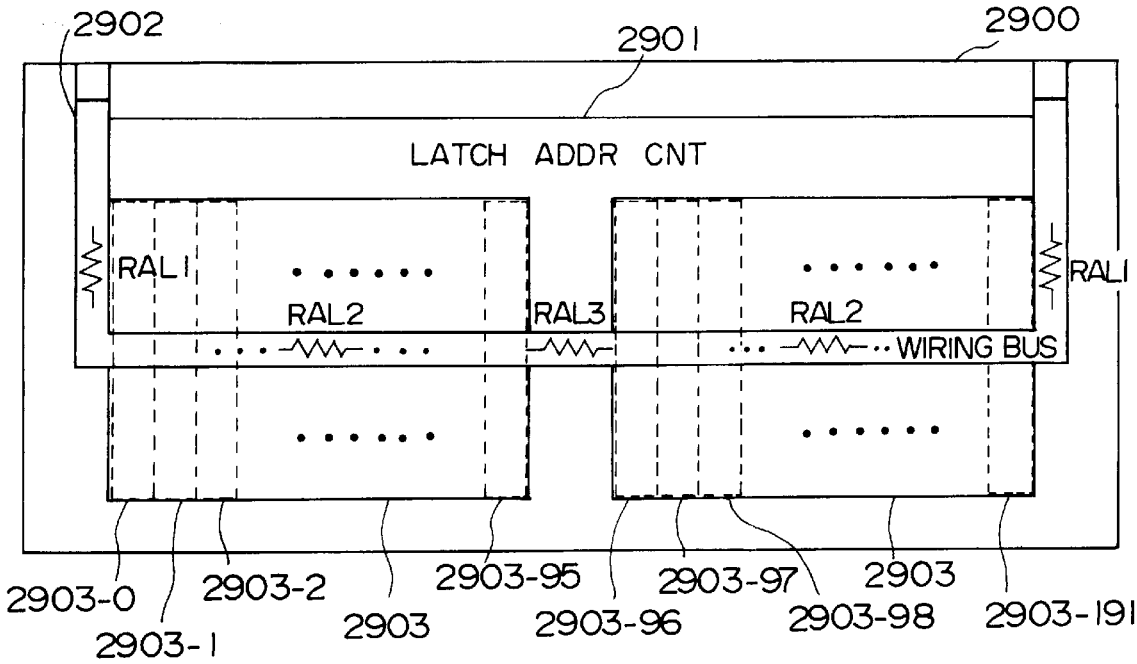
FIG. 29 is a schematic diagram of the chip layout of the liquid-crystal driving circuit of 192 outputs in the thirteenth embodiment of the present invention.
Figure 30:
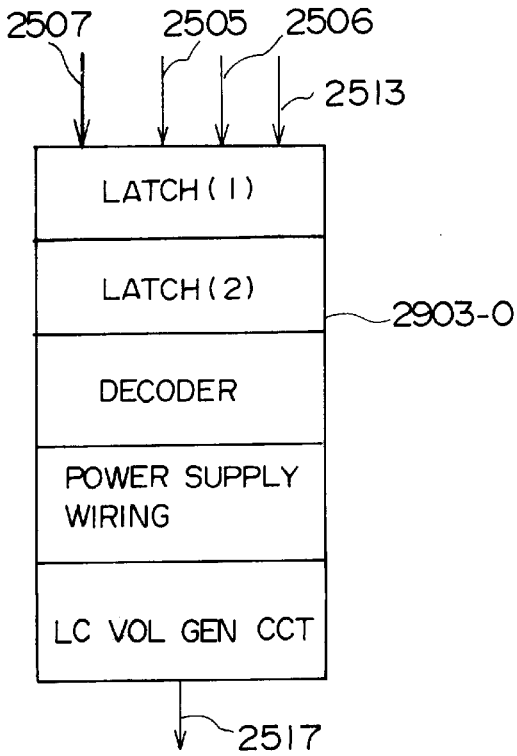
FIG. 30 is a layout diagram of one output system in the thirteenth embodiment of the present invention.
Figure 31:
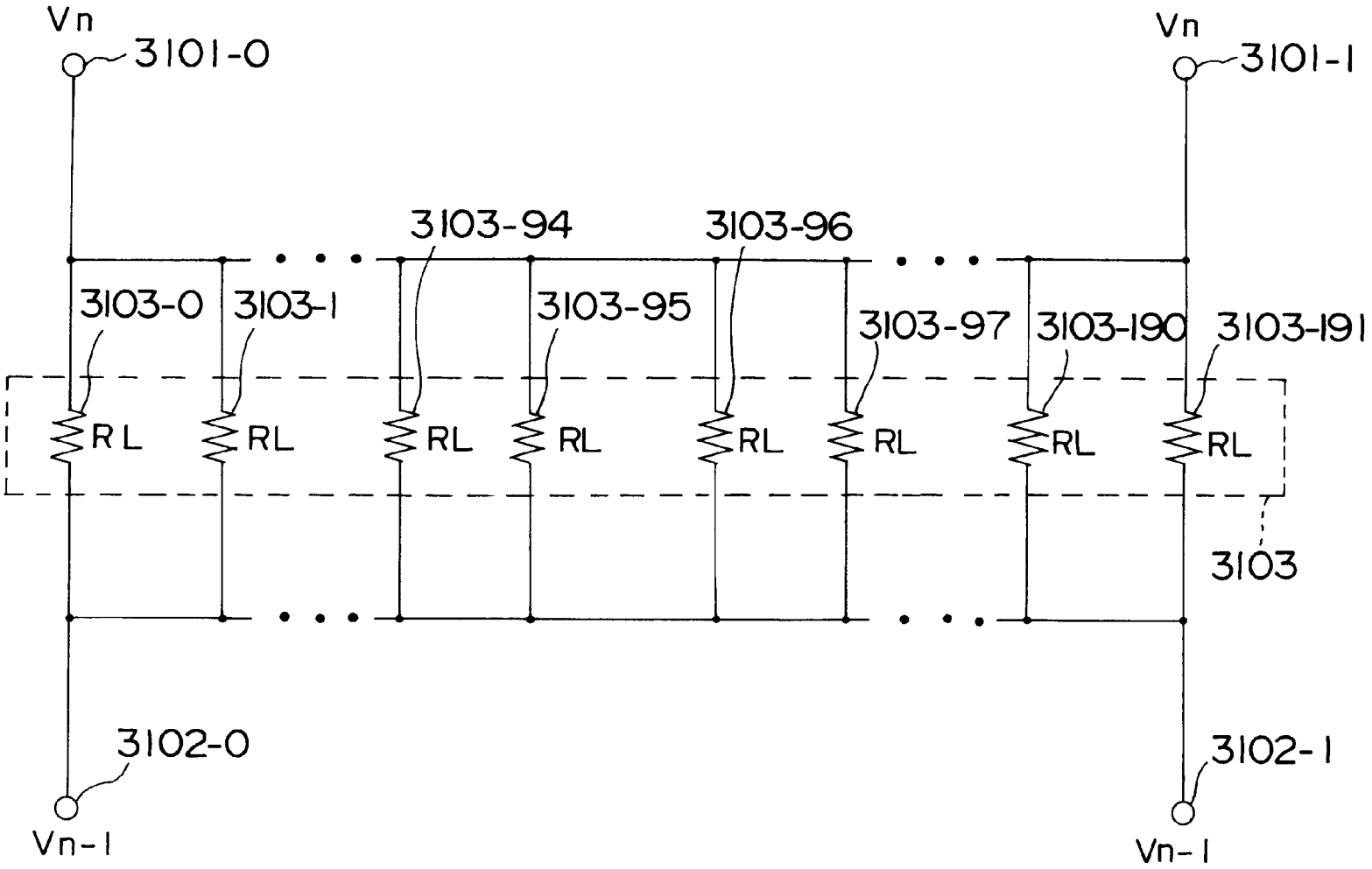
FIG. 31 is a diagram showing the equivalent circuit of a liquid-crystal voltage generator circuit in the thirteenth embodiment of the present invention.
Figure 32:
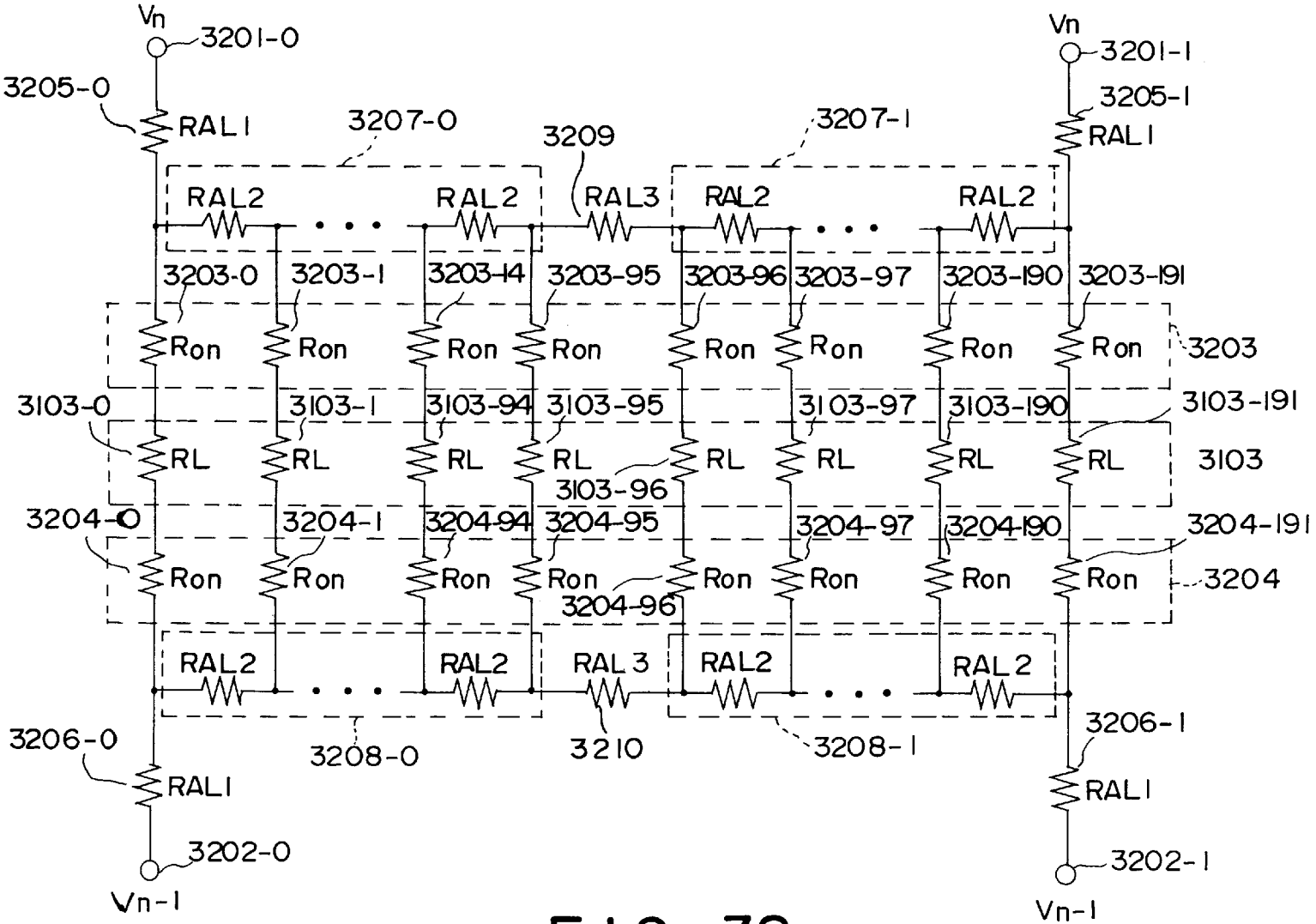
FIG. 32 is a diagram showing the equivalent circuit of a liquid-crystal voltage generator circuit in the thirteenth embodiment of the present invention.
Figure 33:
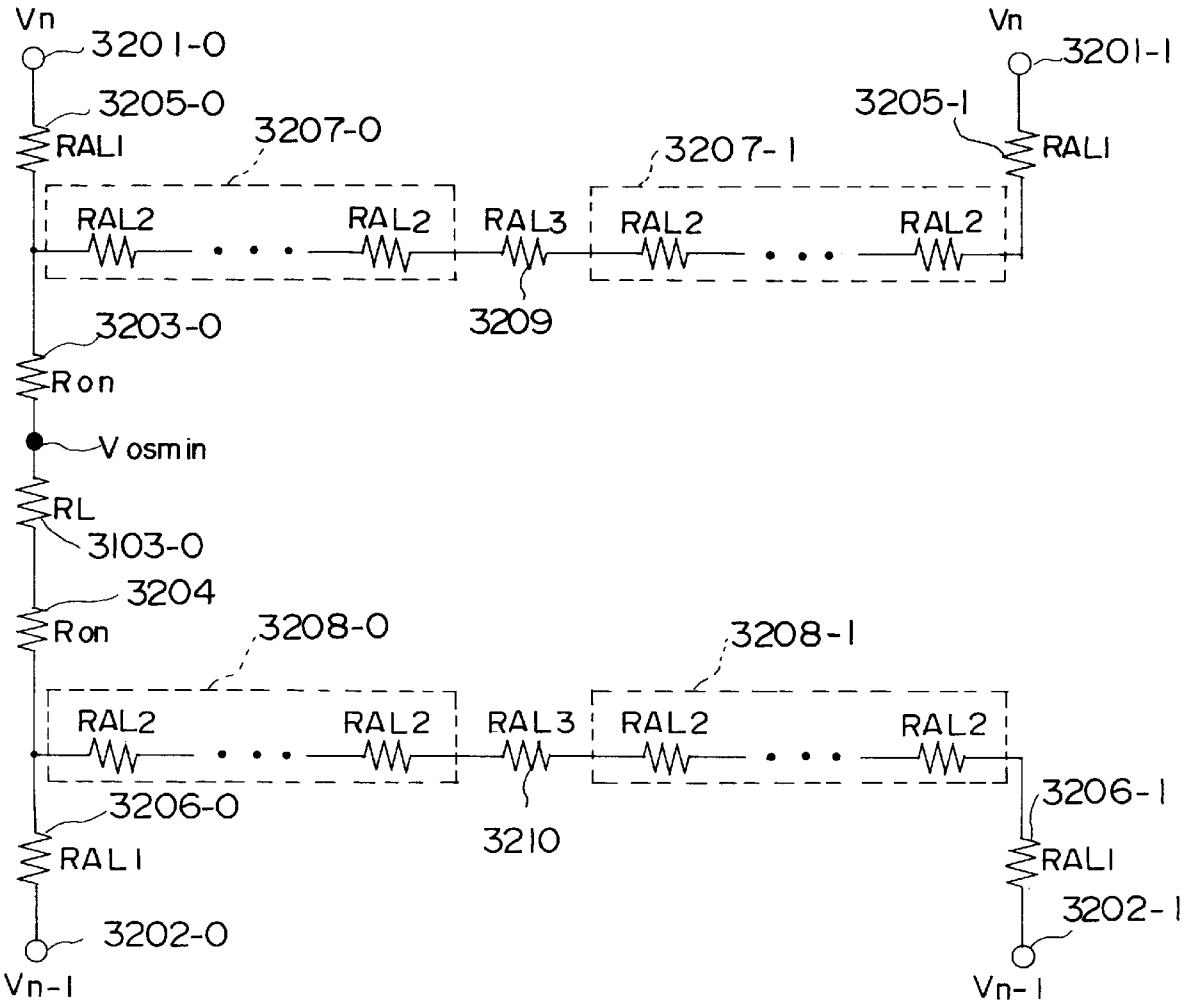
FIG. 33 is a diagram showing the equivalent circuit of a liquid-crystal voltage generator circuit in the thirteenth embodiment of the present invention.
Figure 34:
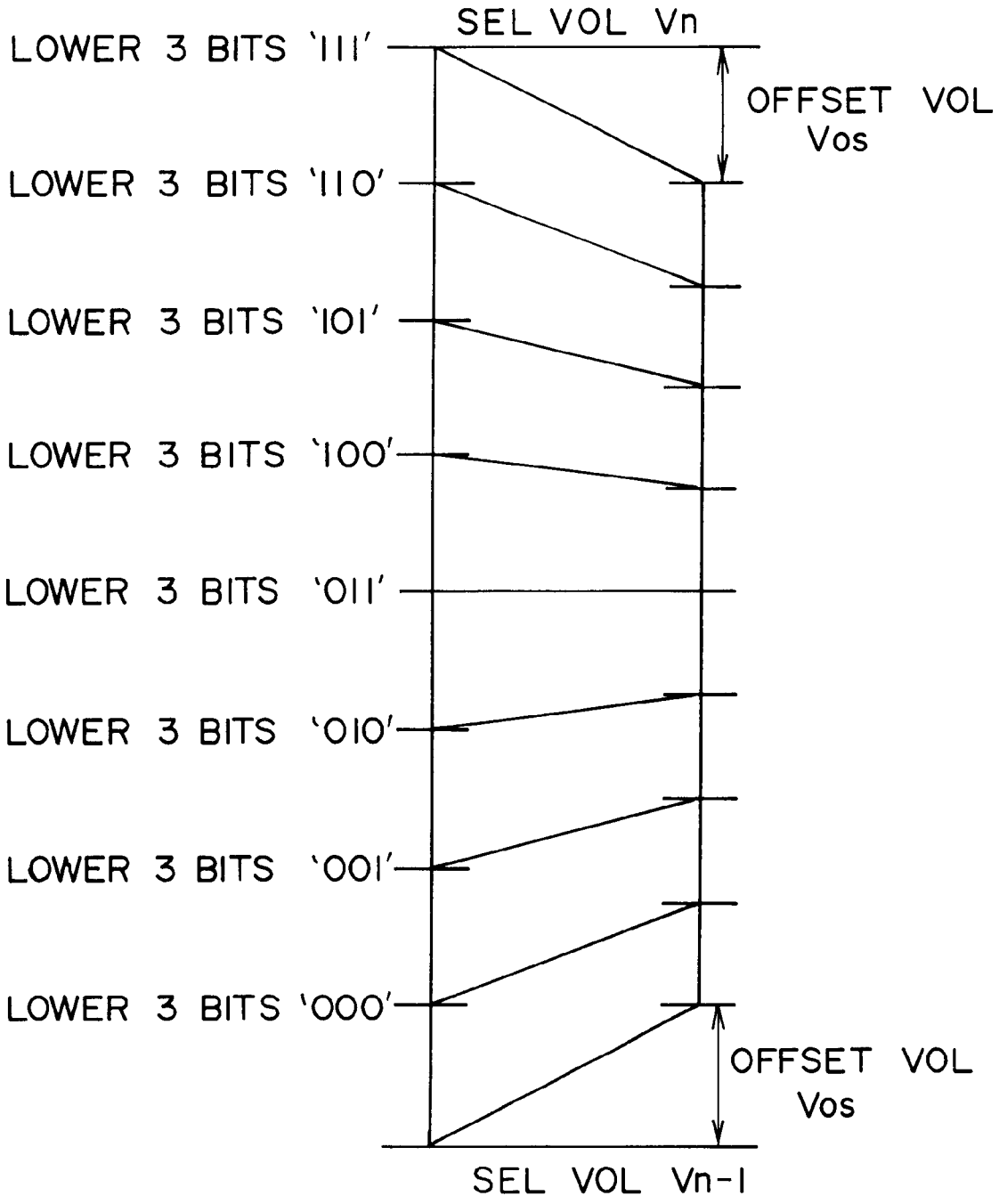
FIG. 34 is a diagram showing offset voltages in the thirteenth embodiment of the present invention.
Figure 35:
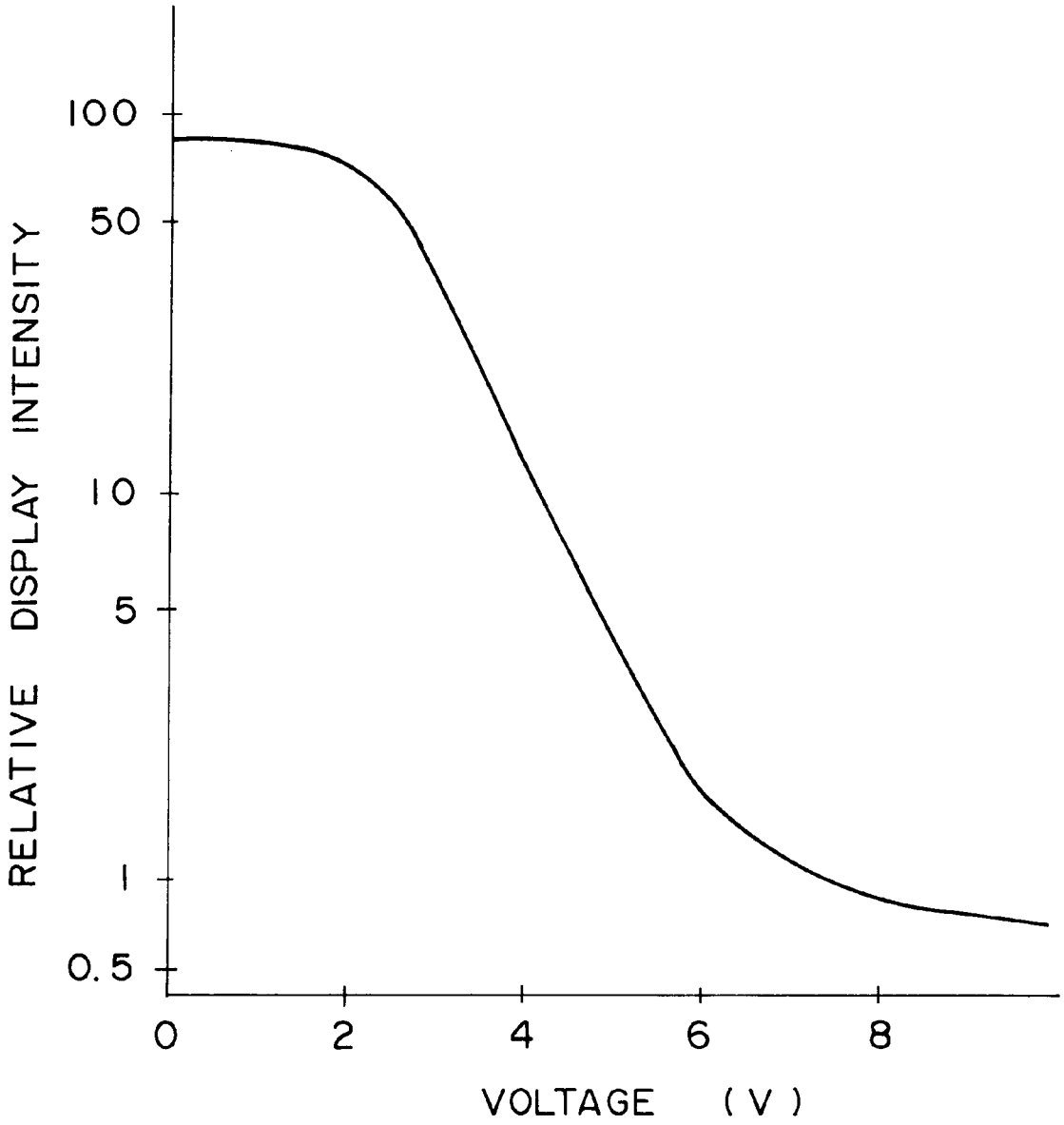
FIG. 35 is a graph showing the intensity-versus-voltage characteristics of a liquid crystal.
Figure 36:
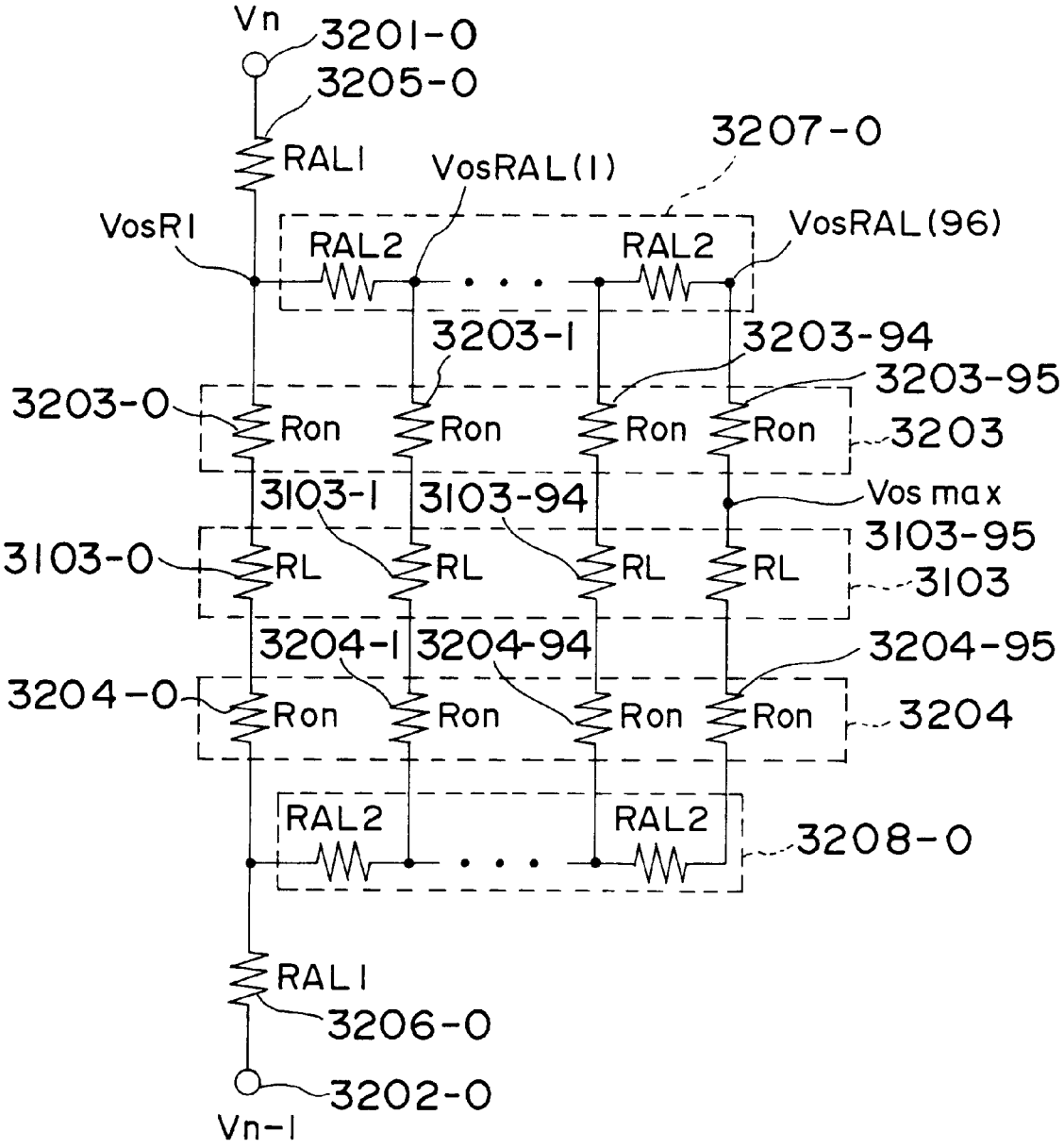
FIG. 36 is a diagram showing the equivalent circuit of a liquid-crystal voltage generator circuit in the thirteenth embodiment of the present invention.
Figure 37:
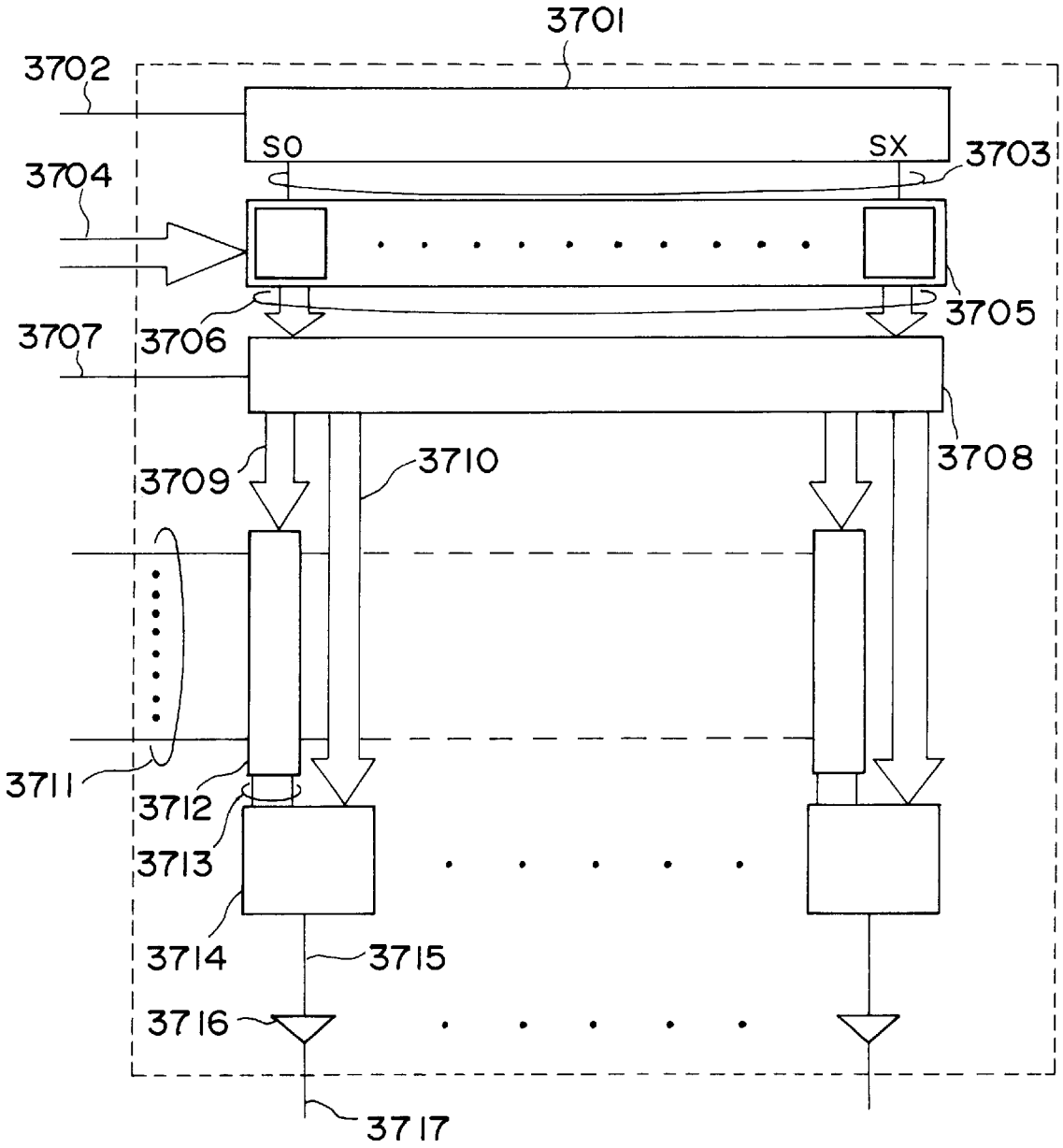
FIG. 37 PRIOR ART
FIG. 37 is a simplified block diagram of a liquid-crystal driving circuit in a prior-art example.
Figure 38:
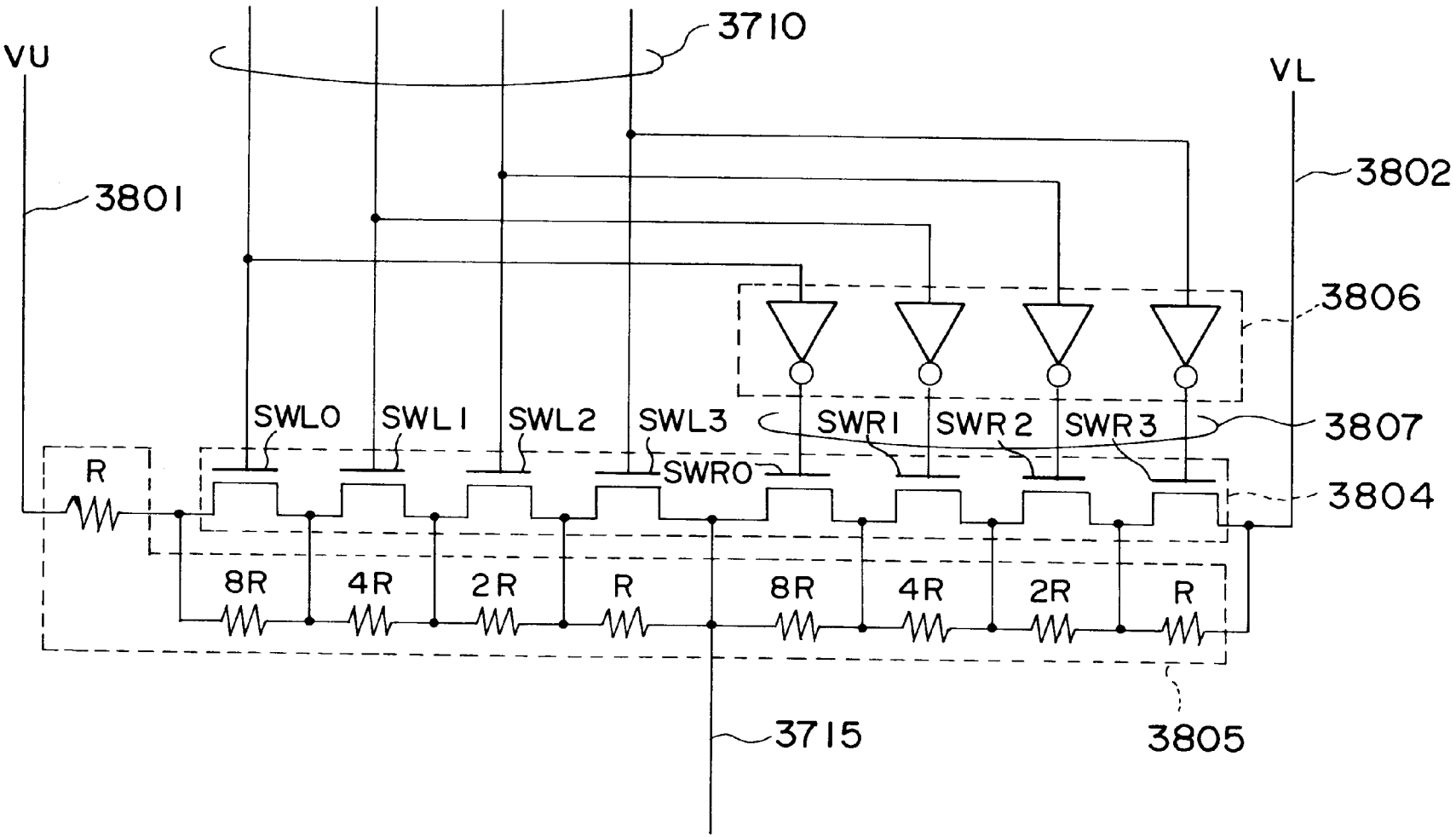
FIG. 38 PRIOR ART
FIG. 38 is a simplified block diagram of a voltage divider circuit in a prior-art example.

FIG. 25 is a block diagram showing a liquid-crystal drive circuit; FIG. 26 is a block diagram showing a liquid-crystal voltage generating circuit for generating voltages for 64 tones to drive a liquid-crystal panel; FIGS. 27 and 28 are truth tables for generating control signals for the voltage divider circuit-switches of a liquid-crystal voltage generating circuit; FIG. 29 is a schematic view showing the layout of the entire of a chip; FIG. 30 is a layout block diagram showing an one output system; FIGS. 31 and 32 are equivalent circuits of liquid crystal voltage generator circuits when the 192 output is selected; FIG. 33 is an equivalent circuit of a liquid-crystal voltage generator circuit when an one output is selected; FIG. 34 shows an offset voltage of output voltage for the liquid crystal; FIG. 35 is a graph showing the intensity-versus voltage characteristics of the liquid crystal; FIG. 36 is a diagram for illustrating part of the equivalent circuit of FIG. 32.

The liquid-crystal driver circuit shown in FIG. 25 has 192 outputs each being capable of outputting voltages for 64 tones. In FIG. 25, a reference numeral 2500 denotes a liquid-crystal driver circuit having 192 outputs; 2501 a latch address control circuit; 2502 a clock; 2503 a control signal representing whether the liquid-crystal driver circuit is asserted or not; 2504 a control circuit fed to the X driver circuit at the subsequent stage; 2505 an output bus from the latch address control circuit 2501; 2506 a latch clock; 2507 a 64 tone 3 pixel (6 bits×3 pixels=18 bits) display data bus which is synchronized with the clock 2502. A reference numeral 2508 a latch circuit for 192 pixels, which successively latches the display data bus 2507; 2509 a latched data bus for 6 bits×192 pixels of each latch circuit 2508; 2510 a latch circuit for 6 bits×192 pixels, which latches the latched data on the latched data bus 2509 at the high level of the latch clock 2506; and 2511 a 6 bits×192 pixels latched data bus of each latch circuit 2510.

When the control signal 2503 is asserted (low level), the latch address control circuit 2501 successively asserts each one of the outputs S0 to S63 of the output bus in synchronism with the rise up of the clock 2502 for one period of the clock 2502. This causes the data on the display data bus 2507 for each 3 bits to be successively latched 64 times to the latch circuit 2508. The data for total 192 pixels are successively latched to the latch circuit 2508 and are output to the latched data bus 2509. The latch address control circuit 2501 asserts the control signal 2504 fed to the liquid-crystal driver circuit when it asserts the output S63. Thereafter, the latch address control circuit 2501 negates the output S63 after one period of the clock 2502. After the latch clock 2506 has been asserted, the latch address control circuit 2501 does not operate until the control signal 2503 is asserted.

The latch circuit 2510 simultaneously latches the latched data on the latched data bus 2509 for 192 pixels in synchronism with the rise-up edge of the latch clock 2506 and outputs the data for 192 pixels to the latched data bus 2511.

A reference numeral 2512 denotes a decoder circuit for 192 outputs for decoding the data on the latched data bus 2511 to generate the voltages for 64 tones for liquid crystal; 2513 denotes a control signal for controlling the low output impedance drive; 2514 a control signal bus for 192 outputs which are decoded by the decoder 2512; 2515 9 liquid-crystal power source busses V8 to V0 for the reference voltages of the 64 tone liquid-crystal voltage; 2516 denotes a liquid-crystal voltage generator circuit for 192 outputs for liquid-crystal voltages of 64 tones from the control signal 2514 and the liquid-crystal power source bus 2515 and 2517 denotes a liquid-crystal voltage output has for 192 liquid-crystal voltage outputs of 64 tones.

The decoder circuit 2512 generates 8 control signals SU0 to SU7 for selecting voltage from upper 3 bits of one output 6 bit latched data of the latched data bus 2511 and 8 control signals SL0 to SL7 for selecting divisional voltage from the remaining lower 3 bits and the control signal 2513. The control signal bus 2514 having 16 signal lines per output is coupled to the liquid-crystal voltage generator circuit 2516 and selects two voltages from 9 lines V8 to V0 of the liquid-crystal power source bus 2515 with 8 control signals SU0 to SU7 and further selects one voltage from the voltages which are obtained by dividing the selected two voltages by 8 with 8 control signals SL0 to SL7 for selecting divisional voltage selecting control and output the selected voltage as the liquid-crystal voltage output bus 2517. Each output of the liquid-crystal voltage output bus 2517 is connected to the liquid-crystal panel so that voltages corresponding to the display data 2507 can be applied to the liquid-crystal elements.

Now, the decoder circuit 2512 and the liquid-crystal voltage generator circuit 2516 will be described in detail with reference to FIGS. 26, 27 and 28.

FIG. 26 is a block diagram showing the liquid-crystal generator circuit for one output. In FIG. 26, reference numerals 2601 and 2602 denote voltage selecting element groups which select two voltages from the liquid-crystal power source bus 2515; 2603 and 2604 voltages which are selected by voltage selecting element groups 2601 and 2602, respectively; 2605 a voltage divider circuit which divides the voltage difference between the selected voltages 2603 and 2604 by 8; 2606 a voltage dividing resistor element group; and 2607 a voltage selecting element group which selects the voltages equally divided by 8 in the voltage divider 2606.

FIG. 27 is a truth table of the control signals SU0 to SU7 for selecting voltage which are generated by upper 3 bits of the 6 bits of the latched data. FIG. 28 is a truth table of 8 control signals SL0 to SL7 for selecting divisional voltage which are generated by decoding the lower 3 bits of the output 3 bits of the latched data 2511 and the control signal 2513.

Operation of the liquid-crystal voltage generator circuit of one output will be described. Description will be made by assuming the relation between the voltages of the liquid-crystal power source bus 2515 as follows:

$$V8>V7>V6>V5>V4>V3>V2>V1>V0$$

Respective ones of the group of voltage selecting element on a higher potential side 2601 and the group of voltage selecting element on the lower potential side are brought conductive in response to the control signal bus 2514 for outputting selected voltages 2603 and 2604 on the higher and lower potential sides, respectively. As shown in FIG. 27, among the control signal bus 2514, a reference symbol SU0 denotes a control signal which is asserted (at high level) when the upper 3 bit latched data on the display data is "000"; SU1 denotes a control signal which is asserted (at high level) when the upper 3 bits on the display data is "001"; SU2 denotes a control signal which is asserted (at high level) when the upper 3 bits on the display data is "010"; SU3 denotes a control signal when the upper 3 bits on the display data is "011"; SU4 denotes a control signal which is asserted (high level) when the upper 3 bits on the display data are "100"; SU5 denotes a control signal which is asserted (high level) when the upper 3 bits on the display data are "101"; SU6 denotes a control signal which is asserted (high level) when the upper 3 bits on the display data are "110"; and SU7 denotes a control signal which is asserted (high level) when the upper 3 bits on the display data are "111". In other words, when SU0 is asserted, V1 and V0 are selected as selected voltages 2603 and 2604, respectively, and when SU1 is asserted, V2 and V1 are selected as selected voltages 2603 and 2604, respectively. Hereafter a voltage corresponding to the decoded value and a voltage which is higher by one level are selected, similarly.

The selected voltages 2603 and 2604 are output to the voltage divider circuit 2605. The voltage divider circuit 2605 causes the group of voltage selecting elements 2607 to select one level from the 8 divided voltages including a potential of the selected voltage 2603, which are divided by the voltage dividing resister element group 2606 in accordance with the control signal 2513 for selecting divisional voltage and output the selected voltage to the liquid-crystal voltage output bus 2517. When the control signal 2513 is "1", the control signal SL7 is asserted "high level" irrespectively of the value of the latched data 2511 as shown in FIG. 28 to perform low impedance drive in which two voltage selecting resistors are connected in series. In other words, high speed writing on a liquid-crystal panel is carried out by applying selected voltage 2603 on the higher potential side only via 2 voltage-selecting elements having low resistances on conductive without via voltage dividing resistors at a low impedance. The control signal 2513 rises up in synchronism with the rise-up of the latch clock 2506 to perform low impedance driving.

When the control signal 2513 falls to become "0", control signals SL0 to SL7 are obtained on the divided voltage selecting control signal bus 2513. Reference symbol SL0 denotes a control signal which is asserted (high level) when the lower 3 bit latched data of the display data is "000", SL1 denotes a control signal which is asserted (high level) when the lower 3 bit latched data of the display data is "001"; SL2 denotes a control signal which is asserted (high level) when the lower 3 bit latched data of the display data is "010"; SL3 denotes a control signal which is asserted (high level) when the lower 3 bit latched data of the display data is "011"; SL4 denotes a control signal which is asserted (high level) when the lower 3 bit latched data of the display data is "100"; SL5 denotes a control signal which is asserted (high level) when the lower 3 bit latched data is "101"; SL6 denotes a control signal which is asserted when the lower 3 bit latched data of the display data is "110"; and SL7 denotes a control signal which is asserted (high level) when the lower 3 bit latched data of the display data is "111".

The group of voltage selecting elements 2607 selects a first high potential on the low potential side from among voltages which are obtained by equally dividing by 8 a potential difference between the selected voltages 2603 and 2604 when SL0 is asserted and selects a second higher potential on the lower potential side from among the voltages which are obtained by equally dividing by 8 a potential difference between the selected voltages 2603 and 2604 when SL1 is asserted. Similar operation is repeated hereafter. One of 8 levels of voltages including the voltages which are obtained by equally dividing the voltage difference between the selected voltages 2603 and 2604; and the selected voltage 2603.

Such a circuit configuration enables the liquid-crystal voltage generator circuit 2515 to generate voltages for 64 tones (=8 sets of selected voltages×8 divisional voltages) so that voltages corresponding to 6 bit display data are output. In other words, during a period of time while the control signal 2513 which rises up in synchronism with the rise-up of the latch clock 2506 is "1", high speed writing on the liquid-crystal panel the selected voltage on the higher potential side which is selected with the upper 3 bits of the display data from among liquid-crystal power source voltages V0 to V8 is conducted by low impedance driving and during a period of time while the control signal 2513 is "0", writing on the liquid-crystal panel is conducted by high impedance driving via voltage dividing resistors of a liquid-crystal voltage corresponding to display data among 64 tonal voltages.

Operation of the present invention will be described in detail with reference to FIGS. 25 through 28. The latch circuit 2508 successively latches the display data on the display data bus 2507 in accordance with the output bus 2505 of the latch address control circuit 2501 and outputs the latched data to the latched data bus 2509. If the display data to be latched by the latch circuit 2508 is represented as "110100" from the upper bit, the data on the latched data bus 2509 is then represented as "110100". Thereafter, the latch circuit 2510 latches the data on the latched data bus 2509 in synchronism with the rise up of the latch clock 2506 to output it to the latched data bus 2511. The latched data on the latched data bus 2511 is input to the decoder circuit 2512. The upper and lower 3 bits are decoded in accordance with truth tables shown in FIGS. 27 and 28, respectively. As a result, the control line SL7 of the control signal for selecting divisional voltage is asserted for a period of time of the low impedance driving in which the voltage selecting control signal SU6 and the control signal 2513 is "1" and the control line SL4 of the control signal for selecting divisional voltage is asserted for a period of time of the high impedance driving in which the control signal 2513 is "0".

Now, operation of the liquid-crystal voltage generator circuit 2516 will be described with reference to FIG. 26. Since the voltage selecting control signal SU6 is asserted, the groups higher and lower potential sides voltage selecting elements 2601 and 2602 output voltages V7 and V6 to the selected voltages 2603 and 2604 to input them to the voltage divider circuit 2605, respectively. On the other hand, since the control line SL7 of the divided voltage selecting control signal is asserted for a period of time of the low impedance driving in which the control signal 2513 is "1", the selection element with which the divided voltage selecting control signal SL4 is connected brought into becomes a conductive state in the group of voltage selecting elements 2606, the liquid-crystal voltage output bus 2517 becomes as follows:

$$Yn=V7(n=0, 1, 2, \ldots, 191)$$

Since the divided voltage selecting control signal SL4 is asserted for a period of time of the high impedance driving in which the control signal 2513 is "0", the selection element with which the divided voltage selecting control signal SL4 is brought into a conductive state. If the group of voltage dividing resistor element 2606 equally divides each voltage level; the liquid-crystal voltage output bus 2517 becomes as follows:

$$Yn=V6+(V7-VG)\times 5/8 (n=0, 1, 2, \ldots, 191)$$

Eight combinations of the selected voltages 2603 and 2604 are possible by the upper 3 bits of the display data (refer to FIG. 27). Since one of the voltages which are obtained by dividing the selected voltages 2603 and 2604 by 8 can be selected by the lower 3 bits of the display data, voltages for 64 tones (8 combinations×8 divided voltages) corresponding to the display data can be generated.

However, wiring resistances, resistances of the on-state selection elements conductive and variations in elements are not considered in the foregoing description of the liquid-crystal voltage generation. An offset voltage is generated in the liquid crystal voltage output in actual circuits. Since amplitude and variations of the offset voltage will give an influence to the display quality of the liquid-crystal panel, it is necessary to consider the offset voltage.

The offset voltage in the circuit scheme in the present embodiment in which the wiring resistances, the resistances of the on-state selecting elements conductive and variations in elements are considered with reference to FIGS. 29 to 36.

FIG. 29 is a schematic view showing the layout of an entire of a chip; FIG. 30 is a view showing the layout of an one output system; FIG. 31 is an equivalent circuit diagram of a liquid-crystal voltage generator circuit in which the wiring resistances and the ON-resistances of the selecting elements are not considered; FIGS. 32 and 33 are equivalent circuit diagrams of liquid-crystal voltage generator circuits in which wiring resistances and the ON-resistances of the selecting resistors are considered. FIG. 34 shows an offset voltage; FIG. 35 is a graph showing the intensity-versus-voltage characteristics and of a liquid crystal.

In FIG. 29, a reference numeral 2900 denotes an IC chip of a liquid-crystal drive circuit; 2901 denotes a layout area of a latch address control unit; 2902 denotes a layout area of a power source wiring bus of a liquid-crystal power source; 2903 denotes a layout area including the latch circuit 2505, the latch circuit 2510, the decoder circuit 2512, and the liquid-crystal voltage generator circuit 2516 shown in FIG. 25; reference numerals 2903-0 to 2903-191 denote layout areas for one output. FIG. 30 shows the detail of the layout area 2903-0 which is equivalent to those 2903-1 to 2903-191. In the present embodiment in order to decrease the offset voltage caused by the wiring resistances of the power source wiring, a liquid-crystal drive power is supplied from the input terminals in two positions. The latch circuit 2505, the latch circuit 2510, the decoder circuit 2512 and the liquid-crystal voltage generator circuit 2516 having a constant data flow are arranged together and without the latch address controlling circuit for controlling the latch circuit 2508 for each output. This provide a layout which is efficient along the flow of wiring to reduce the chip area.

Accordingly, the equivalent circuits of the liquid-crystal voltage generator circuit from the input terminals to the output terminals in a IC chip are shown in FIGS. 31, 32 and 33.

FIG. 31 is an equivalent circuit diagram showing a case in which 192 outputs are selected for one set of selected voltages. Reference numerals 3101-0 and 3101-1 denote input terminals in two positions for one of two selected voltages of the liquid-crystal power sources V0 to V8; 3102-0 and 3102-1 denote selected voltages in two positions for the other selected voltage; 3103-0 to 3103-191 denote the group of voltage dividing resistor elements 2606 including 8 resistor elements in FIG. 26 which are generally designated as a voltage dividing resistor RL; and 3103 denotes a group of voltage dividing registers for 192 dividing resistors.

FIG. 32 is an equivalent circuit diagram showing a case in which 192 output are selected for one set of selected voltages. Reference numerals 3201-0 and 3201-1 denote input terminals in 2 positions of one of 2 selected voltages of the liquid-crystal power sources V0 to V8; 3202-0 and 3202-1 denote the selected voltages in 2 positions of the other selected voltage. Reference numerals 3203-0 to 3203-191 denote ON-resistances of the selected elements of the group of voltage selecting elements 2601 in FIG. 26; 3204-0 to 3204-191 denote ON-resistances of the selected elements of the voltage selecting element group 2602; 3203 and 3204 denote resistor groups; 3205-0 denotes a wiring resistance from the input terminal 3201-0 to the layout area 2903; 3205-1 denotes a wiring resistance from the input terminal 3201-1 to the layout area 2903; 3206-0 denotes a wiring resistance form the input terminal 3203-0 to the layout area 2903; 3206-1 a wiring resistance from the input terminal 3202-1 to the layout area 2903; 3207-0 a wiring resistance of power source line from the layout areas 2903-0 to 2903-95; 3207-1 a wiring resistance of the power source line from the layout areas 2903-96 to 2093-191; 3208-0 a wiring resistance of the power source line from the layout areas 2903-0 to 2903-95; 3208-1 a wiring resistance of the power supply line from the layout areas 2903-96 to 2903-191; and 3209 and 3210 denote wiring resistances of power source line between two layout areas 2903.

FIG. 33 is a diagram showing an equivalent circuit in which one output is selected while FIG. 32 is diagram showing an equivalent circuit in which 192 outputs are selected among one set of selected voltages. RAL2 denotes a wiring resistance of the power source line in each of the layout areas 2903-0 to 2903-191. In such a manner, the selected voltage varies and the number of the selections of output in the selected voltage varies from 1 to 192 depending upon the display data.

Now, the magnitude of the offset voltage is determined from the equivalent circuit. As shown in FIG. 34, the voltages across the voltage dividing resistors 3103-0 to 3103-191 of each output are voltage at input terminals Vn and Vn−1 in the equivalent circuit shown in FIG. 31. Accordingly, the offset voltage Vos is zero if there is no variations in resistances of 8 resistor elements of the group of resistor elements 3103. In contrast to this, the voltages across the voltage dividing resistors 3103-0 to 3103-191 at each output are different from the voltages at input terminals Vn and Vn−1 by an offset voltage Vos caused by the on-state resistances of the wiring resistors and selecting elements. The magnitude of the offset voltage maximizes when 192 outputs in a set of selected voltages shown in FIG. 32 are selected and minimizes when one output in a set of selected voltages shown in FIG. 33 is selected.

Since the liquid-crystal application voltage has characteristics that the intensity differs with different voltages. This is a problem that the difference in brightness is visible depending upon the voltage difference between pins due to variations in offset voltage in the liquid-crystal driver circuit. This provides an adverse display quality. The variation in the offset voltage is defined as follows:

$$\Delta Vos=|Vosmax-Vosmin|$$

Specifically, the difference between the maximum and minimum values Vosmax and Vosmin of the offset voltage is defined as the offset voltage variation ΔVos. The present embodiment aims at suppressing the variations in offset voltages within such a range that the difference in intensity is invisible to human eyes.

The maximum value of the offset voltage Vosmax will be described with reference to FIGS. 32 and 36. The maximum value of the offset voltage are measures at the both ends of the voltage dividing resistors 3103-95 and 3103-96 where the length of the power source wiring is largest so that the resistance of wiring maximizes when 192 outputs are selected in a set of selected voltages: similarly to FIG. 32. Since the right and left sides liquid-crystal voltage circuit are symmetrical with each other in FIG. 32, the offset voltage will be consider in a left half of the equivalent circuit. FIG. 36 is a view showing a left half of the equivalent circuit in FIG. 32. The maximum value of the offset voltage Vosmax at the both ends of the voltage dividing resistor 3103-95 is calculated.

The offset voltage maximizes when RL minimizes and Ron, RAL1 and RAL2 maximize. If the coefficients of the element variations are represented as ARonmax, ARLmin, ARAL1max and ARAL2max, the relations are established as follows:

Ronmax=Ron·A Ronmax

RLmin=RL·A RLmin

RAL1max=RAL1·ARAL1max

RAL2max=RAL2·ARAL2max

If the resultant resistance of a rudder circuit comprising RAL2, Ron and RL between the wiring resistors 3205-0 and 3206-0 is represented as R1, the offset voltage which is generated between the wiring resistors 3205-0 and 3206-0 is represented as VosR1.

If ΔV=|Vn−Vn−1|, the offset voltage VosR1 is represented as follows:

$$VosR1 = \Delta V \frac{RAL1max}{2 \cdot RAL1max + R1} \quad \text{(Eq. 3)}$$

If the resultant resistance of the circuit of the right side of the ON-resistor 3203-1, the voltage dividing resistor 3103-1, the ON-resistor 3204-1 is represented as R(1), the offset voltage VosRAL(1) at point VosRAL (1) in FIG. 36 is represented as follows:

$$VosRAL(1) = \frac{(\Delta V - 2 \cdot VosR1)RAL2max}{\frac{(2 \cdot Ronmax + RLmin)R(1)}{2 \cdot Ronmax + RLmin + R(1)} + 2 \cdot RAL2max} + VosR1 \quad \text{(Eq. 4)}$$

Similarly, Vos RAL(2) is represented as follows:

$$VosRAL(2) = \frac{(\Delta V - 2 \cdot VosRAL(1))RAL2max}{\frac{(2 \cdot Ronmax + RLmin)R(2)}{2 \cdot Ronmax + RLmin + R(2)} + 2 \cdot RAL2max} + VosRAL(1) \quad \text{(Eq. 5)}$$

$$\vdots$$

$$VosRAL(96) = \frac{(\Delta V - 2 \cdot VosRAL(95))RAL2max}{2 \cdot Ronmax + RLmin + 2 \cdot RAL2max} + VosRAL(95)$$

Therefore, the maximum value of the offset voltage Vosmax is determined as follows:

$$Vosmax = \frac{(\Delta V - 2 \cdot VosRAL(96))Ronmax}{2 \cdot Ronmax + RLmin} + VosRAL(96) \quad \text{(Eq. 6)}$$

The minimum value Vosmin of the offset voltage will be described with reference to FIG. 33. The minimum value of the offset voltage is measured at the both ends of the voltage dividing resistor 3103-0 in which the resistance of wiring of the power source minimizes when only one output is selected in a set of selected voltages. The minimum value Vosmin of the offset voltage is determined as follows:

The offset voltages minimizes when RL maximizes, Ron, RAL 1, RAL 2 and RAL 3 minimize. The coefficients of the element variations at this time are represented as ARALmax, ARonmin, ARAL1min, ARAL2min, ARAL3min, respectively.

The following relations are established.

Ronmin=Ron·ARonmin

RLmax=RL·ARLmax

RAL1min=RAL1·ARAL1min

RAL2min=RAL2·ARAL2min

RAL3min=RAL3·ARAL3min

If ΔV=|Vn−Vn−1|, the minimum value Vosmin of the offset voltage which is generated at point Vosmin due to the resultant resistance of a rudder circuit including RAL 1, RAL 2, RAL 3, Ron and RL is determined as follows:

$$Vosmin = \Delta V\left(\frac{(RAL1min + 192 \cdot RAL2min + RAL3min)RAL1min}{2 \cdot RAL1min + 192 \cdot RAL2min + RAL3min} + Ronmin\right) \div \left(2(RAL1min + 192 \cdot RAL2min + RAL3min) RAL1\frac{\min}{2 \cdot RAL1min + 192 \cdot RAL2min + RAL3min} + 2 \cdot Ronmin + RLmax\right) \quad \text{(Eq. 7)}$$

Accordingly, the variation in offset voltage ΔVos can be determined from the difference between the maximum value of the offset voltage Vosmax and the minimum value of the offset voltage Vosmin.

As determined in the foregoing, the variation in the offset voltage is proportional to the potential difference in selected voltage ΔV=|Vn−Vn−1 and can be determined as a function of parameters such as the wiring resistances RAL 1, RAL 2, RAL 3 and the ON-resistance of the selecting element Ron and the voltage dividing resister RL.

Therefore, it is possible to control the variation in the offset voltage to fall within a range in which the difference in intensity is invisible to human eyes by changing the parameters in consideration of the writing characteristics on a liquid-crystal panel and the chip area.

FIG. 35 is a graph showing the intensity-versus-voltage characteristics on a general liquid crystal, abscissa and ordinate representing voltage applied to the liquid crystal and relative intensity in logarithmic scale, respectively. As shown in the drawing, the intensity of the liquid crystal has no linear relationship with voltage. Accordingly, the tonal voltages are not preset at equal spaces at each voltage. The voltages of the liquid-crystal power sources V0 to V8 are not preset at equal spaces.

If the liquid crystal is driven by an output buffer, the offset voltage depends upon the performances of the output buffer circuit and is constant irrespective of the selected voltage. Since the magnitude of the offset voltage is proportional to the difference between 2 selected voltages 2603 and 2604, it is possible to provide a low offset voltage even in a position where a high precision of the offset voltage is required, the difference between the selected voltages and the difference between the tonal voltages are low.

The selecting elements and resistor elements of the liquid crystal voltage generating circuit shown in FIG. 26 has a service voltage range which is equal to the power supply voltage range of the present liquid-crystal driver circuit, the liquid-crystal power source voltage 2515 can be freely preset within the range of the power source voltage of the present liquid-crystal driver circuit.

In accordance with the present embodiment, the 64 tone liquid-crystal voltages corresponding to the display data can be written into a liquid-crystal panel at a high speed by low and high impedance driving so that the variation in the offset voltage can be controlled within such a range that the difference in intensity is invisible to human eyes.

Although the present embodiment in which the tones are 64 in number and the outputs are 192 in number has been described, the present invention can easily cope with even a case in which the tones and outputs are different in number.

If it is assumed that the number of the externally input voltages is 17 in case of 256 tones, the display data would be 8 bits. Accordingly, the present invention can cope with the 256 tones configuration by making the latch circuit and data bus of 8 bits and providing the decoder circuit so that it can deal with 256 tonal voltages (=16 sets of voltages×16 divisional voltages). If the number of the outputs is 120, the latch address control circuit is configured to latch 3 pixels corresponding to 120 outputs 40 times and the latch circuit, the decoder circuit and the liquid-crystal voltage generating circuit are configured to have 120 outputs and the variation in offset voltage can be similarly controlled by providing the equivalent circuit of the liquid-crystal voltage generator circuit having 120 output and by changing the parameters of elements.

Figure 39:
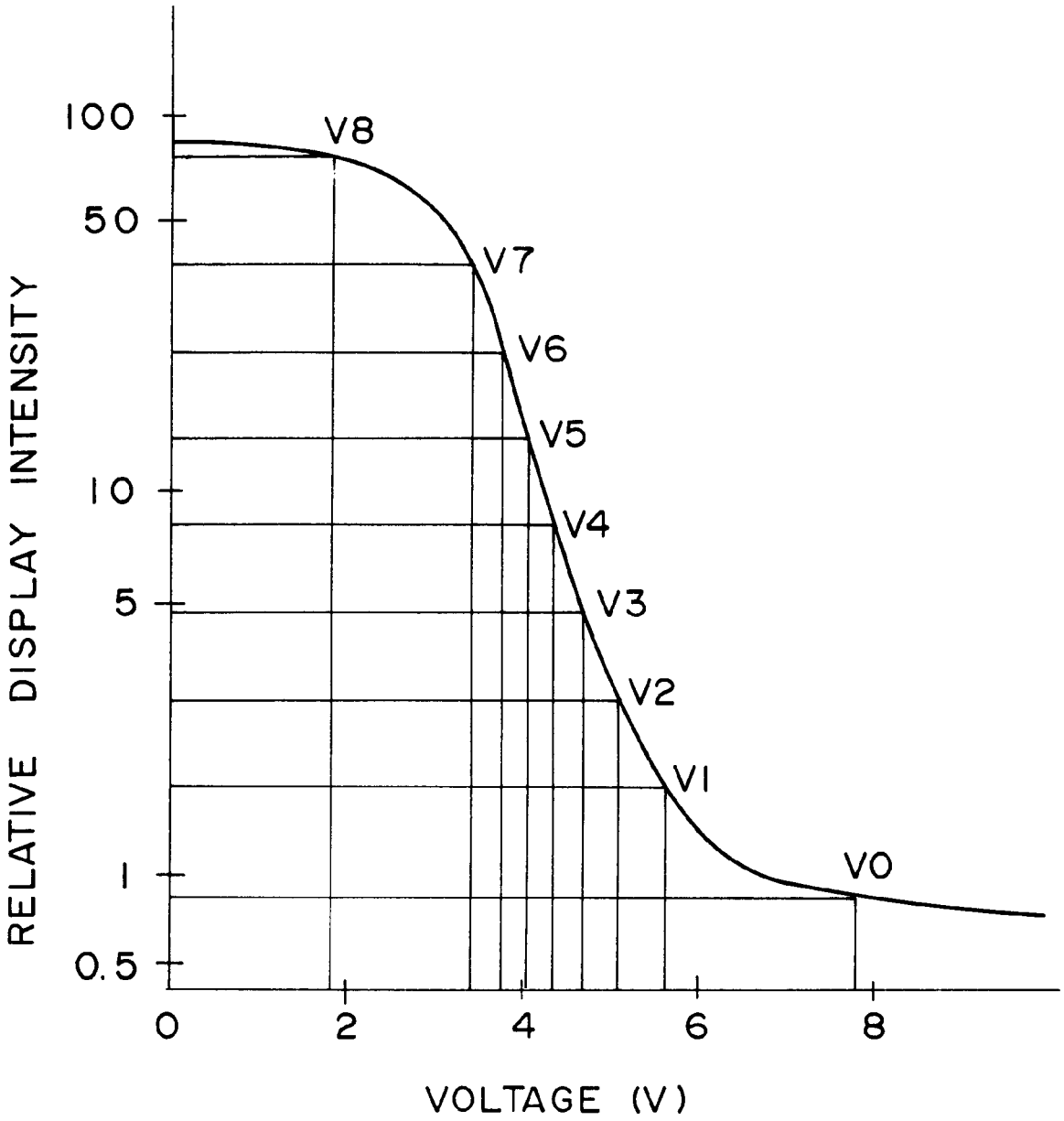
FIG. 39 is a graph showing the intensity-versus-voltage characteristics of a liquid crystal.

Presetting of the liquid-crystal power source voltage will be described with reference to FIGS. 39 and 40. FIG. 39 is a graph showing the relation between the voltages and the intensity of the liquid crystal, abscissa and ordinate representing the voltage applied to the liquid crystal and relative brightness in logarithmic scale, respectively.

Figure 40:
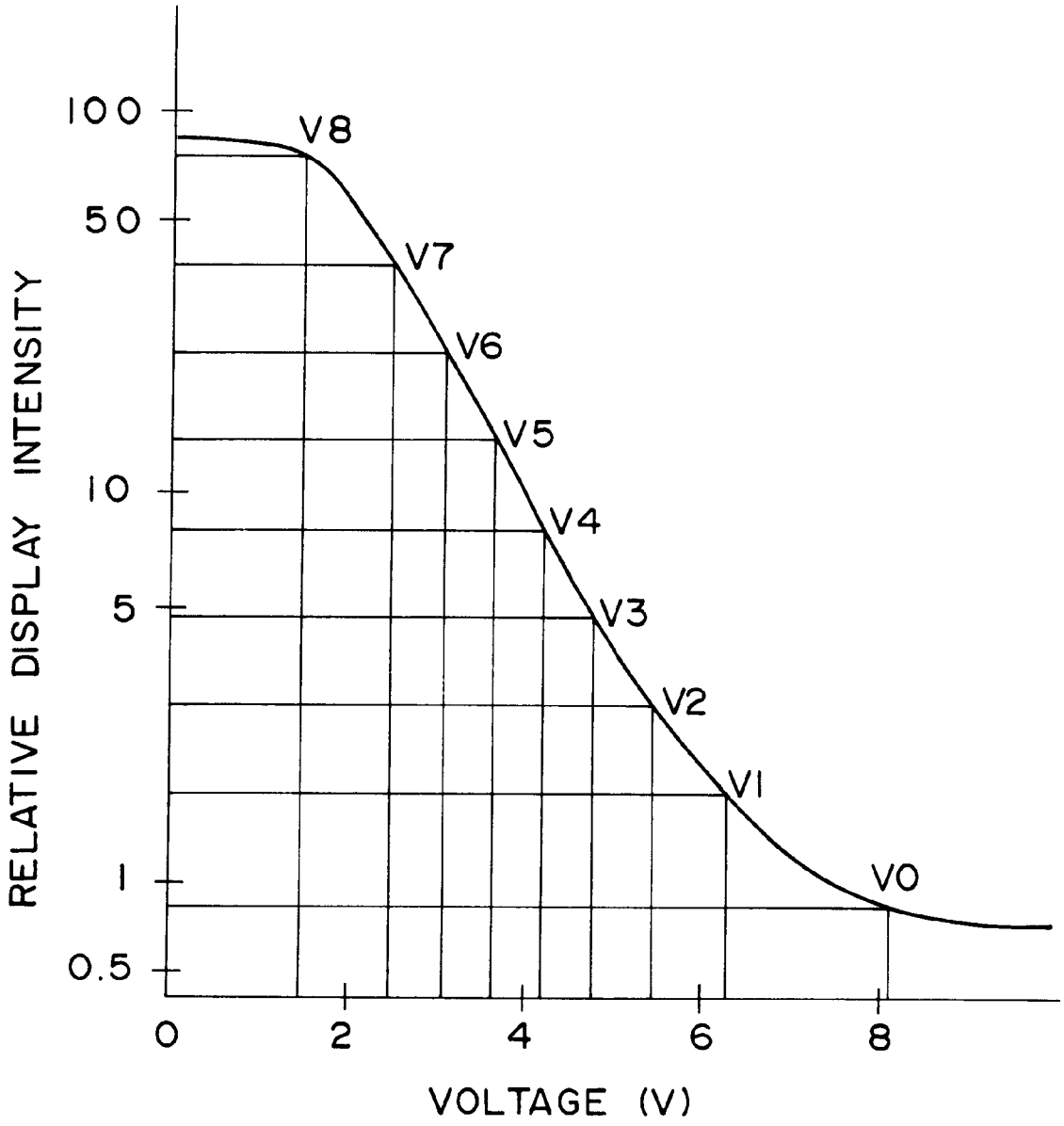
FIG. 40 is a graph showing the intensity-versus-voltage characteristics of a liquid crystal.

FIG. 40 is a graph showing another characteristics of the intensity-versus-voltages of the liquid crystal. The relation between the voltages and the intensity differs with different characteristics of material of the liquid crystal. It is therefore necessary to preset the liquid-crystal power source voltage to match with the voltage-intensity characteristics of the liquid crystal.

Comparison of FIG. 39 with FIG. 40 shows that the curve shown in FIG. 39 has a sharper gradient in the vicinity of 2 to 6 volts of the voltage applied to the liquid crystal. Accordingly, the spacings between preset voltages V0 to V8 of the liquid-crystal power source voltages are narrower. The preset voltage spacings are wider in FIG. 40. In other words, the present embodiment can deal with liquid-crystal panels having different intensity-voltage characteristics of the liquid crystal by changing the presetting of the liquid-crystal power source voltage.

Similarly, the first to eighth embodiments can also deal with the liquid-crystal panels having different intensity-voltage characteristics of the liquid crystal by changing the presetting of the 5 levels of the liquid-crystal power source voltage.

Similarly, the ninth to fourteenth embodiment can also deal with the liquid-crystal panels having different intensity-voltage characteristics of the liquid crystal by changing the presetting of a set of 9 levels of liquid-crystal power source voltage.

Now, a liquid-crystal power source circuit of a liquid-crystal panel module using the signal driver of the ninth to fifteenth embodiments will be described with reference to FIGS. 41 and 42. The liquid-crystal power source is adapted to drive pixel electrodes. The tonal display on the liquid crystal is carried out by changing the magnitude of the voltage which is applied between the pixel electrodes and opposite electrodes.

Figure 41:
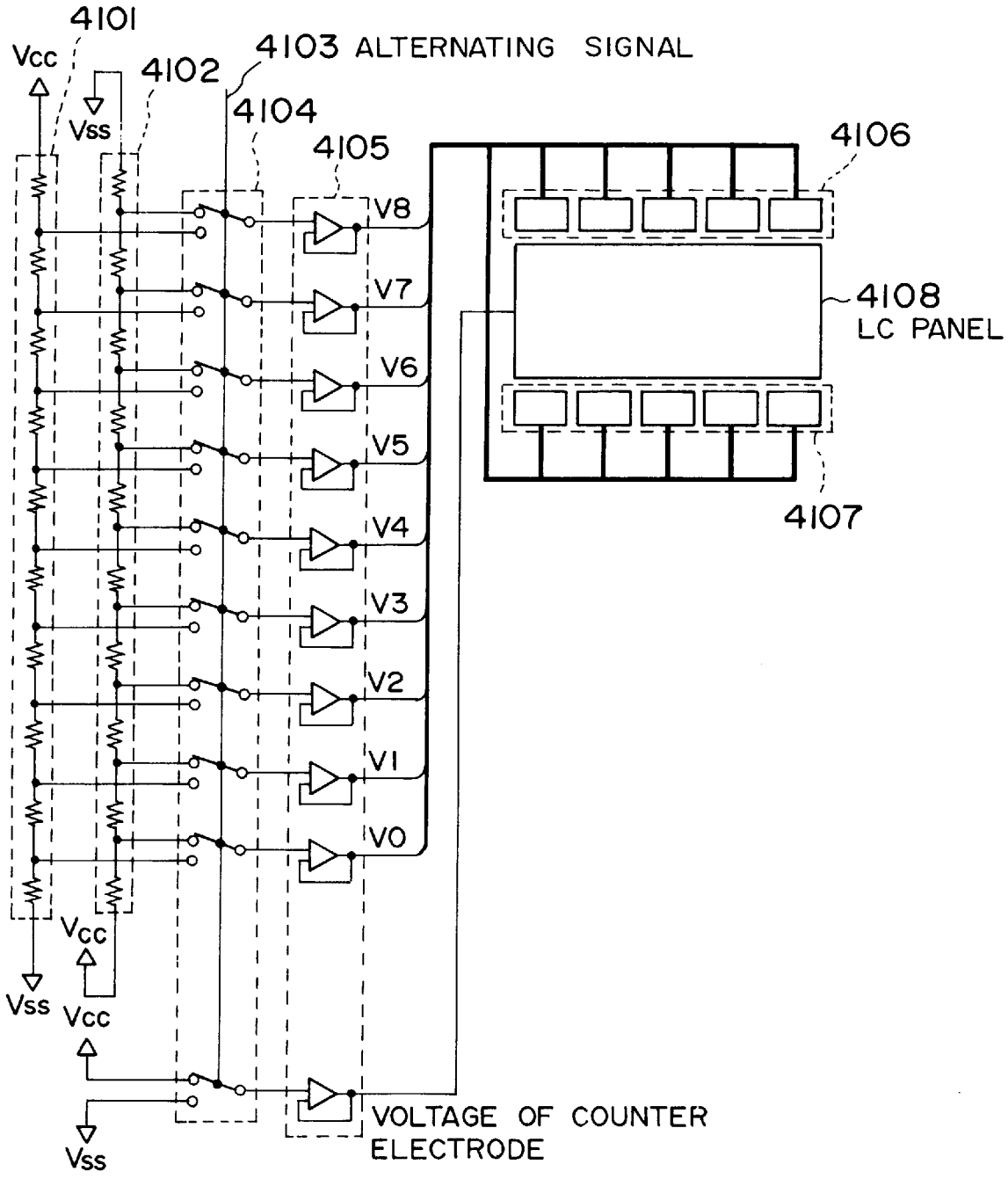
FIG. 41 is a block diagram of a liquid-crystal power source circuit.

FIG. 41 is a view showing the configuration of the liquid-crystal power source circuit in which an active matrix type color liquid-crystal panel having a resolution 1920 pixels×480 lines is driven by using 10 liquid-crystal drivers each having 192 outputs and by applying alternating signal on the opposite electrodes.

Figure 42:
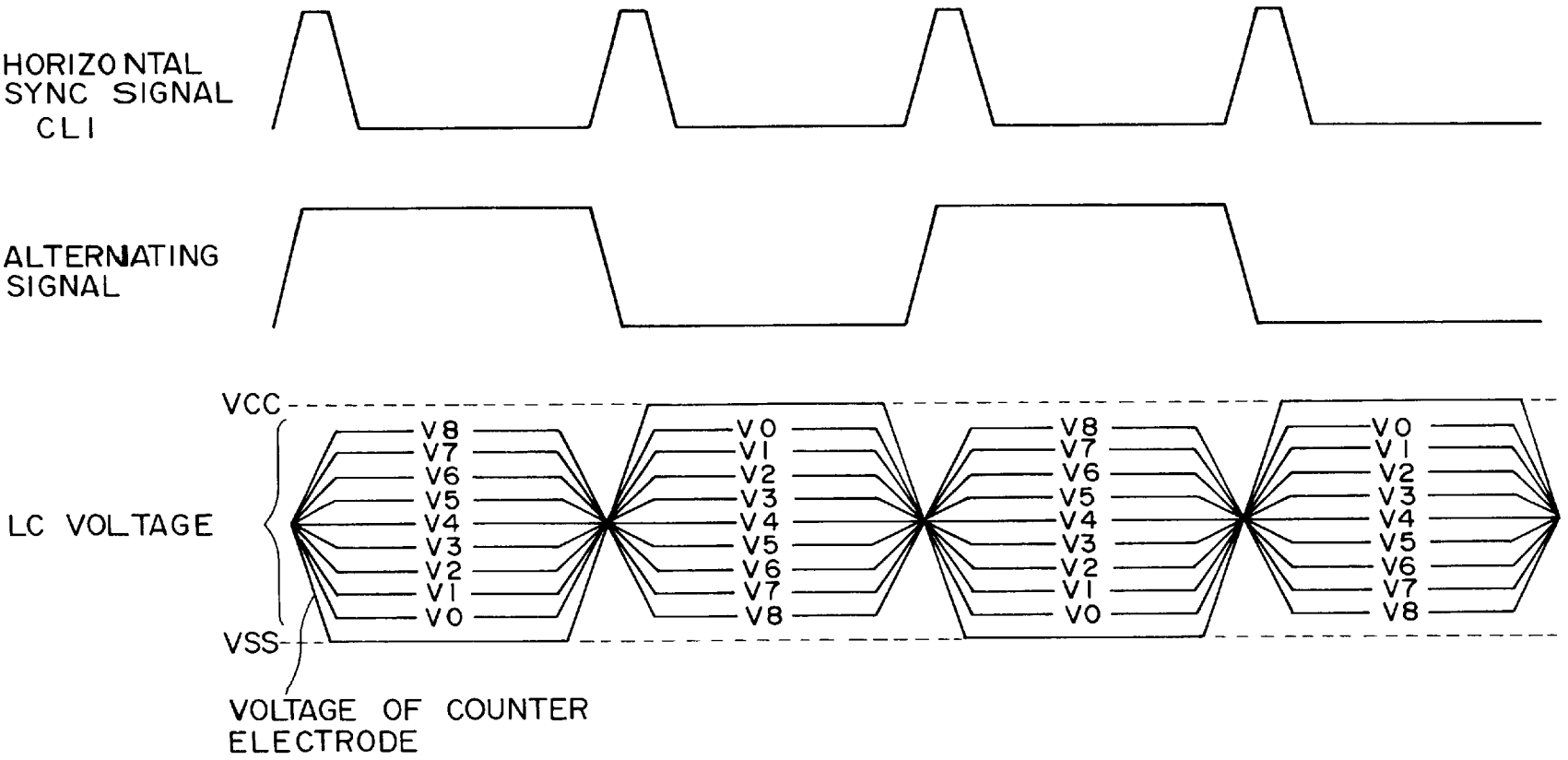
FIG. 42 is a diagram showing the timings of alternation of the counter electrode of a liquid-crystal power source.

FIG. 42 is a chart showing the timing relationship between the alternating signal on the opposite electrodes and the liquid-crystal power source.

In FIG. 41, reference numerals 4101 and 4102 denote group of voltage dividing resistors; 4103 an alternating signal; 4104 selecting element which are switched in response to the alternating signal 4103; 4105 output buffers amplifier; 4106 and 4107 signal driver groups; 4108 the active matrix type color liquid-crystal panel having a resolution of 1920 pixels×480 lines.

A set of 9 levels of voltage are selected by switching the selecting element 4104 in response to the alternating signal 4103 from two sets of 9 levels of voltage one set of which is obtained by dividing the voltage between the power source voltages Vcc and Vss with the group of voltage dividing resistor 4101 and another set of which is obtained by dividing the voltage between the power source voltages Vcc and Vss with the group of voltage dividing resistor 4102. The selected voltage is output via the output buffer amplifier 4105 as V8 to V0.

The power source voltage Vcc or Vss is selected by switching the selecting element 4104 in response to the alternating signal 4103 and the selected voltage s output via the output buffer amplifier 4105 as the opposite electrode voltage. By switching the selecting element 4104 in response to the alternating signal 4103, one of the power source voltage Vcc and Vss is selected and output as the opposite electrode voltage through the output buffer amplifier 4105. ALTERNATING driving of the liquid crystal panel is conducted by connecting the liquid-crystal voltages V8 to V0 to the signal driver groups 4106 and 4107 and connecting the opposite electrode voltage to the opposite electrodes of the liquid-crystal panel 4108.

Now, operation timing of the liquid-crystal voltage and the opposite electrode voltage will be described with reference to FIG. 42. The opposite electrode voltage is Vss for a period of time in which the alternating signal which alternates for each horizontal period is high. The opposite electrode voltage is Vcc for a period of time in which the alternating signal is low. The liquid crystal voltage V8 to V0 is V0 on the Vss side and is V8 on the Vcc side for a period of time in which the alternating signal is high. The crystal voltage V8 to V0 is V8 on the Vss side and is V0 on the Vcc side for a period of time in which the alternating signal is high. By doing so, liquid-crystal voltage having polarities which are negative and positive for the pixel electrodes can be applied to the opposite electrodes.

The opposite electrode voltage alternates with the liquid crystal voltage for each horizontal period. ALTERNATING driving of the liquid-crystal panel can be conducted by applying alternating signal for each frame in the same line.

Also in the first to eighth embodiment, alternating driving of the liquid-crystal panel can be conducted by providing a similar 5-level liquid-crystal power source circuit.

Figure 43:
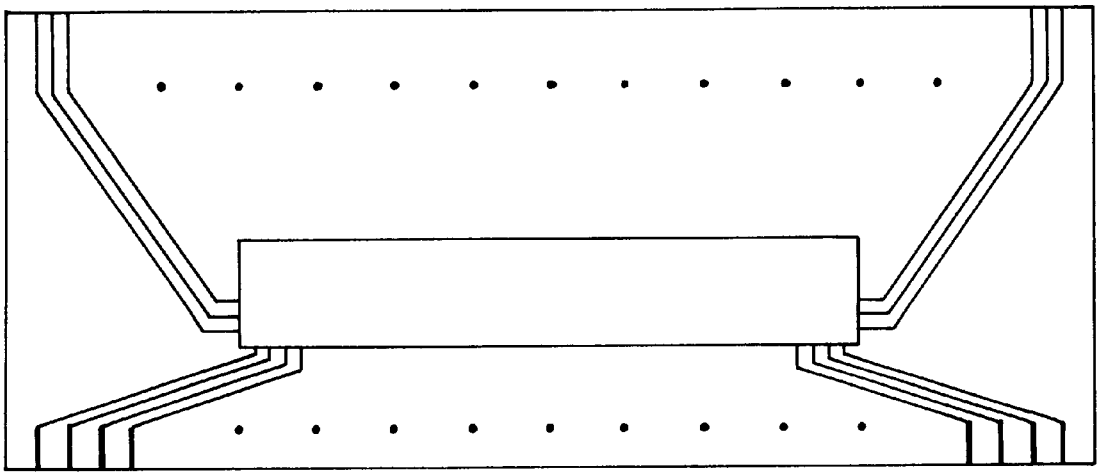
FIG. 43 is a diagram showing a TCP (tape carrier package)

Next, there will be described a method of mounting the signal driver of each of the first thru fifteen embodiments on the liquid-crystal panel. The signal driver has a large number of outputs. Moreover, the pixel pitch of the liquid-crystal panel is small, and the peripheral installation part of the liquid-crystal panel should preferably be reduced. The signal driver is therefore installed in the state in which it is placed on a tape carrier package (hereinbelow, abbreviated to "TCP"). With the TCP, the signal driver is mounted on a tape by tape automated bonding (TAB). FIG. 43 shows the signal driver mounted in the TCP. This figure is a schematic view of the TCP in the case where the pitch of output terminals is 0.16 [mm] and where the pitch of input terminals is 0.65 [mm].

Now, an embodiment of a color liquid-crystal display system of active matrix type employing the signal driver to which the present invention is applied will be described in detail. In the drawings to be referred to below, parts having the same functions are denoted by identical symbols, and they shall not be repeatedly explained.

Figure 44:
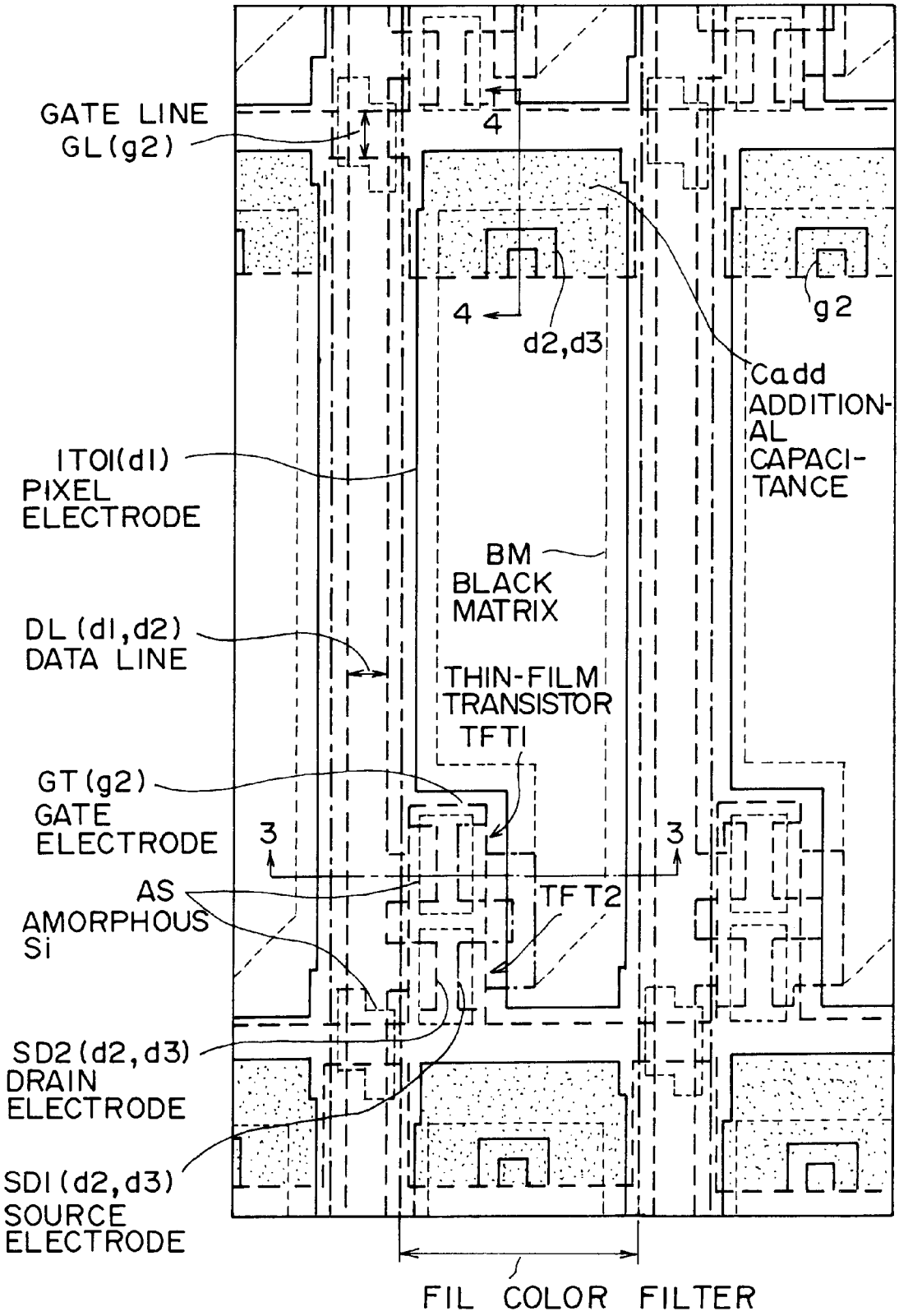
FIG. 44 is a plan view of essential parts showing one pixel of a liquid-crystal display portion and the surroundings thereof in a color liquid-crystal display system of active matrix type to which the present invention is applied.
Figure 45:
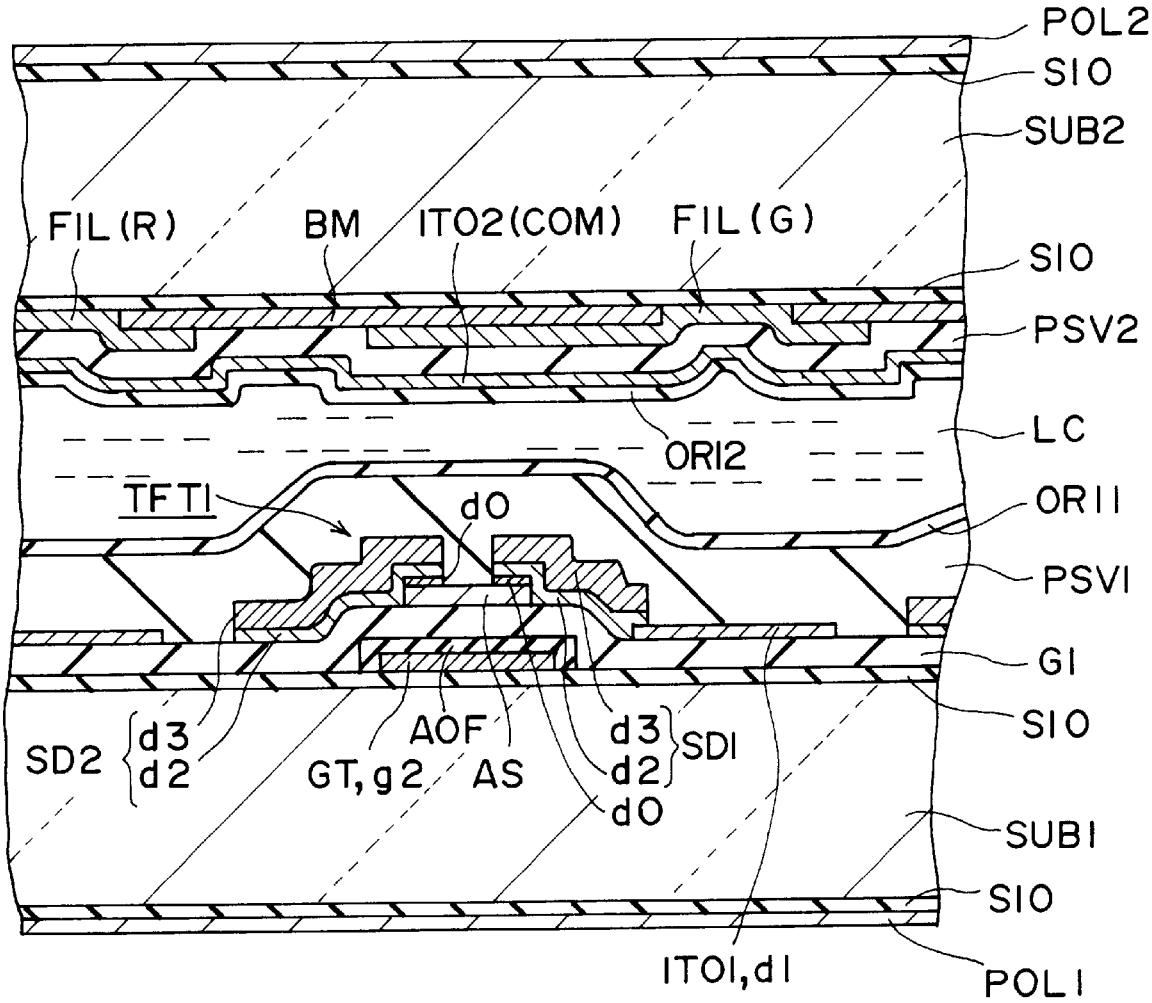
FIG. 45 is a sectional view showing the pixel and the surroundings thereof taken along line 3—3 in FIG. 44.
Figure 46:
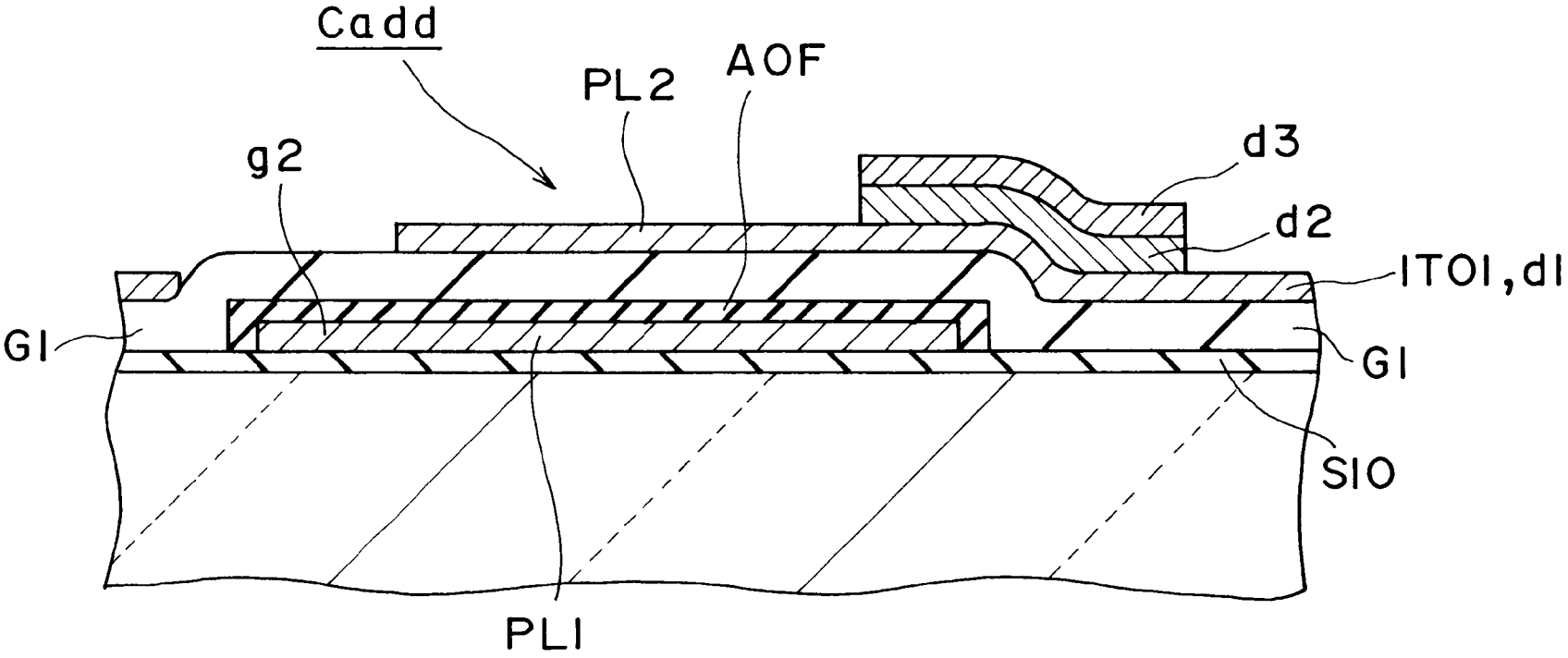
FIG. 46 is a sectional view showing an additional capacitance ($C_{add}$) taken along line 4—4 in FIG. 44.

FIG. 44 is a plan view showing one pixel of the active matrix type color liquid-crystal display system to which the present invention is applied, and the surroundings thereof. FIG. 45 is a sectional view taken along line 3—3 in FIG. 44, while FIG. 46 is a sectional view taken along line 4—4 in FIG. 44.

As shown in FIG. 44, each of the pixels of the liquid-crystal display system is arranged in an area (area enclosed with four signal lines) of intersection among two adjacent scanning signal lines (gate signal lines or horizontal signal lines) GL and two adjacent video signal lines (drain signal lines or vertical signal lines) DL. Each pixel includes thin-film transistors TFT, a transparent pixel electrode ITO1 and a holding capacitance element $C_{add}$. The scanning signal line GL extends laterally as viewed in the figure, and the plurality of scanning signal lines GL are arranged vertically. The video signal line DL extends vertically, and the plurality of video signal lines DL are arranged laterally.

As shown in FIG. 45, the thin-film transistors TFT1, TFT2 and the transparent pixel electrode ITO1 are formed on the side of a lower transparent glass substrate SUB1 with respect to a liquid-crystal layer LC, while color filters FIL and a light intercepting black matrix pattern BM are formed on the side of an upper transparent glass substrate SUB2. Both the surfaces of each of the transparent glass substrates SUB1, SUB2 are provided with silicon oxide films SIO which are formed by, e. g., dipping.

Provided on the surface of the inner side (closer to the liquid crystal LC) of the upper transparent glass substrate SUB2 are the light shield film BM, the color filters FIL, a protective film PSV2, a common transparent pixel electrode ITO2 (COM) and an upper orientation film ORI2 which are successively stacked.

Figure 47:
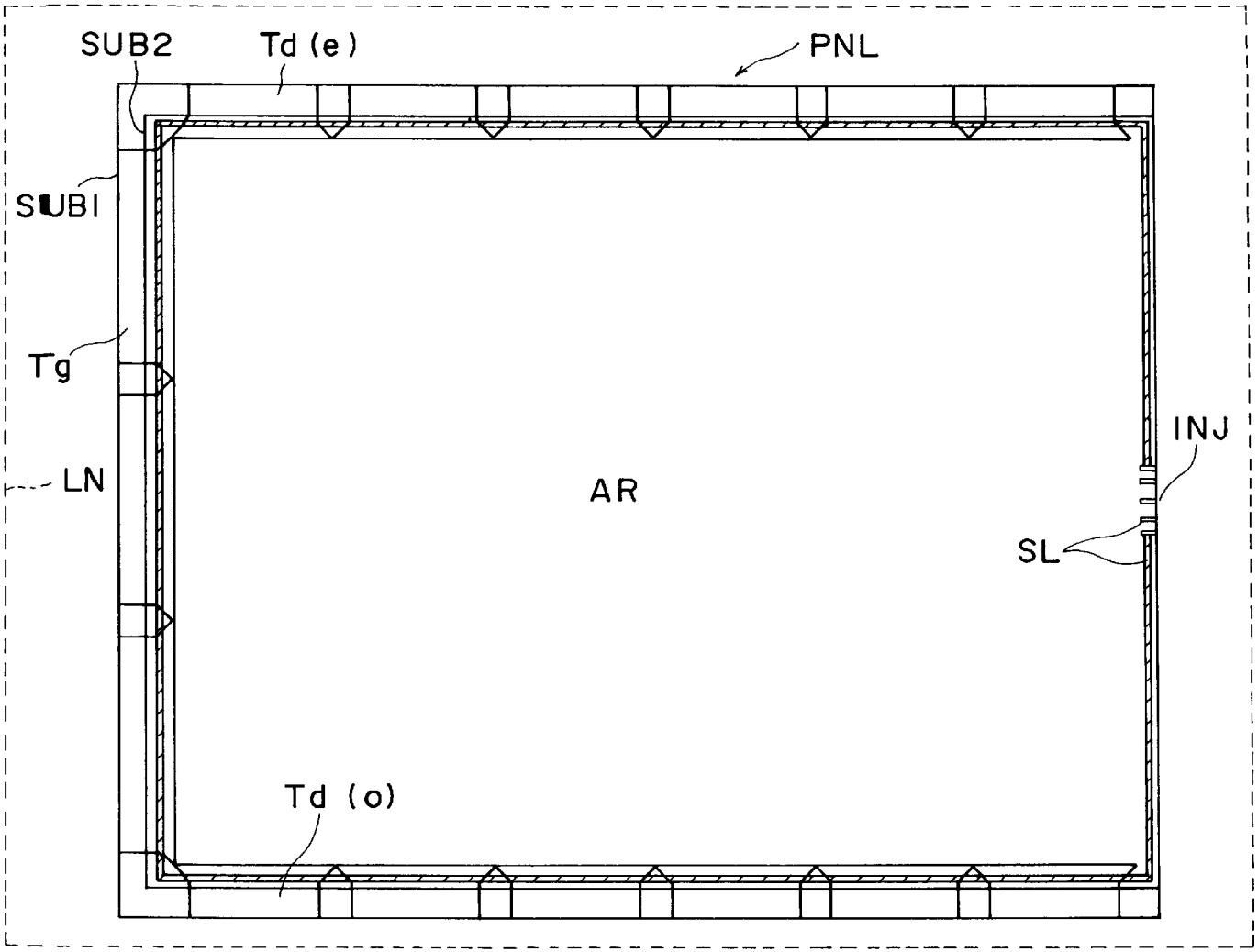
FIG. 47 is a plan view for explaining the construction of the peripheral part of the matrix of a display panel.
Figure 48:
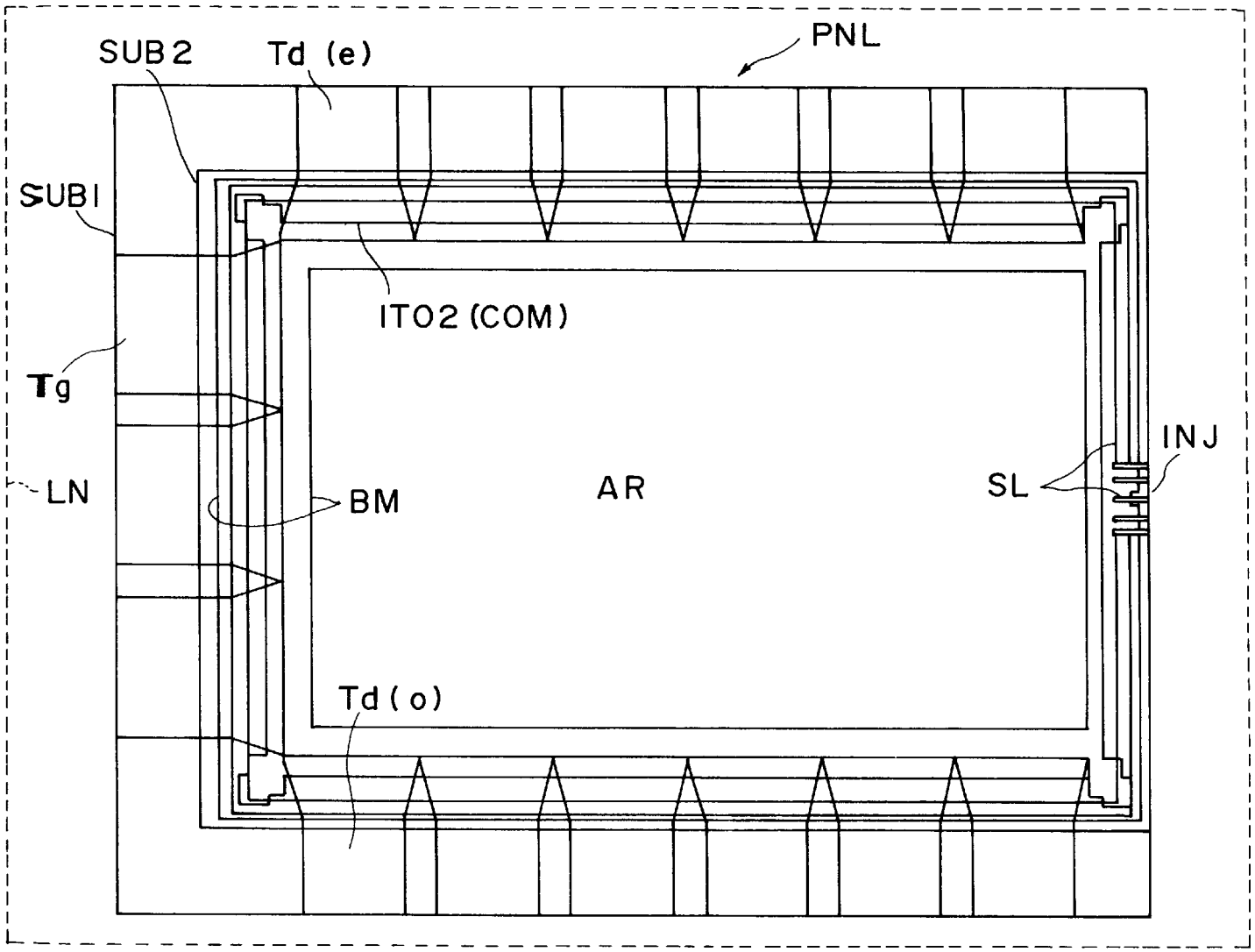
FIG. 48 is a plan view of the panel showing the peripheral part in FIG. 47 somewhat exaggeratively in order to explain it more concretely.
Figure 49:
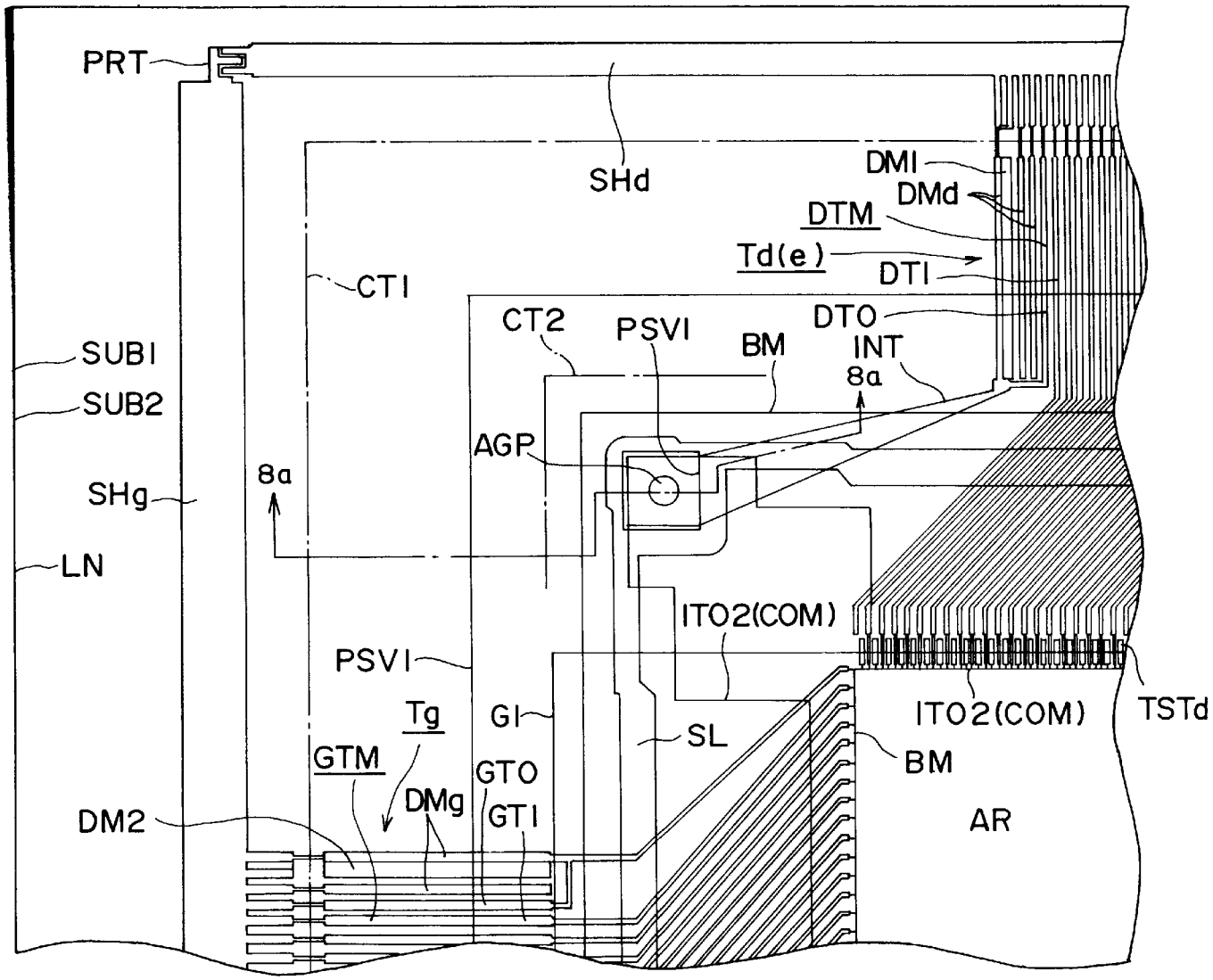
FIG. 49 is an enlarged plan view of the corner of the display panel including the electrical connection parts of upper and lower substrates.
Figures 50A, 50B, 50C:
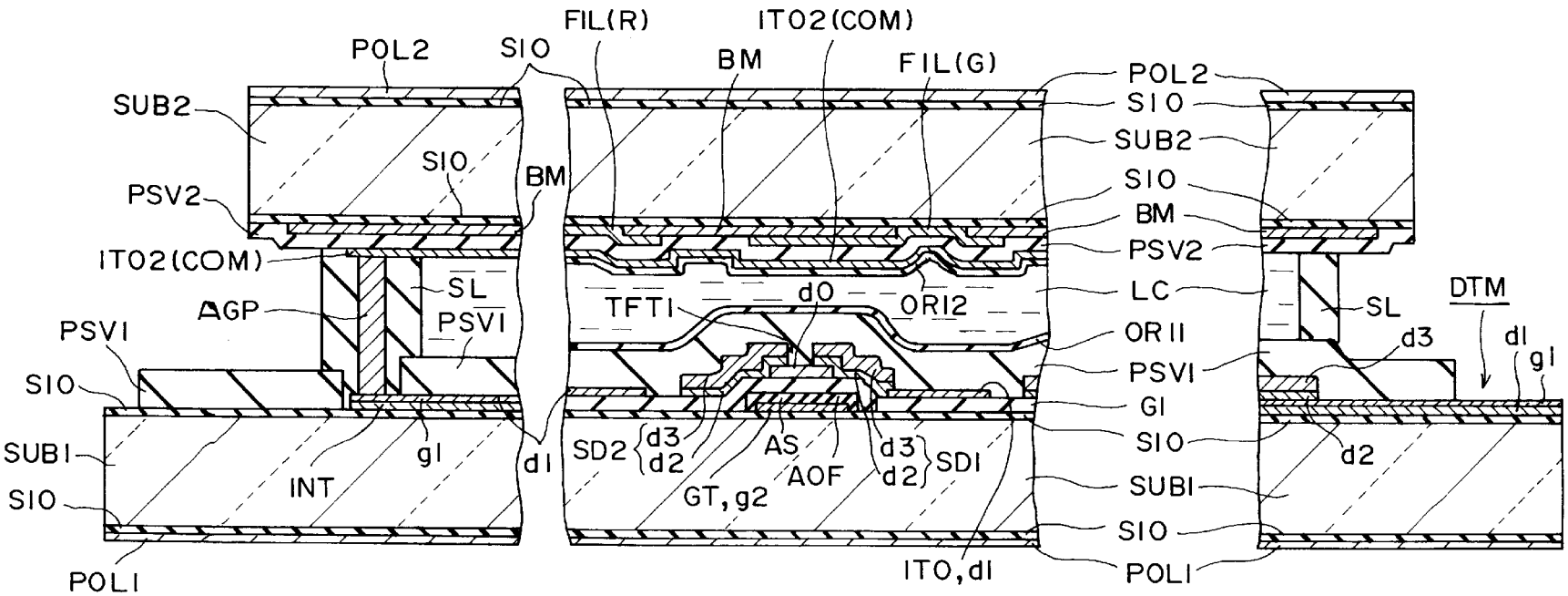
FIG. 50(A), FIG. 50(B) and FIG. 50(C) are sectional views showing the vicinity of the corner of the panel, the pixel part of the matrix and the vicinity of a video signal terminal, respectively.
Figures 51A, 51B:
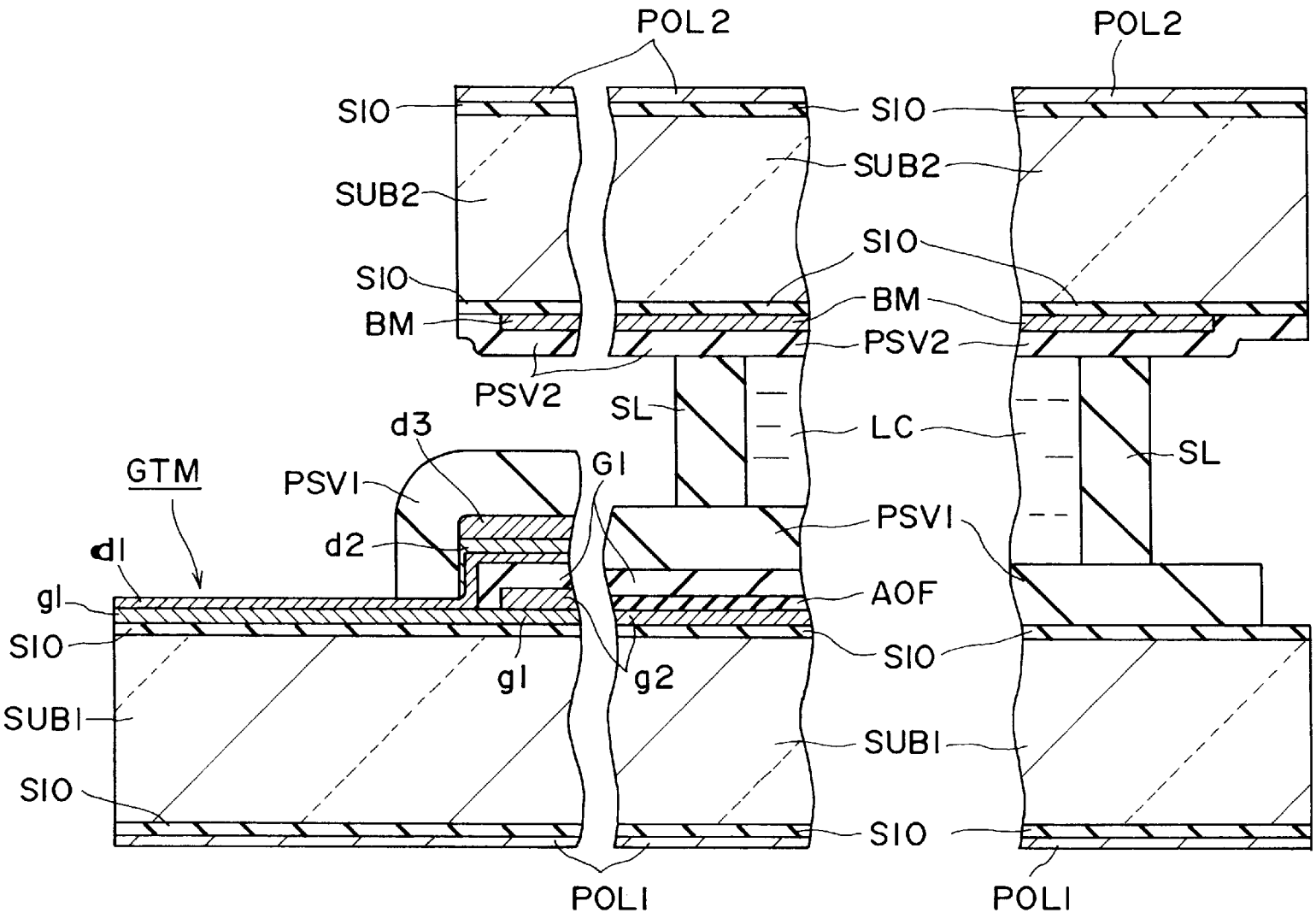
FIG. 51(A) and FIG. 51(B) are sectional views showing a scanning signal terminal and the edge part of the panel having no external connection terminal, respectively.

FIG. 47 is a plan view of the essential parts of and around a matrix (AR) in a display panel PNL which includes the upper and lower glass substrates SUB1 and SUB2, FIG. 48 is a plan view showing the surrounding parts of the matrix (AR) in a more exaggerated manner, and FIG. 49 is an enlarged plan view of the vicinity of a seal portion SL corresponding to the upper left corner of the panel in FIGS. 47 and 48. In addition, FIG. 50(B) is a sectional view equivalent to FIG. 45, FIG. 50(A) is a sectional view taken along line 8*a*—8*a* indicated in FIG. 49, and FIG. 50(C) is a sectional view of the vicinity of an external connection terminal DTM to which a video signal driver circuit is to be connected. Likewise, FIG. 51(A) is a sectional view of the vicinity of an external connection terminal GTM to which a scanning circuit is to be connected, and FIG. 51(B) is a sectional view of the vicinity of the seal portion SL which has no external connection terminal.

The panel PNL is manufactured as stated below. When the size of the panel PNL is small, devices for a plurality of panels are simultaneously fabricated on a single glass substrate and are thereafter split in order to enhance throughput. On the other hand, when the size of the panel PNL is large, a glass substrate having a size applicable to all kinds of panels is prepared and is thereafter reduced to sizes conforming to the respective kinds of panels, in order to share manufactural equipment. In either case, the glass is cut after having undergone a series of processes. FIGS. 47 to 49 illustrate the example of the latter case. Herein, both FIGS. 47 and 48 show the state of the panel PNL after the upper and lower substrates SUB1 and SUB2 have been cut, and FIG. 49 shows the state before they are cut. Symbol LN denotes the edges of both the substrates before the cutting, and symbols CT1 and CT2 denote the positions of the respective substrates SUB1 and SUB2 to be cut. In either case, in the finished state of the panel PNL, the upper substrate SUB2 is made smaller in size than the lower substrate SUB1 in order to denude or expose portions (the upper and lower latera and the left latus as viewed in the figures) where groups of external connection terminals Tg and Td (terminal Nos. 1 to 192 by way of example) are existent. The names of the groups of terminals Tg and Td are given in such a way that the pluralities of scanning circuit connecting terminals GTM and video signal circuit connecting terminals DTM, and the lead-out wiring portions thereof to be explained later are respectively collected in the units of the tape carrier packages TCP (in FIGS. 60 and 61) on which integrated circuit chips CHI are mounted. The lead-out wiring of each group extending from the matrix portion to the external connection terminal portion inclines as it comes near to both the ends thereof. This is intended to adapt the terminals DTM and GTM of the display panel PNL to the arrayal pitch of the packages TCP and the connection terminal pitch of each package TCP.

The seal pattern SL is formed between the transparent glass substrates SUB1 and SUB2 and along the edges thereof except a liquid-crystal injection port INJ so as to tightly enclose the liquid crystal LC. A sealant for the seal pattern SL is, for example, an epoxy resin. The common transparent pixel electrode ITO2 on the side of the upper transparent glass substrate SUB2 is connected to the lead-out wiring line INT thereof formed on the side of the lower transparent glass substrate SUB1, with a silver paste material AGP in at least one place, in this embodiment, in the four corners of the panel PNL. The lead-out wiring line INT is formed by the same manufacturing process as that of the gate terminal GTM and drain terminal DTM to be explained later.

The respective layers of the orientation films ORI1, ORI2, transparent pixel electrode ITO1 and common transparent pixel electrode ITO2 in FIG. 45 are formed inside the seal pattern SL. Polarizer plates POLL and POL2 are respectively formed on the outer surfaces of the lower transparent glass substrate SUB1 and the upper transparent glass substrate SUB2. The liquid crystal LC is tightly enclosed in a region partitioned by the seal pattern SL, between the lower orientation film ORI1 and the upper orientation film ORI2 which set the orientations of liquid-crystal molecules. The lower orientation film ORI1 is formed on a protective film PSV1 provided on the side of the lower transparent glass substrate SUB1.

The liquid-crystal display system is assembled by stacking the various layers separately on the side of the lower transparent glass substrate SUB1 and on the side of the upper transparent glass substrate SUB2, forming the seal pattern SL on the side of the substrate SUB2, placing the lower transparent glass substrate SUB1 and the upper transparent glass substrate SUB2 one over the other, injecting the liquid crystal LC from the opening INJ of the sealant SL, sealing the injection port INJ with the epoxy resin or the like, and cutting the upper and lower substrates.

Now, the construction of the side of the TFT substrate SUB1 will be described in detail by referring back to FIGS. 44 and 45.

The thin-film transistor TFT operates in such a manner that the source-drain channel resistance of this transistor decreases when a plus bias is applied to the gate electrode GT thereof, whereas the channel resistance increases when the bias is made null.

Each pixel is provided with the plurality of (two) thin-film transistors TFT1, TFT2 redundantly. The thin-film transistors TFT1, TFT2 are constructed with substantially the same sizes (equal channel lengths and equal channel widths), respectively. Each of the transistors TFT1, TFT2 includes the gate electrode GT, a gate insulator film GI, an i-type semiconductor layer AS made of amorphous silicon (Si) of i-type (intrinsic type which is not doped with any impurity for determining a conductivity type), and a source electrode SD1 and a drain electrode SD2 which form a pair. By the way, the source and drain of a transistor are essentially determined by the sign of the bias between them. In the circuitry of the liquid-crystal display system, the sign is inverted during the operation thereof. It is therefore to be understood that the source and drain interchange during the operation. For the sake of convenience, however, one shall be fixedly expressed as the source and the other as the drain in the ensuing description.

The gate electrode GT is constructed in a shape in which it protrudes in the vertical direction from the scanning signal line GL (bifurcated in the shape of letter T). This gate electrode GT protrudes beyond the active regions of the respective thin-film transistors TFT1, TFT2. The gate electrodes GT of the individual thin-film transistors TFT1, TFT2 are constructed unitarily (as a common gate electrode), and are formed in continuation to the scanning signal line GL. In this example, the gate electrode GT is formed of the second conductor film g2 of single layer. The second conductor film g2 is, for example, an aluminum (Al) film formed by sputtering, and it is overlaid with an anodic oxidation film AOF of Al.

The gate electrode GT is formed somewhat larger than the i-type semiconductor layer AS so as to completely cover this layer AS (as viewed from below). Thus, external light or back light is prevented from striking the i-type semiconductor layer AS.

The scanning signal line GL is formed of the second conductor film g2. The second conductor film g2 of the scanning signal line GL is formed by the same manufacturing process as that of the gate electrode GT, and is constructed to be unitary with that of the gate electrode GT. Besides, the anodic oxidation film AOF of Al is extended also on the scanning signal line GL.

The insulator film GI is used as the gate insulator film which serves to apply an electric field to the semiconductor layer AS in cooperation with the gate electrode GT in the thin-film transistors TFT1, TFT2. The insulator film GI is formed over the gate electrode GT as well as the scanning signal line GL. By way of example, a silicon nitride film formed by plasma CVD is selected as the insulator film GI, and it is formed to a thickness of 1200 to 2700 [Å] (about 2000 [Å] in this embodiment). As shown in FIG. 49, the gate insulator film GI is formed so as to surround the whole matrix portion AR, and the peripheral part thereof is removed so as to denude the external connection terminals DTM, GTM. The insulator film GI is also contributive to the electrical insulation of the scanning signal line GL and the video signal line DL.

The i-type semiconductor layer AS is deposited so as to form independent islands for the respective thin-film transistors TFT1, TFT2 in this example. It is formed of amorphous silicon to a thickness of 200 to 2200 [Å] (about 2000 [Å] in this embodiment). A layer d0 is an N(+)-type amorphous silicon semiconductor layer doped with phosphorus (P) and for an ohmic contact (resistive contact or resistive junction). It is left at only a part under which the i-type semiconductor layer AS exists and over which a conductor layer d2 (d3) exists.

The i-type semiconductor layer AS is also extended between the scanning signal line GL and the video signal line DL in the intersection (crossover) area thereof. The i-type semiconductor layer AS in the crossover area relieves the short-circuiting of the scanning signal line GL and the video signal line DL in this area.

The transparent pixel electrode ITO1 constructs one of the pixel electrodes of the liquid-crystal display portion.

More specifically, the transparent pixel electrode ITO1 is connected to both the source electrode SD1 of the thin-film transistor TFT1 and that of the thin-film transistor TFT2. Therefore, even when any defect has arisen in either of the thin-film transistors TFT1, TFT2, a pertinent part may be cut by a laser beam or the like on condition that the defect brings about an evil effect. If the defect brings about no evil effect, it may be left intact because the other thin-film transistor is operating normally. The transparent pixel electrode ITO1 is constructed of the first conductor film d1, which is made of a transparent conductor film (Indium-Tin-Oxide abbreviated to ITO: nesa film) formed by sputtering and which is formed to a thickness of 1000 to 2000 [Å] (about 1400 [Å] in this embodiment).

The source electrode SD1, and the drain electrode SD2 are respectively constructed of the second conductor film d2 lying in touch with the N(+)-type semiconductor layer d0, and the third conductor film d3 formed thereon.

The second conductor film d2 is a chromium (Cr) film which is formed by sputtering to a thickness of 500 to 1000 [Å] (about 600 [Å] in this embodiment). When the Cr film is thickened, it undergoes a high stress, and hence, it is formed within a thickness range not exceeding about 2000 [Å] . The Cr film is used for the purposes of improving the adhesion of the source and drain electrodes with the N(+)-type semiconductor layer d0, and preventing the Al atoms of the third conductor film d3 from diffusing into the N(+)-type semiconductor layer d0 (as a so-called barrier layer). Apart from the Cr film, a high-melting metal (Mo, Ti, Ta or W) film or a high-melting metal silicide ($MoSi_2$, $TiSi_2$, $TaSi_2$ or $WSi_2$) film may well be employed as the second conductor film d2.

The third conductor film d3 is formed by the sputtering of Al to a thickness of 3000 to 5000 [Å] (about 4000 [Å] in this embodiment). The Al film is lower in stress than the Cr film, and can be thickened. It functions to reduce the resistances of the source electrode SD1, drain electrode SD2 and video signal line DL and to ensure getting over steps ascribable to the gate electrode GT and the i-type semiconductor layer AS (to improve step coverage).

After the second conductor film d2 and third conductor film d3 have been patterned with an identical mask, the N(+)-type semiconductor layer d0 is partly removed using the same mask or using the second conductor film d2 and third conductor film d3 as a mask. That is, the N(+)-type semiconductor layer d0 having remained on the i-type semiconductor layer AS has its parts removed by self-alignment, the parts being outside the second conductor film d2 and third conductor film d3. On this occasion, the N(+)-type semiconductor layer d0 is etched so that the whole thickness thereof may be removed. Therefore, also the i-type semiconductor layer AS has its surface part somewhat etched, but the extent of the surface etching may be controlled in terms of an etching time period.

The video signal line DL is constructed of the second conductor film d2 and third conductor film d3 of the same layer as that of the source electrode SD1 and drain electrode SD2.

The protective film PSV1 is provided on the thin-film transistor TFT and transparent pixel electrode ITO1. This protective film PSV1 is formed chiefly for protecting the thin-film transistor TFT from moisture etc., and is made of a material of high transparency and high moisture resistance. By way of example, the protective film PSV1 is formed of a silicon oxide film or silicon nitride film produced by a plasma CVD device, and it has a thickness of about 1 [$\mu$m].

As shown in FIG. 49, the protective film PSV1 is formed so as to surround the whole matrix portion AR. The peripheral part of this film PSV1 is removed so as to denude the external connection terminals DTM, GTM, and the part thereof, in which the common electrode COM of the upper substrate SUB2 is connected to the terminal connecting lead-out wiring INT of the lower substrate SUB1 with the silver paste AGP, is also removed. Regarding the thicknesses of the protective film PSV1 and the gate insulator film GI, the former film is thickened in consideration of the effect of the protection, and the latter film is thinned in consideration of the mutual conductance gm of the transistor. As illustrated in FIG. 49, accordingly, the protective film PSV1 of high protection effect is formed larger than the gate insulator film GI in order that even the peripheral part may be protected over the largest possible area.

On the side of the upper transparent glass substrate SUB2, the light intercepting film BM is provided so as to prevent the external light or back light from entering the i-type semiconductor layer AS. The contour line of the closed polygon of the light shield film BM shown in FIG. 44 indicates an opening inside which this film BM is not formed. The light shield film BM is made of, for example, an aluminum film or chromium film which is highly interceptive of light. In this embodiment, the chromium film is formed to a thickness of about 1300 [Å] by sputtering.

Accordingly, the i-type semiconductor layer AS of the thin-film transistors TFT1, TFT2 is sandwiched in between the overlying light shield film BM and the underlying gate electrode GT of somewhat larger size, and it is shielded from the external natural light or the back light. The light shield film BM is formed in the shape of a lattice around the respective pixels (as the so-called black matrix), and the effective display area of one pixel is defined by the lattice. Accordingly, the contour of each pixel is clarified by the light shield film BM, and the contrast of a display image is enhanced. That is, the light shield film BM has the two functions of the light shield for the i-type semiconductor layer AS and the black matrix.

An edge part (a right lower part in FIG. 44) on a root side in the rubbing direction of the transparent pixel electrode ITO1 is also shielded from light by the light intercepting film BM. Therefore, even when a domain (a nonuniform display) has appeared in the edge part, it is not seen, and the display characteristics of the liquid-crystal panel PNL do not degrade.

As shown in FIG. 48, the light shield film BM is formed in a picture frame shape even at the peripheral part, and the pattern thereof is formed in continuation to the pattern of the matrix portion shown in FIG. 44 and provided with a plurality of dot-like openings. As shown in FIG. 48, FIG. 49, FIGS. 50(A) to 50(C), and FIGS. 51(A) to 51(B), the light shield film BM at the peripheral part is extended outside the seal portion SL. Thus, in a machine employing the liquid-crystal display system, such as personal computer, light which enters the interior of the machine through the connected part etc. of the housing of the machine or light which is reflected by the housing is prevented from invading the matrix portion. On the other hand, the light shield film BM is confined about 0.3 to 1.0 [mm] inward of the edge of the substrate SUB2 so as to avoid the cutting area of this substrate SUB2.

The color filters FIL are formed at positions opposing to the pixels, in the shape of stripes by the iteration of red, green and blue. They are formed somewhat larger so as to cover the whole transparent pixel electrode ITO1. The light shield film BM is formed inside the peripheral edge part of the transparent pixel electrode ITO1 so as to overlap the edge parts of the color filters FIL and transparent pixel electrode ITO1.

The color filters FIL can be formed as stated below. First, a dyeing parent material such as acrylic resin is deposited on the surface of the upper transparent glass substrate SUB2, and the dyeing parent material on surface parts except red filter forming regions is removed by photolithography. Thereafter, the dyeing parent material is dyed with a red dye and is subjected to a fixing process. Then, the red filters R are formed. Subsequently, green filters G and blue filters B are successively formed by performing similar processes.

The protective film PSV2 is provided in order to prevent the dyes of the color filters FIL from leaking into the liquid crystal LC. By way of example, the protective film PSV2 is formed of a transparent resin material such as acrylic resin or epoxy resin.

The common transparent pixel electrode ITO2 opposes to the transparent pixel electrode ITO1 which is provided every pixel on the side of the lower transparent glass substrate SUB1. The optical state of the liquid crystal LC changes in response to the potential difference (electric field) between each pixel electrode ITO1 and the common transparent pixel electrode ITO2. A common voltage $V_{com}$ is applied to the common transparent pixel electrode ITO2. In this embodiment, the common voltage $V_{com}$ is set at the intermediate D.C. potential between a drive voltage $V_{dmin}$ of minimum level and a drive voltage $V_{dmax}$ of maximum level which are applied to the video signal line DL. However, in a case where the supply voltage of an integrated circuit for use in a video signal driver circuit is to be reduced to about a half, an ALTERNATING voltage may be applied. Incidentally, the plan shape of the common transparent pixel electrode ITO2 is as shown in FIGS. 48 and 49.

The transparent pixel electrode ITO1 is formed so as to overlap the adjacent scanning signal line GL at its end opposite to its end which is connected with the thin-film transistor TFT. As also seen from FIG. 46, the overlap constructs the holding capacitance element $C_{add}$, one electrode PL2 of which is the transparent pixel electrode ITO1 and the other electrode PL1 of which is the adjacent scanning signal line GL. The dielectric film of the holding capacitance element $C_{add}$ is formed of the insulator film GI and anodic oxidation film AOF which are used as the gate insulator film of the thin-film transistor TFT.

The holding capacitance element $C_{add}$ is formed at the widened part of the the second conductor film g2 of the scanning signal line GL. Incidentally, the part of the second conductor film g2 intersecting the video signal line DL is fined in order to lower the probability of the short-circuiting of this conductor film with the video signal line DL.

Even when the transparent pixel electrode ITO1 has disconnected at the stepped part of the electrode PL2 of the holding capacitance element $C_{add}$, the defect of the disconnection is compensated by an island region which is configured of the second conductor film d2 and third conductor film d3 formed astride the step.

Figure 52A:
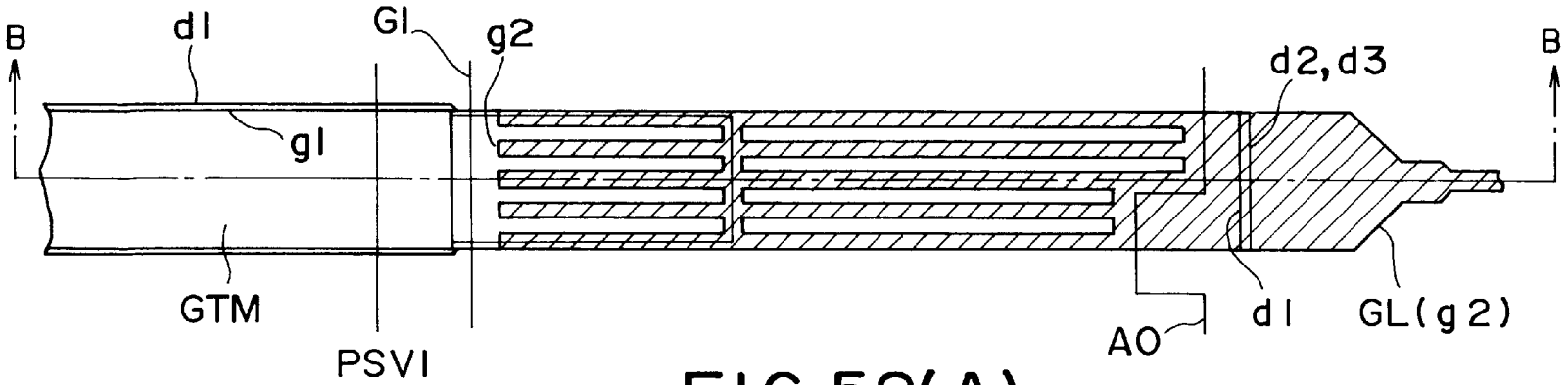
FIG. 52(A) and FIG. 52(B) are a plan view and a sectional view showing the vicinity of the connection parts of a gate terminal (GTM) and a gate wiring line (GL), respectively.
Figure 52B:
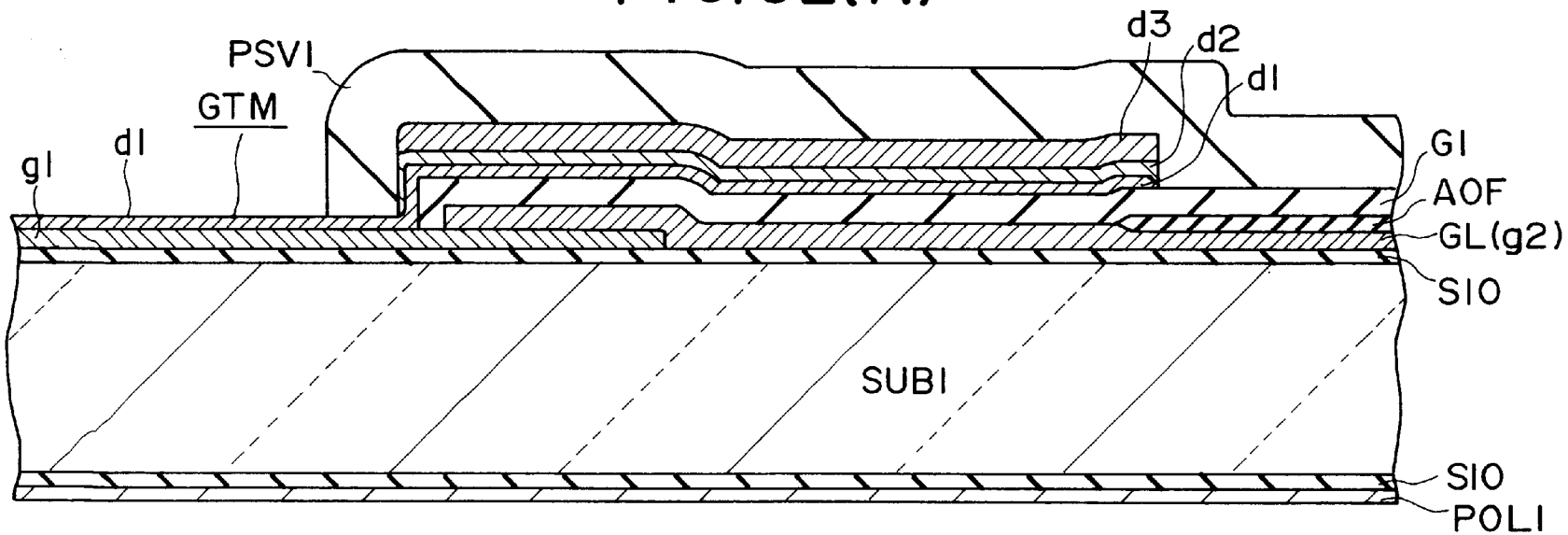

FIG. 52(A) is a plan view showing the structure of connection from the scanning signal line GL of the display matrix to the external connection terminal FTM thereof, while FIG. 52(B) is a sectional view taken along line B—B in FIG. 52(A). Incidentally, these figures correspond to the vicinity of the lower part of FIG. 49, and the oblique wiring parts are depicted straight for the sake of convenience.

Symbol AO denotes a mask pattern for a photolithographic step, in other words, a photoresist pattern for local anodic oxidation. Accordingly, the photoresist of the pattern AO is removed after the anodic oxidation, and the illustrated pattern AO does not remain in a finished product. As shown in FIG. 52(B), however, the traces of the pattern AO remain because the oxide film AOF is formed on the selected part of the gate wiring line GL. In FIG. 52(A), a left side with respect to the boundary line AO of the photoresist is a region which is covered with the resist and is not subjected to the anodic oxidation, whereas a right side is a region which is not covered with the resist and is subjected to the anodic oxidation. On account of the anodic oxidation, the AL layer g2 has its surface formed with the oxide ($Al_2O_3$) film AOF, and the lower conductor part thereof has its volume decreased. Of course, the anodic oxidation is carried out by setting the appropriate conditions of a time period, a voltage etc. so that the conductor part may be properly left behind. The mask pattern (anodic oxidation mask) AO does not intersect the scanning line GL as a single straight line, but intersects it in a crank-like bent shape.

The Al layer g2 in FIG. 52(A) is hatched for better understanding, and parts which are not to be anodized is patterned in the shape of a comb. More specifically, when the Al layer is wide, whiskers appear on the surface thereof. Therefore, narrow Al lines are formed, and they are bundled in parallel. With this construction, it is intended to suppress the probability of disconnection and the degradation of electric conductivity to the least, whilst preventing the appearance of the whiskers. In this example, accordingly, the part of the Al layer g2 corresponding to the root of the comb is also staggered along the mask AO.

The gate terminal GTM is configured of a Cr layer g1 which exhibits a good adhesion with the silicon oxide layer SIO and the galvanic corrosion resistance of which is higher than those of Al etc., and the transparent conductor layer d1 which protects the surface of the Cr layer g1 and which lies at the same level as that of the pixel electrode ITO1 (the same layer formed at the same time). By the way, the conductor layers d2 and d3 formed on the upper surface and side surface of the gate insulator film GI remain as the result of the fact that, in etching the conductor layers d3 and d2, the remaining regions were covered with the photoresist so as to prevent the conductor layers g2 and g1 from being etched together due to pinholes etc. Besides, the ITO layer d1 extended rightwards over the gate insulator film GI renders a similar countermeasure more perfect.

In the plan view of FIG. 52(A), the gate insulator film GI is formed on the right side of the indicated boundary line thereof, and the protective film PSV1 is also formed on the right side of the indicated boundary line thereof. The terminal portion GTM located at the left end of the illustration is not covered with either of the films GI and PSV1, and can be brought into electrical contact with an external circuit. In FIGS. 52(A) and 52(B), only one pair consisting of the gate line GL and the gate terminal GTM is illustrated. In actuality, however, a plurality of such pairs are vertically arrayed as shown in FIG. 49, and the group of terminals Tg (in FIGS. 48 and 49) are constructed. In the manufacturing process of the liquid-crystal display system, the left ends of the gate terminals GTM are extended beyond the cutting position of the substrate and are short-circuited by a wiring line SHg. Such a short-circuiting line SHg in the manufacturing process serves to feed electric power during the anodization, and to prevent electrostatic breakdown during, e. g., the rubbing of the orientation film ORI1.

Figure 53A:
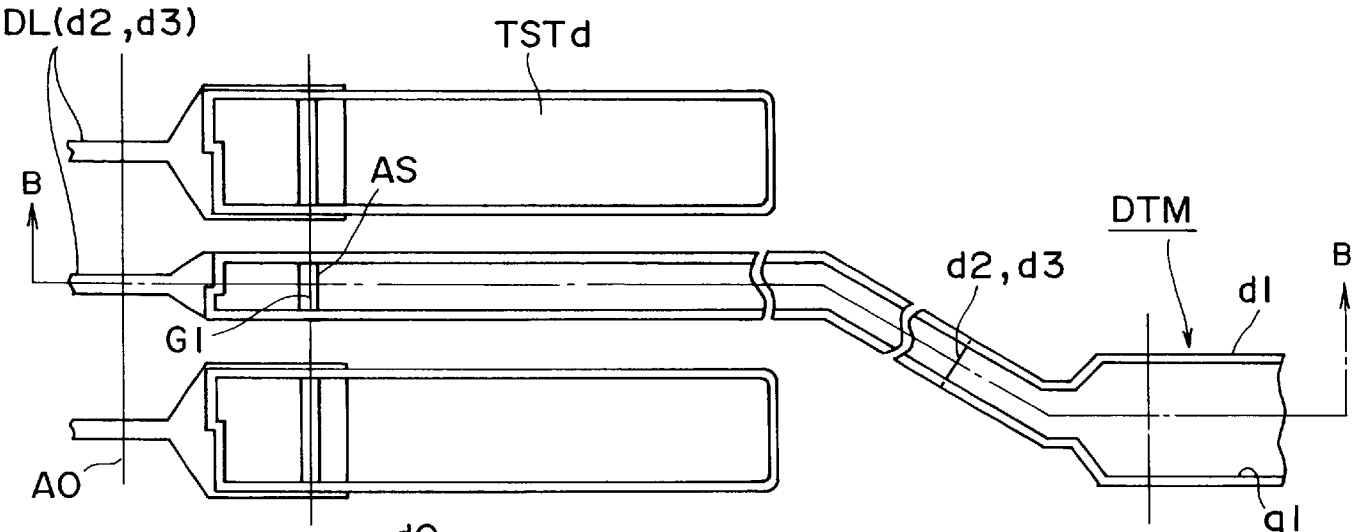
FIG. 53(A) and FIG. 53(B) are a plan view and a sectional view showing the vicinity of the connection parts of a drain terminal (DTM) and a video signal line (DL), respectively.
Figure 53B:
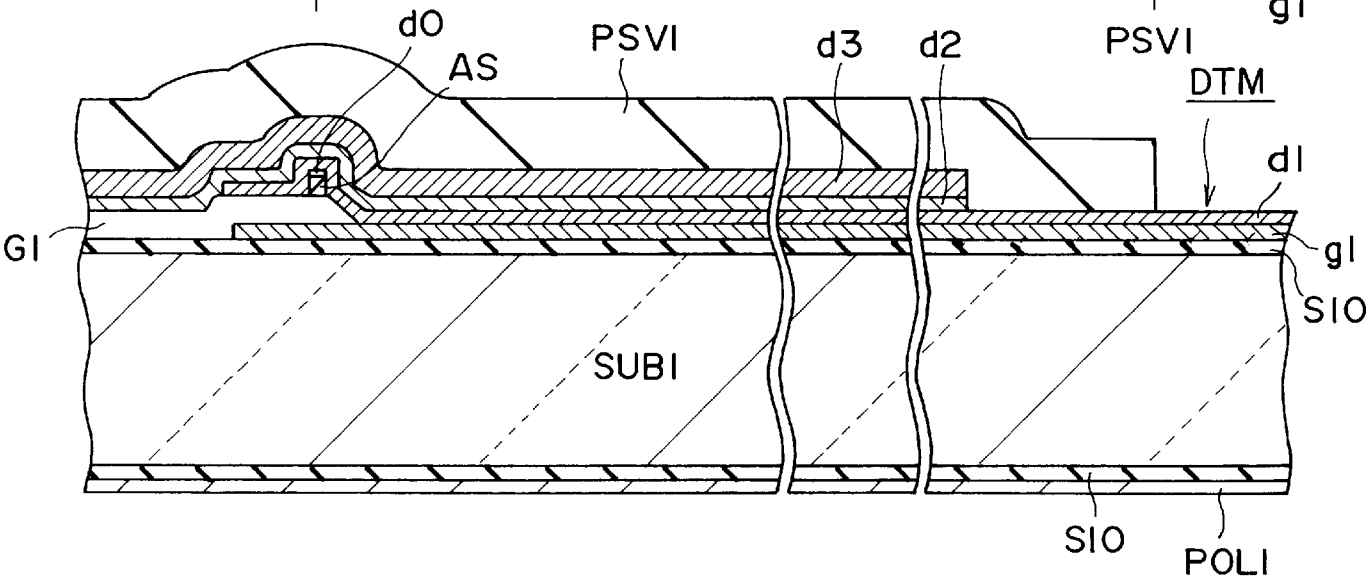

FIG. 53(A) is a plan view showing the connection from the video signal line DL to the external connection terminal (drain terminal) DTM, while FIG. 53(B) is a sectional view taken along line B—B in FIG. 53(A). These figures correspond to the vicinity of the right upper part of FIG. 49. Although the direction of FIGS. 53(A) and 53(B) is changed from that of FIG. 49 for the sake of convenience, the right ends of FIGS. 53(A) and 53(B) correspond to the upper end part (or lower end part) of the substrate SUB1.

Symbol TSTd denotes a test terminal, to which no external circuit is connected. The test terminal TSTd is made wider than the wiring portion so that a probe can be held in touch with this terminal. Likewise, the drain terminal DTM is also made wider than the wiring portion so that it can be connected with the external circuit. The plurality of test terminals TSTd and external connection terminals DTM are alternately arrayed zigzag in the vertical direction. As shown in FIGS. 53(A) and 53(B), the test terminals TSTd terminate without reaching the end part of the substrate SUB1. As shown in FIG. 49, the drain terminals DTM constitute the group of terminals Td. They are extended beyond the cutting line CT1 of the substrate SUB1, and all of them are short-circuited by a wiring line SHd in order to prevent the electrostatic breakdown during the manufacturing process. The drain terminals DTM are connected on a side (not shown in FIG. 49, and lying below the illustration of this figure) opposite to the test terminals TSTd with the matrix portion AR of the video signal lines DL interposed therebetween. To the contrary, the test terminals TSTd are connected on a side opposite to the drain terminals DTM with the matrix portion AR of the video signal lines DL interposed therebetween.

The drain terminal DTM is formed of the two layers of the Cr layer g1 and the ITO layer d1 for the same reasons as stated on the gate terminal GTM before, and it is connected with the video signal line DL at the part at which the gate insulator film GI has been removed. The semiconductor layer AS formed on the end part of the gate insulator film GI serves to etch the edge of this film GI in a tapered shape. The protective film PSV1 is, of course, removed on the terminal DTM in order to connect this terminal DTM with the external circuit. Symbol AO denotes the anodic oxidation mask explained before. The boundary line of the mask AO is set so as to sufficiently surround the whole matrix. In FIG. 53(A), the left side of the boundary line is covered with the mask. Since the layer g2 does not exist at a nonmasked part in the figure, the illustrated pattern is not directly pertinent.

As also shown in FIG. 50(C), a lead-out wiring line from the matrix portion to the drain terminal DTM has a structure in which the layers d2, d3 at the same level as that of the video signal line DL are stacked to the intermediate position of the seal pattern SL directly on the layers d1, g1 at the same level as that of the drain terminal DTM. The structure is intended to suppress the probability of disconnection to the minimum, and to protect the Al layer d3 easy of galvanic corrosion with the protective film PSV1 and the seal pattern SL as far as possible.

Figure 54:
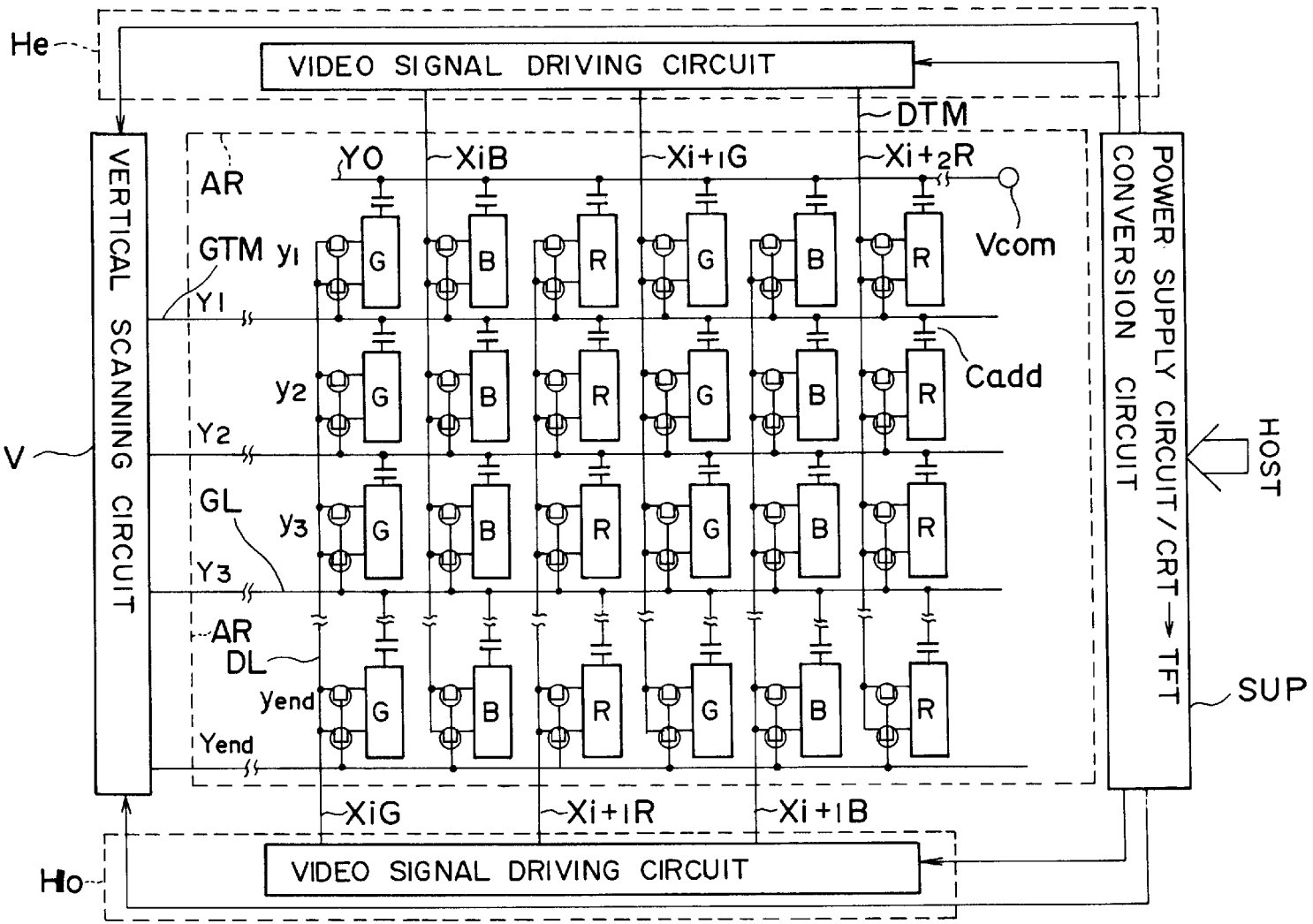
FIG. 54 is a circuit diagram showing the matrix portion of the color liquid-crystal display system of the active matrix type and the surroundings thereof.

FIG. 54 shows the equivalent circuit of the display matrix portion and the connections of the peripheral circuits thereof. Although the figure is a circuit diagram, it is depicted in correspondence with an actual geometrical arrangement. Symbol AR denotes the matrix array in which the plurality of pixels are arrayed in two dimensions.

In the figure, letter X signifies the video signal lines DL, and suffixes G, B and R are respectively assigned in correspondence with the green, blue and red pixels. Letter Y signifies the scanning signal lines GL, and suffixes 1, 2, 3, . . . , and end are assigned in the sequence of scanning timings.

The video signal lines X are alternately connected to the upper (or even-numbered) video signal driver circuit He and the lower (or odd-numbered) video signal driver circuit $H_o$.

The scanning signal lines Y are connected to a vertical scanning circuit V.

Shown at symbol SUP is circuitry including a power supply circuit by which a plurality of divided and stabilized supply voltages are produced from a single supply voltage, and a circuit by which information for a CRT (cathode-ray tube) as sent from a host (host processor) is converted into information for the TFT liquid-crystal display system.

When the thin-film transistor TFT switches, the holding capacitance element $C_{add}$ operates to relieve the influence of a gate potential change $\Delta V_g$ on a midpoint potential (pixel electrode potential) $V_{lc}$. This situation is formularized as follows:

$$\Delta V_{lc}=\{C_{gs}/(C_{gs}+C_{add}+C_{pix})\}\times\Delta V_g$$

Here, $C_{gs}$ denotes a parasitic capacitance which develops between the gate electrode GT and source electrode SD1 of the thin-film transistor TFT, $C_{pix}$ denotes a capacitance which develops between the transparent pixel electrode ITO1(PIX) and the common transparent pixel electrode ITO2(COM), and $\Delta V_{lc}$ denotes the variation of the pixel electrode potential $V_{lc}$ attributed to the gate potential change $\Delta V_g$. Although the variation $\Delta V_{lc}$ forms the cause of a D.C. component acting on the liquid crystal LC, the value thereof can be made smaller as the holding capacitance $C_{add}$ is enlarged more. Besides, the holding capacitance element $C_{add}$ has the function of prolonging a discharging time period, and video information after the turn-OFF of the thin-film transistor TFT is stored for long. The reduction of the D.C. component to be applied to the liquid crystal LC can enhance the service life of the liquid crystal LC, and can relieve so-called baking in which a preceding picture remains when liquid-crystal display pictures have been changed-over.

As stated before, the gate electrode GT is made larger so as to cover the i-type semiconductor layer AS entirely. The area of the gate electrode GT overlapping the source electrode SD1 and the drain electrode SD2 increases to that extent. Accordingly, there arises the evil effect that the parasitic capacitance Cgs enlarges, so the midpoint potential $V_{lc}$ becomes susceptible to the gate (scanning) signal $V_g$. The demerit, however, can be eliminated by providing the holding capacitance element $C_{add}$.

The holding capacitance of the holding capacitor $C_{add}$ is set at a value which is approximately 4–8 times the liquid-crystal capacitance $C_{pix}$ ($4\cdot C_{pix}<C_{add}<8\cdot C_{pix}$) and approximately 8–32 times the parasitic capacitance $C_{gs}$ ($8\cdot C_{gs}<C_{add}<32\cdot C_{gs}$), on the basis of the write characteristics of the pixels.

The scanning signal line of first stage GL($Y_o$) which is used only as a holding capacitance electrode line, is set at the same potential as that of the common transparent pixel electrode ITO2 ($V_{com}$). In the example of FIG. 49, the first-stage scanning signal line GL($Y_o$) is short-circuited to the common electrode COM through the terminal GT0, the lead-out line INT, the terminal DT0 and an external wiring line (not shown). The terminal GT0 and the lead-out line INT are connected by the external wiring line. Alternatively, the first-stage holding capacitance electrode line $Y_o$ may be connected to the scanning signal line of last stage $Y_{end}$ or to any D.C. potential point (ALTERNATING ground point) other than the common electrode $V_{com}$, or it may well be connected so as to receive one additional scanning pulse $Y_o$ from the vertical scanning circuit V.

Next, a method of manufacturing the substrate SUB1 side of the above liquid-crystal display system will be described with reference to FIGS. 55–57. In these figures, letters in middle parts indicate the simplified names of processes, left sides illustrate the flow of fabrication as seen on the sections of the pixel portion shown in FIG. 45, and right sides illustrate the flow of fabrication as seen on the sections of the vicinity of the gate terminal shown in FIGS. 52(A) and 52(B). The processes A–I except the process D are sorted out in correspondence with individual photolithographic steps. The sectional views of any of the processes illustrate a stage at which a step (steps) subsequent to the photolithographic step has (have) ended, so a photoresist has been removed. Incidentally, the "photolithographic step" in the description here shall signify a series of jobs which include the coating of a substrate structure with the photoresist, the selective exposure of the photoresist employing a mask, and the development of the photoresist exposed to light, and the jobs shall not be repeatedly explained. Now, the manufacturing method will be elucidated along the processes sorted out.

Figure 55:
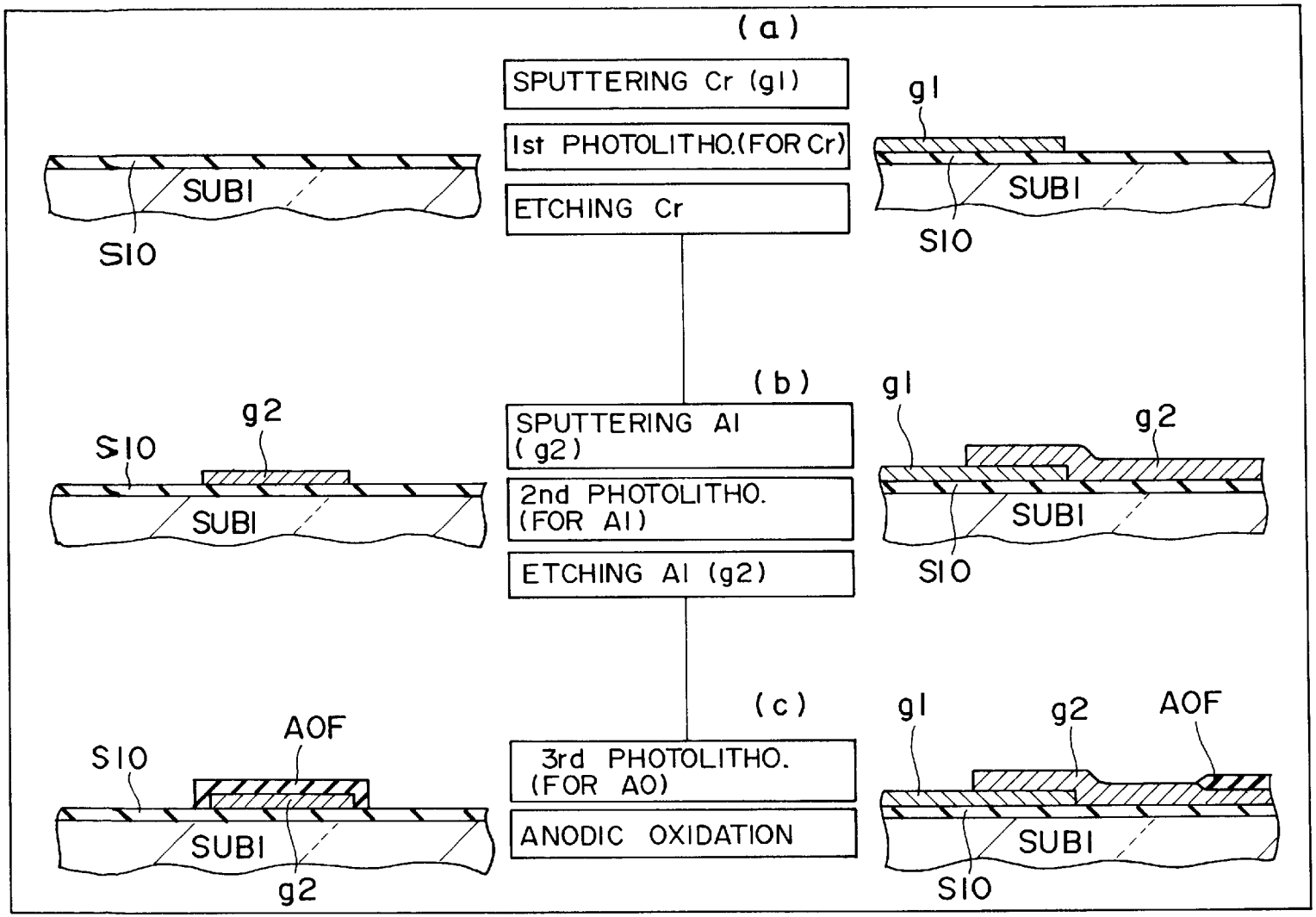
FIG. 55 is a flow chart with sectional views of the pixel portion and the gate terminal portion, showing the manufacturing steps of processes (a) to (c) on the side of the substrate (SUB1)

Process (A), FIG. 55:

Both the surfaces of a lower transparent glass substrate SUB1 made of "7059 Glass" (trade name) are provided with silicon oxide films SIO by dipping.

Thereafter, the resultant structure is baked at 500 [° C.] for 60 [min.]. The first conductor film g1 made of chromium at a thickness of 1100 [Å] is deposited on the lower transparent glass substrate SUB1 by sputtering. After the first photolithographic step, the first conductor film g1 is selectively etched using a solution of ceric ammonium nitrate as an etchant. Thus, there are formed gate terminals GTM, drain terminals DTM, an anodic oxidation bus line SHg which connects the gate terminals GTM, a bus line SHd which short-circuits the drain terminals DTM, and an anodic oxidation pad (not shown) which is connected to the anodic oxidation bus line SHg.

Process B, FIG. 55:

The second conductor film g2 made of Al—Pd, Al—Si, Al—Si—Ti, Al—Si—Cu or the like and having a thickness of 2800 [Å] is deposited by sputtering. After the second photolithographic step, the second conductor film g2 is selectively etched with a mixed acid solution which consists of phosphoric acid, nitric acid and glacial acetic acid.

Process C, FIG. 55:

After the third photolithographic step (after the formation of an anodic oxidation mask AO as explained before), the resultant substrate SUB1 is immersed in an anodic oxidation solution. Herein, the anodic oxidation solution is a liquid prepared in such a way that a solution of 3%-tartaric acid adjusted to a pH-value of 6.25±0.05 with ammonia is diluted to 1:9 with ethylene glycol. In the immersion, a forming current density is adjusted so as to become 0.5 [A/cm$^2$] (constant-current formation). Subsequently, anodic oxidation is carried out until a forming voltage of 125 [V] necessary for obtaining an $Al_2O_3$ film of predetermined thickness is reached. It is desirable that the substrate structure is thereafter held in this state for several tens [min.] (constant-voltage formation). This is important for producing a uniform $Al_2O_3$ film. Thus, the conductor film g2 undergoes the anodic oxidation, and each anodic oxidation film AOF having a thickness of 1800 [Å] is formed on a scanning signal line GL, a gate electrode GT and an electrode PL1.

Figure 56:
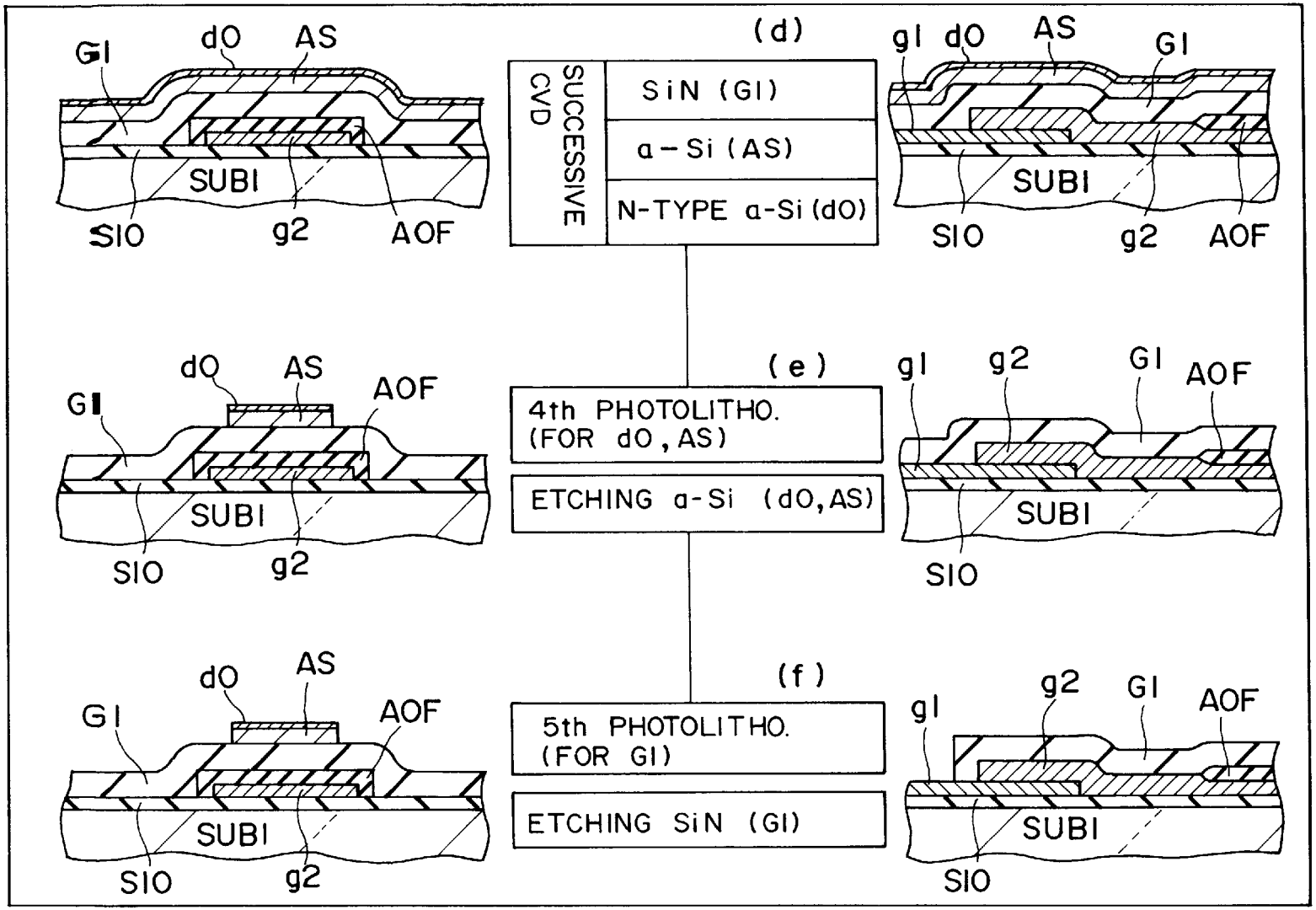
FIG. 56 is a flow chart with sectional views of the pixel portion and the gate terminal portion, showing the manufacturing steps of processes (d) to (f) on the side of the substrate (SUB1)

Process D, FIG. 56:

A silicon nitride film GI having a thickness of 2000 [Å] is deposited on the resultant substrate by introducing ammonia gas, silane gas and nitrogen gas into a plasma CVD device. Subsequently, an i-type amorphous silicon film AS having a thickness of 2000 [Å] is deposited by introducing silane gas and hydrogen gas into the plasma CVD device. Thereafter, an N(+)-type amorphous silicon film d0 having a thickness of 300 [Å] is deposited by introducing hydrogen gas and phosphine gas into the plasma CVD device.

Process E, FIG. 56:

After the fourth photolithographic step, the N(+)-type amorphous silicon film d0 and the i-type amorphous silicon film AS are selectively etched using $SF_6$ and $CCl_4$ as dry etching gases, respectively. Thus, the islands of the i-type semiconductor layer AS are formed.

Process F, FIG. 56:

After the fifth photolithographic step, the silicon nitride film GI is selectively etched using SF6 as a dry etching gas.

Figure 57:
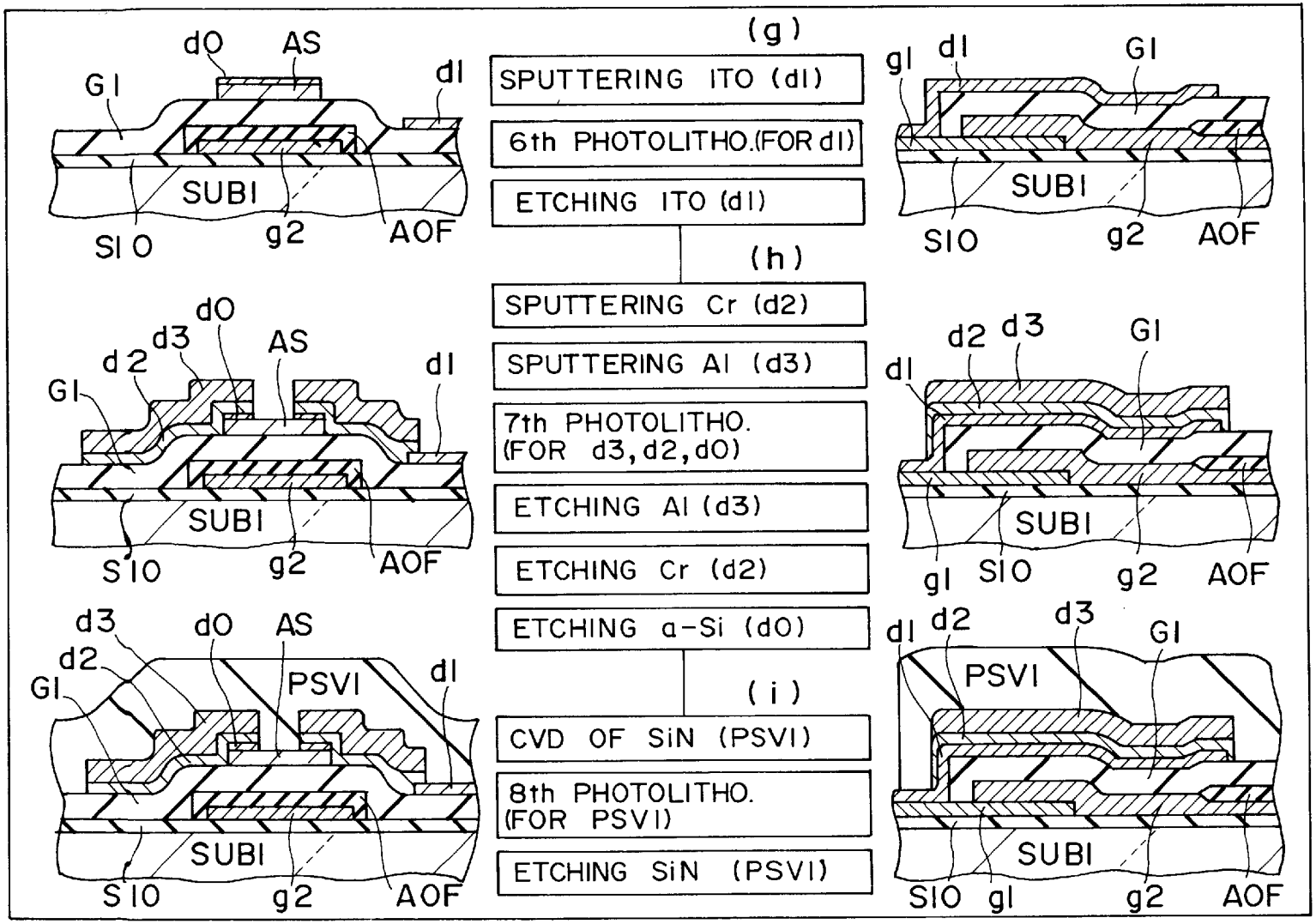
FIG. 57 is a flow chart with sectional views of the pixel portion and the gate terminal portion, showing the manufacturing steps of processes (g) to (i) on the side of the substrate (SUB1)

Process G, FIG. 57:

The first conductor film d1 made of an ITO film at a thickness of 1400 [Å] is deposited by sputtering. After the sixth photolithographic step, the first conductor film dl is selectively etched using a mixed acid solution consisting of hydrochloric acid and nitric acid, as an etchant. Thus, the uppermost layers of each gate terminal GTM and each drain terminal DTM, and each transparent pixel electrode ITO1 are formed.

Process H, FIG. 57:

The second conductor film d2 made of Cr at a thickness of 600 [Å] is deposited by sputtering. Further, the third conductor film d3 made of Al—Pd, Al—Si, Al—Si—Ti, Al—Si—Cu or the like at a thickness of 4000 [Å] is deposited by sputtering. After the seventh photolithographic step, the third conductor film d3 is etched with the same solution as in the process B, and the second conductor film d2 is etched with the same solution as in the process A, thereby forming video signal lines DL, source electrodes SD1 and drain electrodes SD2. Subsequently, the N(+)-type amorphous silicon film d0 is etched by introducing $CCl_4$ and SF6 into a dry etching device, thereby removing the selected parts of the N(+)-type amorphous silicon film d0.

Process I, FIG. 57:

A silicon nitride film having a thickness of 1 [μm] is deposited by introducing ammonia gas, silane gas and nitrogen gas into the plasma CVD device. After the eighth photolithographic step, the silicon nitride film is selectively etched by a photoetching technique which uses $SF_6$ as a dry etching gas. Thus, a protective film PSV1 is formed.

Figure 58:
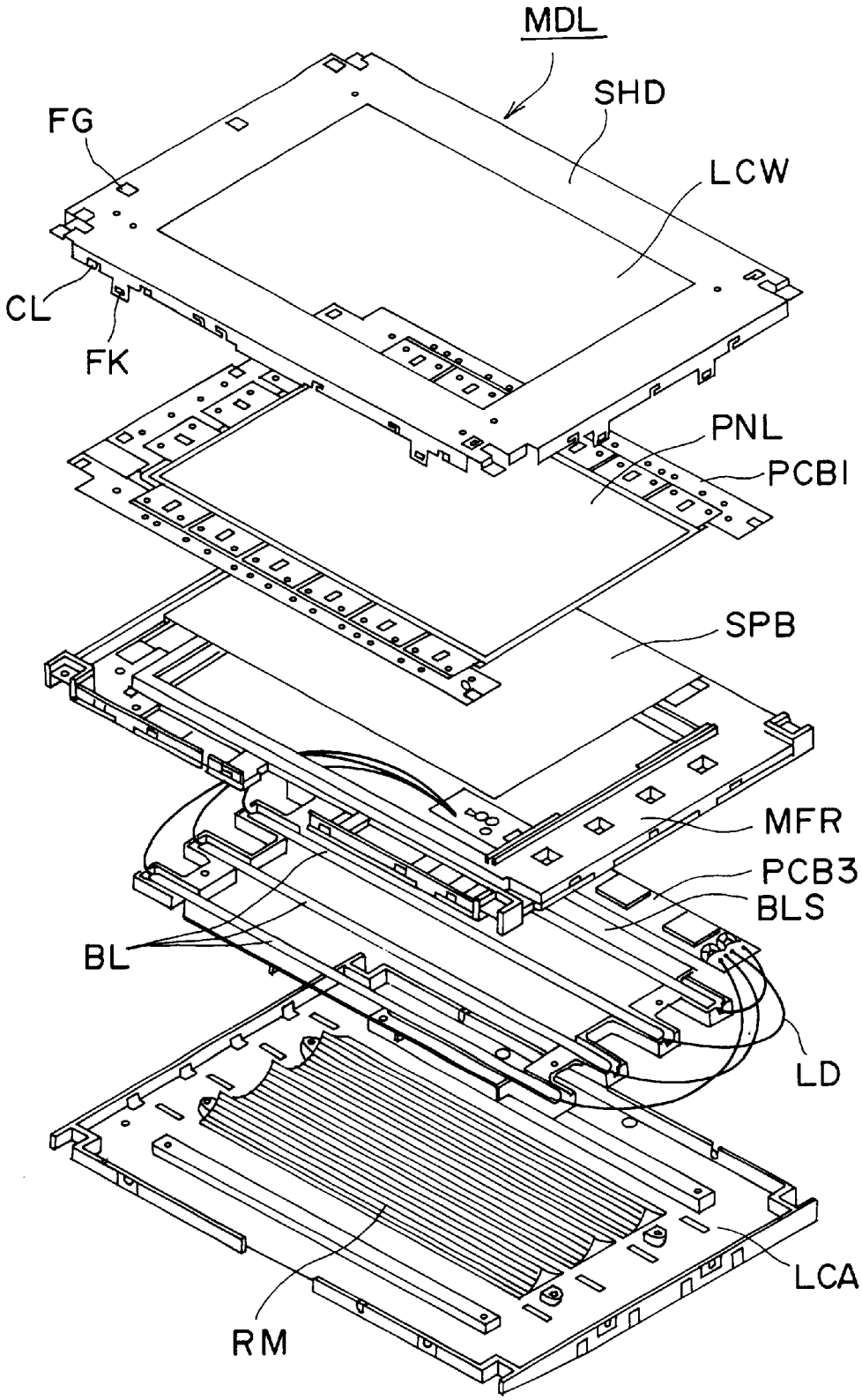
FIG. 58 is an exploded perspective view of a liquid-crystal display module.

FIG. 58 is an exploded perspective view showing the constituent components of a liquid-crystal display module MDL.

Symbol SHD denotes a frame-shaped shield case (metal frame) made of a metal plate, symbol LCW a display window provided in the shield case SHD, symbol PNL a liquid-crystal display panel, symbol SPB a light diffusion plate, symbol MFR a middle frame, symbol BL back light, symbol BLS a back light supporter, and symbol LCA a lower case. The module MDL is assembled by stacking the individual members in a vertical arrangement relationship as shown in the figure.

The module MDL is entirely fixed by claws CL and hooks FK which are provided in the shield case SHD.

The middle frame MFR is formed in a frame shape so as to be provided with an opening which corresponds to the display window LCW. The frame part of the middle frame MFR is provided with the diffusion plate SPB, the back light supporter BLS, rugged parts corresponding to the shapes and thicknesses of various circuit components, and openings for heat radiation.

The lower case LCA serves also as a reflector for the back light. It is formed with reflection mountains RM in correspondence with fluorescent lamps BL so as to realize efficient reflection.

Figure 59:
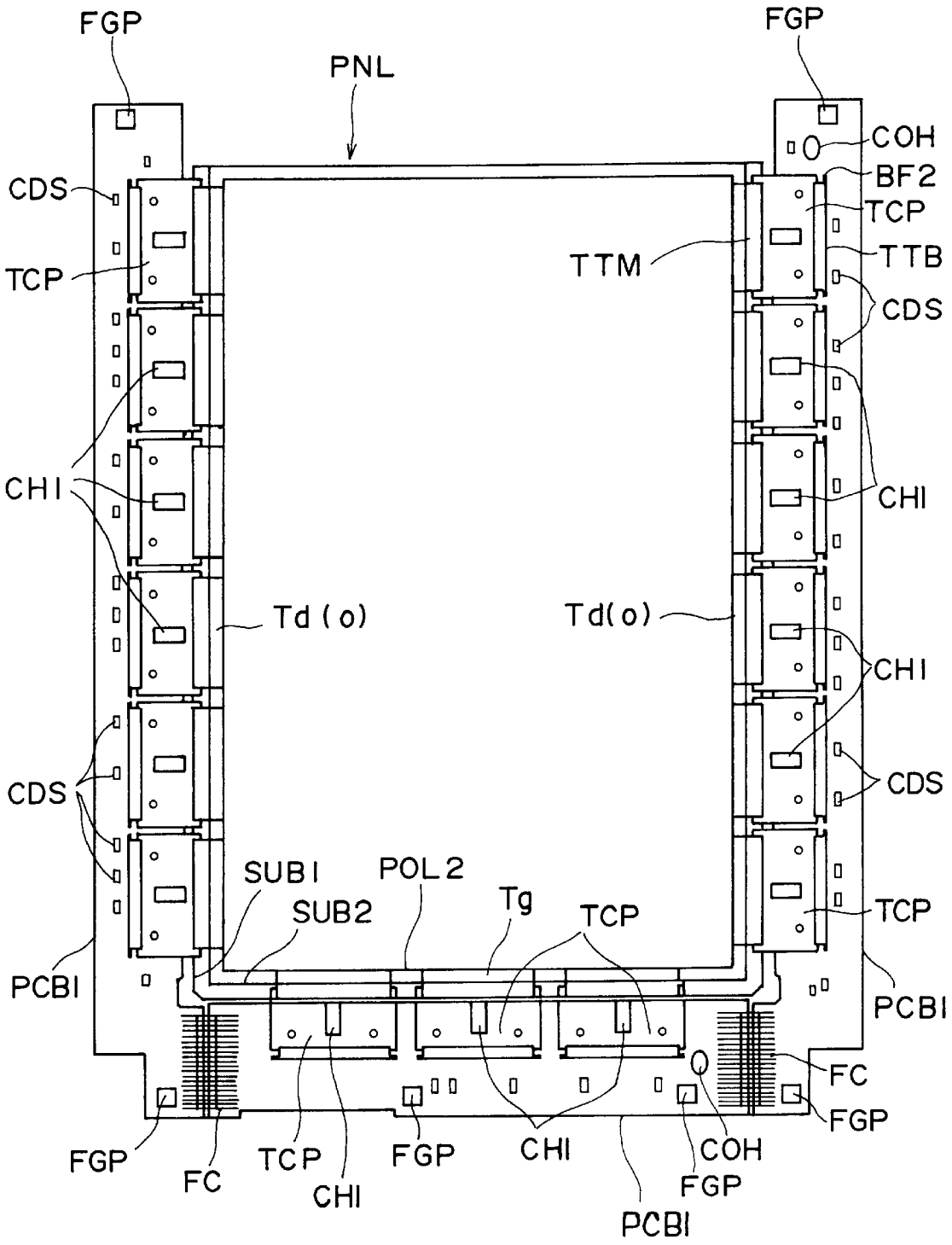
FIG. 59 is a top plan view showing the state in which peripheral driver circuits are mounted on the liquid-crystal display panel.

FIG. 59 is a top view showing the state in which the video signal driver circuits He, Ho and the vertical scanning circuit V are connected to the display panel PNL shown in, e. g., FIG. 58.

Symbol CHI denote driver IC chips which drive the display panel PNL (three chips at a lower part are driver IC chips on the vertical scanning circuit side, and six chips at each of right and left parts are driver IC chips on the video signal driver circuit side in the first, second, third, fourth, fifth, sixth, ninth, tenth or thirteenth embodiment to which the present invention is applied). Symbol TCP denotes tape carrier packages in which the driver IC chips CHI are respectively mounted by the tape automated bonding (TAB) as will be explained later with reference to FIGS. 60 and 61. Symbol PCB1 denotes a driver circuit board on which the tape carrier packages TCP, capacitors CDS, etc. are mounted, and which is divided into three parts. Symbol FGP denotes frame g1 and pads, to which spring-like fragments FG (shown in FIG. 58) provided by cutting in the shield case SHD are soldered. Symbol FC denotes flat cables which electrically connect the lower driver circuit board PCB1 and left driver circuit board PCB1, and the lower driver circuit board PCB1 and right driver circuit board PCB1, respectively. The flat cable FC used is such that, as shown in the figure, a plurality of leads (a starting material of phosphor bronze is plated with Sn (tin)) are supported by a polyethylene layer and a polyvinyl alcohol layer of striped pattern in sandwiched fashion.

Figure 60:
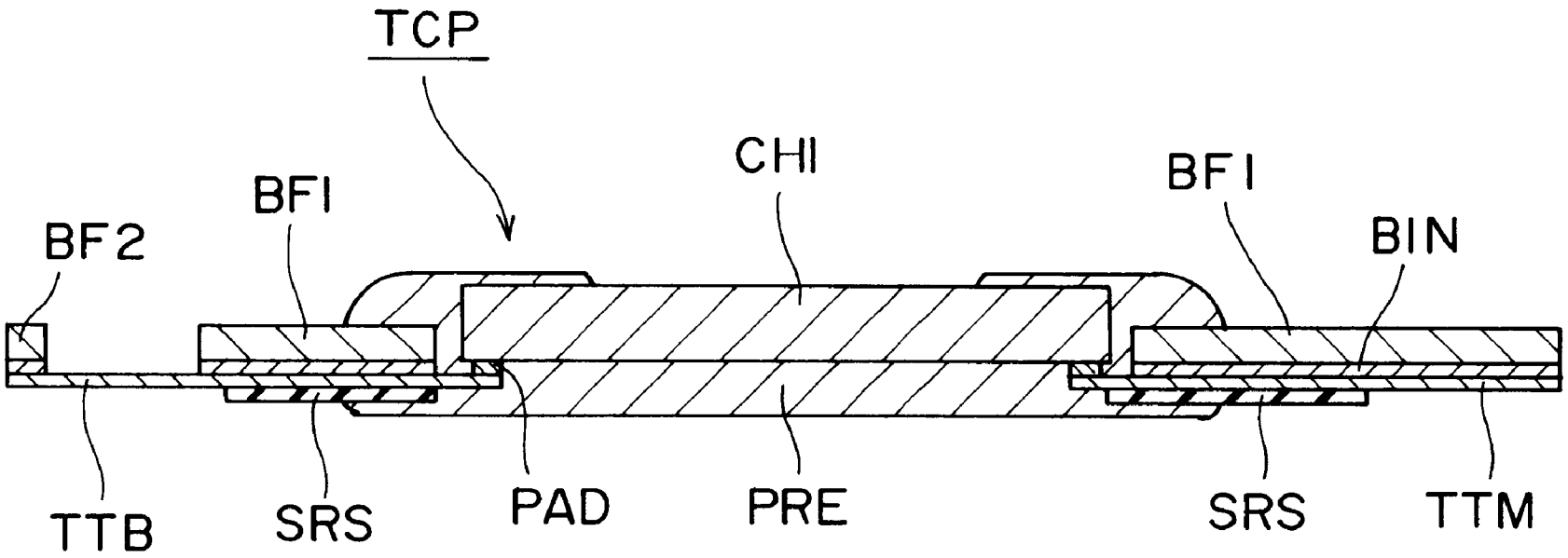
FIG. 60 is a view showing the sectional structure of the tape carrier package (TCP) in which an integrated circuit chip (CHI) constituting the driver circuit is carried on a flexible wiring circuit board.

FIG. 60 is a view showing the sectional structure of the tape carrier package TCP in which the integrated circuit chip CHI constituting the scanning signal driver circuit V or video signal driver circuits He, Ho is mounted on a flexible printed wiring circuit board. On the other hand, FIG. 61 is a sectional view of essential portions showing the state in which the tape carrier package TCP is connected to the liquid-crystal display panel, in this example, to the video signal circuit terminal DTM thereof.

Figure 61:
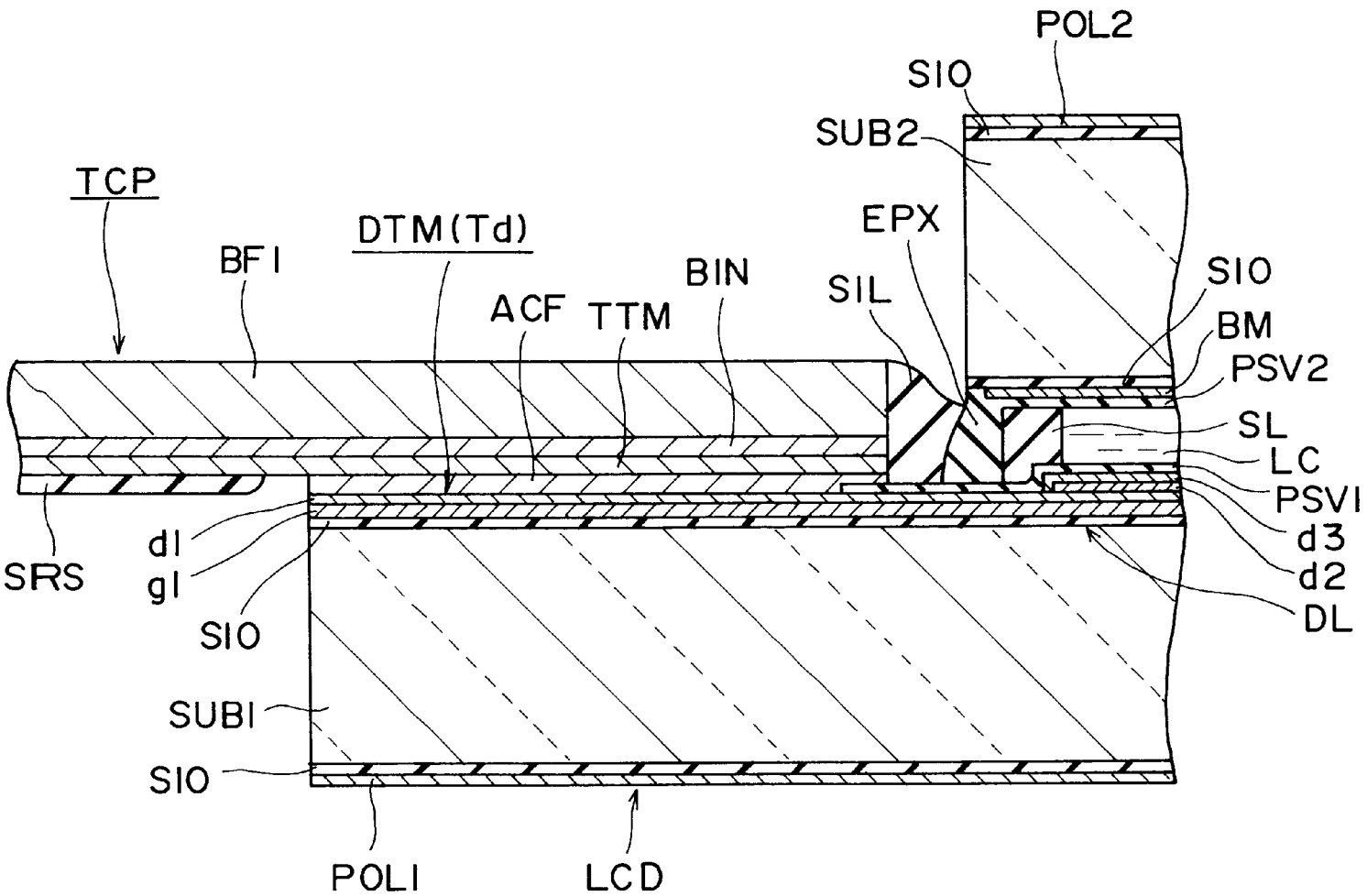
FIG. 61 is a sectional view of essential parts showing the state in which the tape carrier package (TCP) is connected to the video signal circuit terminal (DTM) of the liquid-crystal display panel (PNL)

In FIGS. 60 and 61, symbol TTB denotes the input terminal/wiring portion of the integrated circuit CHI, and symbol TTM the output terminal/wiring portion of the integrated circuit CHI. The portions TTB and TTM are made of, for example, Cu (copper). The bonding pad PAD of the integrated circuit CHI is connected to the inner front end (usually called "inner lead") of each of the terminals TTB and TTM by so-called face down bonding. The outer front ends (usually called "outer leads") of the terminals TTB and TTM correspond to the input and output of the semiconductor integrated circuit chip CHI, respectively. They are connected to the CRT-TFT conversion circuit/power supply circuit SUP (FIG. 54) by soldering or the like, and to the liquid-crystal display panel PNL by an anisotropic conductor film ACF, respectively. The package TCP has its front end connected to the panel PNL so as to cover the protective film PSV1 from which the connection terminal DTM on the panel PNL side is denuded. Accordingly, the external connection terminal DTM (GTM) is covered with at least one of the protective film PSV1 and the package TCP, and it becomes immune against galvanic corrosion.

Symbol BF1 represents a base film made of polyimide or the like, and symbol SRS a solder-resist film as a mask which prevents a solder from adhering to an improper place in the soldering operation. The clearance between the upper and lower glass substrates outside the seal pattern SL is protected with, e. g., an epoxy resin EPX after washing. Further, the space between the package TCP and the upper substrate SUB2 is filled with a silicone resin SIL. Thus, the multiple protection is done.

Figure 62:
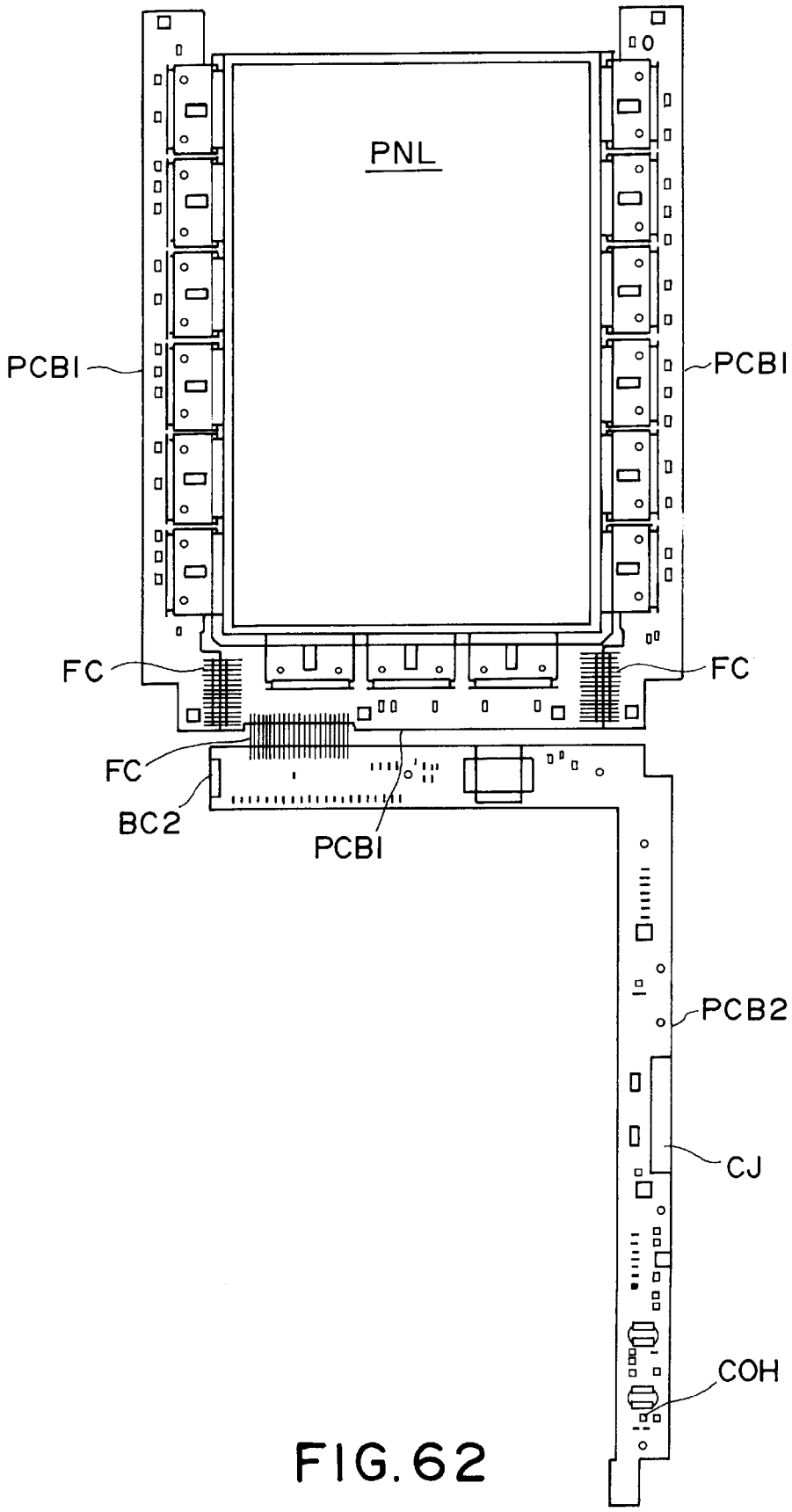
FIG. 62 is a top plan view showing the connected state of a peripheral driver circuit board (PCB1 whose upper surface is seen) and a power source circuit board (PCB2 whose lower surface is seen)

As shown in FIG. 62, that driver circuit board PCB2 of the liquid-crystal display portion LCD which is held by and received in the middle frame MFR is in the shape of letter L, and electronic components such as IC's, capacitors and resistors are mounted thereon. The driver circuit board PCB2 carries thereon the circuitry SUP including the power supply circuit which produces the plurality of divided and stabilized supply voltages from the single supply voltage, and the circuit by which the information for the CRT (cathode-ray tube) as sent from the host (host processor) is converted into the information for the TFT liquid-crystal display system. Symbol CJ indicates a connector connection portion to which a connector, not shown, to be externally connected is connected. The driver circuit board PCB2 and an inverter circuit board PCB3 are electrically connected by a back light cable through a connector hole provided in the middle frame MFR.

The driver circuit board PCB1 and the driver circuit board PCB2 are electrically connected by the bendable flat cables FC. In the assembling operation, the driver circuit board PCB2 is placed on the rear side of the driver circuit board PCB1 by bending the flat cables FC an angle of 180°, and it is fitted into the predetermined recess of the middle frame MFR.

Owing to such a construction, the liquid-crystal driver employing the liquid-crystal driving circuit of the present invention can be operated.

According to the present invention, various effects are produced as stated below.

One voltage selected from among N voltages without the intervention of any resistance element is delivered by selection means directly through no buffer means, whereby an output impedance can be lowered, and a liquid-crystal panel can be driven at high speed. That is, in a case where a capacitive load is driven directly by the voltage divider of an X driver circuit having a voltage divider circuit, charging/discharging time periods can be shortened. Further, it becomes possible to drive a high-definition liquid-crystal display system of at least 1280×1024 dots and a large-screen liquid-crystal display system of at least 20 inches which necessitate higher resistances and shorter charging/discharging time periods than in a present-day liquid-crystal display system.

In addition, since resistances need not be lowered in a voltage divider circuit which divides voltages by the use of resistors, increase in power consumption can be minimized, and an output of high precision can be produced.

Besides, an output voltage width can be equalized to a supply voltage width.

Moreover, the magnitude of an output offset voltage can be controlled using the potential difference between two unequal voltages selected by selection means.

What is claimed is:

1. An X driver circuit into which display data to be displayed on a liquid-crystal panel is supplied, and which transmits a voltage corresponding to said display data to each data line of the liquid crystal panel, said X driver circuit comprising:

a voltage divider circuit provided for each data line, by which n voltages having n different voltage levels externally supplied are divided into m voltages having m different voltage levels (n<m, n and m are integers larger than 1) corresponding to said display data;

said voltage divider circuit including:

a first selector circuit which is supplied with the n voltages of n different voltage levels, and which selects and transmits two of the supplied n voltages, a first control circuit which controls said first selector circuit in accordance with said display data so as to select the two voltages, an output circuit which transmits either of a plurality of divisional voltages produced from the selected voltages and the supplied voltages, a second selector circuit which selects and transmits any of said plurality of divisional voltages and said supplied voltages, and a second control circuit which controls said second selector circuit under either of a voltage selection command externally supplied and a voltage selection command internally generated, so as to select the voltage to-be-transmitted from either of said supplied voltages and said plurality of divisional voltages corresponding to said display data;

wherein said voltage selection command is a command for selecting a higher one of said two voltages selected by said first selector circuit, during a first period, while it is a command for selecting the divisional voltage corresponding to said display data, during a second period subsequent to said first period.

2. An X driver circuit as defined in claim 1, further comprising:

a decoder which includes a plurality of output lines corresponding to said display data, which selects any of said plurality of output lines in accordance with said display data, and which supplies the selected output line with a signal indicative of the selection of said output line; and a gate circuit which operates upon receiving said voltage selection command to transmit the output of said decoder to said second control circuit during said second period.

3. A liquid-crystal display system for presenting displays, comprising:

said X driver circuit as defined in claim 2;

said liquid-crystal panel, including a plurality of scanning lines and said plurality of data lines;

a Y driver circuit by which one of the plurality of scanning lines to have a voltage applied thereto is selected, and which transmits the voltage to the selected one of the plurality of scanning lines;

a power source for said liquid-crystal displays, which supplies voltages to said Y driver circuit and said X driver circuit; and a control signal generator circuit which transmits said voltage selection command to said X driver circuit.

4. An X driver circuit as defined in claim 1, further comprising:

a latch circuit which accepts said display data;

a decoder which includes a plurality of output lines corresponding to said display data transmitted by said latch circuit, which selects any of said plurality of output lines in accordance with said display data, and which supplies the selected output line with a signal indicative of the selection of said output line; and a gate circuit which is interposed between said latch circuit and said decoder, which is supplied with lower bits of an output of said latch circuit, and which operates upon receiving said voltage selection command to transmit predetermined data during said first period and the supplied lower bits during said second period.

5. A liquid-crystal display system for presenting displays, comprising:

said X driver circuit as defined in claim 4;

said liquid-crystal panel, including a plurality of scanning lines and said plurality of data lines;

a Y driver circuit by which one of the plurality of scanning lines to have a voltage applied thereto is selected, and which transmits the voltage to the selected one of the plurality of scanning lines;

a power source for said liquid-crystal displays, which supplies voltages to said Y driver circuit and said X driver circuit; and a control signal generator circuit which transmits said voltage selection command to said X driver circuit.

6. An X driver circuit as defined in claim 1, further comprising:

an upper bit decoder which includes a plurality of output lines corresponding to upper bits of said display data, which selects any of said plurality of output lines in accordance with said upper bits, and which supplies the selected output line with a signal indicative of the selection of said output line; and a lower bit decoder which includes a plurality of output lines corresponding to lower bits of said display data, which selects any of said plurality of output lines in accordance with said lower bits, and which supplies the selected output line with a signal indicative of the selection of said output line;

said lower bit decoder operating upon receiving said voltage selection command to transmit predetermined data during said first period and a signal corresponding to the supplied supplied lower bits during said period.

7. A liquid-crystal display system for presenting displays, comprising:

said X driver circuit as defined in claim 6;

said liquid-crystal panel, including a plurality of scanning lines and said plurality of data lines;

a Y driver circuit by which one of the plurality of scanning lines to have a voltage applied thereto is selected, and which transmits the voltage to the selected one of the plurality of scanning lines;

a power source for said liquid-crystal displays, which supplies voltages to said Y driver circuit and said X driver circuit; and a control signal generator circuit which transmits said voltage selection command to said X driver circuit.

8. A liquid-crystal display system for presenting displays, comprising:

said X driver circuit as defined in claim 1;

said liquid-crystal panel, including a plurality of scanning lines and said plurality of data lines;

a Y driver circuit by which one of the plurality of scanning lines to have a voltage applied thereto is selected, and which transmits the voltage to the selected one of the plurality of scanning lines;

a power source for said liquid-crystal display, which supplies voltages to said Y driver circuit and said X driver circuit; and a control signal generator circuit which transmits said voltage selection command to said X driver circuit.

9. An X driver circuit into which display data to be displayed on a liquid-crystal panel is supplied, and which generates and transmits any of m liquid-crystal driving voltages having m different voltage levels corresponding to said display data to each data line of the liquid crystal panel, said X driver circuit comprising:

a voltage divider circuit provided for each data line, by which n voltages externally supplied are divided into m voltages having m different voltage levels ($n<m$, n and m are integers larger than 1) corresponding to said display data;

wherein said voltage divider circuit includes:

a first selector circuit which is supplied with the n voltages of n different voltage levels, and which selects and transmits two of the supplied n voltages, a first control circuit which controls said first selector circuit in accordance with said display data so as to select the two voltages, a resistance circuit which is supplied with the selected voltages at both of its ends, in which a plurality of resistor elements are connected in series, and which transmits either of a plurality of divisional voltages produced from the selected voltages, and the supplied voltages, and a second control circuit which controls said second selector circuit under a voltage selection command externally supplied, so as to select the voltage to-be-transmitted from either of said supplied voltages and said plurality of divisional voltages corresponding to said display data.

10. An X driver circuit as defined in claim 9, wherein a magnitude of an offset voltage which is determined by a difference between said two voltages selected by said first selector circuit is smaller than a predetermined value.

11. An X driver circuit as defined in claim 10, wherein a maximum one of said n voltages of n different voltage levels externally supplied is identical to a power source voltage of said X driver circuit.

12. An X driver circuit as defined in claim 11, wherein:

a plurality of such voltage divider circuits are connected in parallel; and said n voltages of n different voltage levels externally supplied are applied from both ends of said voltage divider circuits connected in parallel.

13. A liquid-crystal display system, comprising:

a plurality of X driver circuits as defined in claim 12;

a display panel to which voltages are applied by said X driver circuits; and a control signal generator circuit which transmits said voltage selection command.

14. A liquid-crystal display system, comprising:

a plurality of X driver circuits as defined in claim 11;

a display panel to which voltages are applied by said X driver circuits; and a control signal generator circuit which transmits said voltage selection command.

15. An X driver circuit as defined in claim 10, wherein:

a plurality of such voltage divider circuits are connected in parallel; and said n voltages of n different voltage levels externally supplied are applied from both ends of said voltage divider circuits connected in parallel.

16. A liquid-crystal display system, comprising:

a plurality of X driver circuits as defined in claim 15;

a display panel to which voltages are applied by said X driver circuits; and a control signal generator circuit which transmits said voltage selection command.

17. A liquid-crystal display system, comprising:

a plurality of X driver circuits as defined in claim 10;

a display panel to which voltages are applied by said X driver circuits; and a control signal generator circuit which transmits said voltage selection command.

18. An X driver circuit as defined in claim 9, wherein a maximum one of said n voltages of n different voltage levels externally supplied is identical to a power source voltage of said X driver circuit.

19. An X driver circuit as defined in claim 18, wherein:

a plurality of such voltage divider circuits are connected in parallel; and said n voltages of n different voltage levels externally supplied are applied from both ends of said voltage divider circuits connected in parallel.

20. A liquid-crystal display system, comprising:

a plurality of X driver circuits as defined in claim 19;

a display panel to which voltages are applied by said X driver circuits; and a control signal generator circuit which transmits said voltage selection command.

21. A liquid-crystal display system, comprising:

a plurality of X driver circuits as defined in claim 18;

a display panel to which voltages are applied by said X driver circuits; and a control signal generator circuit which transmits said voltage selection command.

22. An X driver circuit as defined in claim 9, wherein:

a plurality of such voltage divider circuits are connected in parallel; and said n voltages of n different voltage levels externally supplied are applied from both ends of said voltage divider circuits connected in parallel.

23. A liquid-crystal display system, comprising:

a plurality of X driver circuits as defined in claim 22;

a display panel to which voltages are applied by said X driver circuits; and a control signal generator circuit which transmits said voltage selection command.

24. A liquid-crystal display system, comprising:

a plurality of X driver circuits as defined in claim 9;

a display panel to which voltages are applied by said X driver circuits; and a control signal generator circuit which transmits said voltage selection command. for selecting a higher one of said two voltages selected by said first selector circuit, during a first period, while it is a command for selecting the divisional voltage corresponding to said video data, during a second period subsequent to said first period.

25. A liquid-crystal display system for tonal displays, including:

a liquid-crystal panel having a plurality of scanning lines and a plurality of data lines;

a Y driver circuit by which one of the plurality of scanning lines to have a voltage applied thereto is selected, and which transmits the voltage to the selected one of the plurality of scanning lines;

an X driver circuit which is supplied with display data, and which transmits a voltage corresponding to the display data to each of the plurality of data lines;

a power source, which supplies voltages to the Y driver circuit and the X driver circuit, the supply voltages of the X driver circuit being n voltages having different n voltage levels;

a control signal generator circuit for generating a time signal which divides one horizontal scanning cycle into a first period and a subsequent second period;

wherein said X driver circuit includes a voltage divider circuit which generates m voltages having m different voltage levels from said n voltages of n different voltage levels supplied from said power source ($n<m$, wherein n and m are integers greater than 2) and outputs a voltage selected from said m voltages; and a control circuit, supplied with said time signal and a signal corresponding to said display data, which controls said voltage divider circuit so that a first voltage is selected from said m voltages in said first period, and a second voltage (may be) is selected in said second period from said m voltages, in response to said time signal and said signal corresponding to said display data, in a manner that a time constant, when said first voltage is output to the data lines, is smaller than a time constant when said second voltage is output to the data lines, said second voltage corresponding to said display data;

wherein said X driver circuit outputs said first voltage and said second voltage, as selected, to each of the data lines in said first period and said second period, respectively.

26. A liquid-crystal display system according to claim 25, said circuit for controlling said voltage divider circuit comprising:

a signal correction circuit which is supplied with said time signal and said signal corresponding to said display data, and corrects, in said first period, said signal corresponding to said display data and outputs corrected signal so that said first voltage is selected in said first period, and outputs, in said second period, said signal corresponding to said display data as input;

a selection circuit which is supplied with said time signal and said signal corresponding to said video data, and controls said voltage divider circuit so that said first voltage is selected in said first period, and said second voltage is selected in said second period.

27. A liquid-crystal display system according to claim 25, said circuit for controlling said voltage divider circuit further comprising:

a selector circuit which is supplied with said signal corresponding to said display data, and selects and outputs said second voltage in response to said signal corresponding to said display data, an output correction circuit which is supplied with said time signal, and selects and outputs said first voltage in said first period instead of an output from said selection circuit while inhibiting output from said selection circuit in said first period, and releases the inhibition in said second period.

28. An X driver circuit which is used for a liquid-crystal display system having a liquid crystal panel and a power source for the liquid-crystal display, and which generates and outputs from a plurality of voltages output from said power source for the liquid-crystal display a display voltage corresponding to display data supplied from an external system via a plurality of data lines comprising:

a voltage divider circuit which is supplied with n voltages of n different voltage levels, and generates m voltages of m different voltage levels, from said n voltages ($n<m$, wherein n and m are integers greater than 2), and outputs a selected one of the m voltages; and a control circuit which is externally supplied with a time signal to divide a horizontal scanning cycle into a first period and a subsequent second period, and controls said voltage divider circuit so that a first voltage is selected from said m voltages in said first period, and a second voltage is selected in said second period from said m voltages, in response to said time signal and said signal corresponding to said display data, in a manner that a time constant when said first voltage is output to said liquid-crystal panel is smaller than a time constant when said second voltage is output to said liquid-crystal panel, said second voltage corresponding to said display data;

wherein said circuit divider circuit outputs said first and second voltages as selected, in said first and second period to said liquid-crystal panel, respectively.

29. An X driver circuit according to claim 28, wherein said circuit for controlling voltage divider circuit comprises:

a signal correction circuit which is supplied with said time signal and said signal corresponding to said display data, and corrects in said first period said signal corresponding to said display data and outputs a corrected signal so that said first voltage is selected in said first period, and which, in said second period, outputs said signal corresponding to said display data as input;

a selection circuit which is supplied with said time signal and said signal corresponding to said display data, and controls said voltage divider circuit so that said first voltage is selected in said first period, and said second voltage is selected in said second period.

30. An X driver circuit according to claim 29, wherein said m voltages generated by said voltage generation circuit include said n voltages, and said control circuit gives a command to said voltage divider circuit to select one voltage, as the first voltage, from said n voltages.

31. An X driver circuit according to claim 30, wherein said m voltages of said voltage divider circuits include n voltages of n different voltage levels to be supplied from an external system, and said control circuit gives a command to said voltage divider circuits to select one voltage as the first voltage from n voltages of n different voltage levels.

32. An X driver circuit as defined in claim 30, further comprising:

a decoder circuit provided for each of said data lines, which is supplied with said display data, and which generates a decoded signal for selecting said second voltage corresponding to said display data from among said m voltages of m different voltage levels; wherein said signal correction circuit includes a decoded signal alteration circuit which operates upon receiving said time signal to alter the output of said decoder circuit to a predetermined decoded signal during said first period and to a decoded signal corresponding to said video data during said second period, and said selector circuit delivers said voltage upon receiving the altered decoded signal.

33. A liquid-crystal display system for presenting displays, comprising:

said X driver circuit as defined in claims 22;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides one horizontal scanning cycle into a first period and a second period, and supplies the time signal to said X driver circuit.

34. An X driver circuit as defined in claim 30, further comprising:

a decoder circuit provided for each of said data lines, which is supplied with said display data, and which generates a decoded signal for selecting said second voltage corresponding to said display data from among said m voltages of m different voltage levels; wherein said signal correction circuit includes a display data alteration circuit which is disposed at a state preceding said decoder circuit, and which operates upon receiving said time signal to alter the input of said decoder circuit to predetermined display data during said first period and to the supplied display data during said second period, and said decoder circuit operating upon receiving the altered display data to generate said decoded signal for selecting said second voltage corresponding to said display data.

35. A liquid-crystal display system for presenting displays, comprising:

said X driver circuit as defined in claim 34;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides one horizontal scanning cycle into a first period and a second period, and supplies the time signal to said X driver circuit.

36. An X driver circuit as defined in claim 30, further comprising:

a decoder circuit provided for each of said data lines, which is supplied with the display data having a plurality of bits, and which generates a decoded signal for selecting said second voltage corresponding to said display data from among said m voltages of m different voltage levels; wherein said signal correction circuit corrects said signal corresponding to said display data, so as to deliver as said first voltage a voltage which corresponds to a specified bit in said display data.

37. A liquid-crystal display system for presenting displays, comprising:

said X driver circuit as defined in claim 36;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides one horizontal scanning cycle into a first period and a second period, and supplies the time signal to said X driver circuit.

38. A liquid-crystal display system for presenting displays, comprising:

said X driver circuit as defined in claim 30;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides one horizontal scanning cycle into a first period and a second period, and supplies the time signal to said X driver circuit.

39. An X driver circuit as defined to claim 29, further comprising:

a decoder circuit provided for each of said data lines, which is supplied with said display data, and which generates a decoded signal for selecting said second voltage corresponding to said display data from among said m voltages of m different voltage levels; wherein said signal correction circuit includes a decoded signal alteration circuit which operates upon receiving said time signal to alter the output of said decoder circuit to a predetermined decoded signal during said first period and to a decoded signal corresponding to said display data during said second period, and said selector circuit delivers said voltage upon receiving the altered decoded signal.

40. A liquid-crystal display system for presenting displays, comprising:

said X driver circuit as defined in claim 39;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides one horizontal scanning cycle into a first period and a second period, and supplies the time signal to said X driver circuit.

41. An X driver circuit as defined in claim 29, further comprising:

a decoder circuit provided for each of said data lines, which is supplied with said display data, and which generates a decoded signal for selecting said second voltage corresponding to said display data from among said m voltages of m different voltage levels; wherein said signal correction circuit includes a display data alteration circuit which is disposed at a stage preceding said decoder circuit, and which operates upon receiving said time signal to alter the input of said decoder circuit to predetermined display data during said first period and to the supplied display data during said second period, and said decoder circuit operating upon receiving the altered display data to generate said decoded signal for selecting said second voltage corresponding to said display data.

42. A liquid-crystal display system for presenting displays, comprising:

said X driver circuit as defined in claim 41;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides one horizontal scanning cycle into a first period and a second period, and supplies the time signal to said X driver circuit.

43. An X driver circuit as defined in claim 29, further comprising:

a decoder circuit provided for each of said data lines, which is supplied with the display data having a plurality of bits, and which generates a decoded signal for selecting said second voltage corresponding to said display data from among said m voltages of m different voltage levels; wherein said signal correction circuit corrects said signal corresponding to said display data, so as to deliver, as said first voltage a voltage which corresponds to a specified bit in said display data.

44. A liquid-crystal display system for presenting displays, comprising:

said X driver circuit as defined in claim 43;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides on horizontal scanning cycle into a first period and a second period, and supplies the time signal to said X driver circuit.

45. A liquid-crystal display system for presenting displays, comprising:

said X driver circuit as defined in claim 29;

said liquid-crystal panel, including a plurality of scanning lines and said plurality of data lines;

a Y driver circuit by which one of the plurality of scanning lines to have said voltage applied thereto is selected, and which transmits said voltage to said selected one of the plurality of scanning lines, wherein said power source for said liquid-crystal displays supplies said voltages to said Y driver circuit and said X driver circuit; and a control signal generator circuit for generating a time signal which divides on horizontal scanning cycle into a first period and a second period, and supplies the time signal to said X driver circuit.

46. A liquid-crystal display system for tonal display, including:

a liquid crystal panel having a plurality of scanning lines and a plurality of data lines;

a Y driver circuit by which one of the plurality of scanning lines to have a voltage applied thereto is selected, and which transmits the voltage to the selected one of the plurality of scanning lines;

an X driver circuit which is supplied with display data, and which transmits a voltage corresponding to the display data to each of the plurality of data lines; and a power source, which supplies voltages to the Y driver circuit and the X driver circuit, the supplied voltages of the X driver circuit being n voltages having n different voltage levels, said X driver circuit comprising:

a plurality of voltage divider circuits which generate m voltages having m different voltage levels from said n voltages supplied from said power source for the liquid-crystal display system (n<m, wherein n and m are integers greater than 2), and outputs one of the m voltages, a plurality of control circuits which divide a horizontal scanning cycle into a second period and a preceding first period and control said voltage divider circuits to select a second voltage corresponding to said display data from said m voltages and selecting a first voltage in a manner that an output impedance of said voltage divider circuit is smaller in said first period than an output impedance in said second period, wherein each of said voltage divider circuits outputs selected voltages to each of the data lines in said first period and said second period respectively.

47. A liquid-crystal display system according to claim 46, wherein said m voltages capable of generation by said voltage divider circuits include n voltages of n different levels which are supplied from said power source for liquid-crystal display.

48. A liquid-crystal display system according to claim 46, wherein said control circuit gives a command to said voltage divider circuits to select any one voltage from n voltages of different levels supplied from said power source for said liquid-crystal display for said first period.

49. A liquid-crystal display system according to claim 46, further comprising:

a control signal generator circuit for generating a time signal which divides one horizontal scanning cycle into a first period and a subsequent second period; and said control circuit for controlling said voltage divider circuits further comprises:

a signal correction circuit which is supplied with said time signal and said signal corresponding to said display data, and corrects in said first period said signal corresponding to said display data and outputs the corrected signal so that a voltage may be selected in a manner that an output impedance of said voltage divider circuit may be smaller in said first period, and outputs in said second period said signal corresponding to said display data as input, and a selection circuit which is supplied with said time signal and said signal corresponding to said display data, and controls said voltage divider circuits so that the voltage is selected which makes the output impedance of said voltage divider circuit smaller in said first period, and the voltage corresponding to said display data may be selected in said second period.

50. A liquid-crystal display system according to claim 46, further comprising:

a control signal generator circuit for generating a time signal which divides one horizontal scanning cycle into a first period and a subsequent second period; and said control circuit for controlling said voltage divider circuits further comprises:

a selector circuit which is supplied with said signal corresponding to said display data, and selects a voltage from said m voltages of m different levels and output said voltage in response to said signal corresponding to said display data, and a circuit which is supplied with said time signal, and selects and outputs a voltage from said m voltages instead of an output from said selector circuit, such that an output impedance of said voltage divider circuit is smaller in said first period, while inhibiting output from said selector circuit in said first period, and releases the inhibition in said second period.

51. An X driver circuit which is used for a liquid-crystal display system including a liquid crystal panel having a plurality of scanning lines and a plurality of data lines, which generates and outputs a display voltage from a plurality of given voltages corresponding to display data supplied from an external system, comprising:

a plurality of voltage divider circuits which are supplied with n voltages of n different voltage levels and generate m voltages of m different voltage levels, from said n voltages (n<m, wherein n and m are integers greater than 2), and outputs selected one of the voltages; and a plurality of control circuits which divide a horizontal scanning cycle into a second period and a preceding first period, and gives a command to said voltage divider circuits to select a second voltage corresponding to said display data from said m voltages in said second period and selects a first voltage in said first period such that an output impedance of said voltage divider circuit smaller in said first period compared to that in said second period;

wherein each of said voltage divider circuits outputs said first and second voltages as selected, in said first and second period to said data lines respectively.

52. A liquid-crystal display system according to claim 51, further comprising:

a control signal generator circuit for generating a time signal which divides one horizontal scanning cycle into a first period and a subsequent second period;

a signal correction circuit which is supplied with said time signal and said signal corresponding to said display data, and corrects, in said first period, said signal corresponding to said display data and outputs a corrected signal so that said first voltage may be selected in said first period, and outputs, in said second period, said signal corresponding to said display data as input; and a selection circuit which is supplied with said time signal and said signal corresponding to said display data, and controls said voltage divider circuit so that said first voltage is selected in said first period, and said second voltage is selected in said second period.

* * * * *